US008432345B2

(12) United States Patent
Asano

(10) Patent No.: US 8,432,345 B2
(45) Date of Patent: Apr. 30, 2013

(54) DISPLAY APPARATUS, LAYOUT METHOD FOR A DISPLAY APPARATUS AND AN ELECTRONIC APPARATUS

(75) Inventor: Mitsuru Asano, Aichi (JP)

(73) Assignee: Sony Corporation, Tokyo (JP)

( * ) Notice: Subject to any disclaimer, the term of this patent is extended or adjusted under 35 U.S.C. 154(b) by 241 days.

(21) Appl. No.: 13/064,247

(22) Filed: Mar. 14, 2011

(65) Prior Publication Data

US 2011/0248906 A1 Oct. 13, 2011

(30) Foreign Application Priority Data

Apr. 8, 2010 (JP) ..... 2010-089803

(51) Int. Cl.
*G09G 3/36* (2006.01)

(52) U.S. Cl.
USPC ..... 345/92; 345/88

(58) Field of Classification Search ..... 345/92, 345/88

See application file for complete search history.

(56) References Cited

U.S. PATENT DOCUMENTS

| | | | | |
|---|---|---|---|---|
| 5,485,293 | A * | 1/1996 | Robinder | 345/92 |
| 6,552,706 | B1 * | 4/2003 | Ikeda et al. | 345/92 |
| 2002/0033809 | A1 | 3/2002 | Nakajima | |
| 2005/0264498 | A1 | 12/2005 | Asano | |
| 2010/0118058 | A1 * | 5/2010 | Murai et al. | 345/88 |
| 2010/0302131 | A1 * | 12/2010 | Tsubata | 345/87 |

FOREIGN PATENT DOCUMENTS

| | | |
|---|---|---|
| JP | 2002-032051 | 1/2002 |
| JP | 2005-338592 A | 12/2005 |

* cited by examiner

*Primary Examiner* — Kevin M Nguyen

(74) *Attorney, Agent, or Firm* — Rader, Fishman & Grauer PLLC

(57) ABSTRACT

Disclosed herein is a display apparatus, including, a pixel array section including a plurality of pixel circuits arrayed in rows and columns of a matrix and each including a light emitting portion, a plurality of signal lines disposed individually for the pixel columns of the matrix array of the pixel circuits and connected to the pixel circuits belonging to the pixel columns, and a selector circuit for distributing display signals given thereto in a time series from an input signal line time-divisionally to the signal lines, the pixel array section has, in regard to any of combinations of those two signal lines which are individually connected to the pixel circuits which belong to those two pixel columns which neighbor with each other, a first wiring region, and a second wiring region.

20 Claims, 53 Drawing Sheets

CONVENTIONAL EXAMPLE

FRAME INVERSION

LINE INVERSION

FRAME INVERSION
+ LINE INVERSION

DOT INVERSION

FRAME INVERSION
+ LINE INVERSION
+ DOT INVERSION

DISPLAY APPARATUS, LAYOUT METHOD FOR A DISPLAY APPARATUS AND AN ELECTRONIC APPARATUS

BACKGROUND OF THE INVENTION

1. Field of the Invention

This invention relates to a display apparatus, a layout method for a display apparatus and an electronic apparatus, and more particularly to a display apparatus of the flat type wherein a plurality of pixel circuits each including a light emitting portion are arrayed two-dimensionally in rows and columns or in a matrix, a layout method for the display apparatus, and an electronic apparatus including the display apparatus.

2. Description of the Related Art

In recent years, in the field of display apparatus for displaying an image, a display apparatus of the flat type or flat panel type wherein a plurality of pixel circuits, which may be hereinafter referred to sometimes as pixels, are arrayed or disposed in rows and columns has spread rapidly. As one of such flat type display apparatus, a display apparatus is available wherein an electro-optical element of the current driven type whose emitted light luminance varies in response to the value of current flowing to the element is used as a light emitting portion or element of a pixel. As the electro-optical element of the current driven type, an organic EL element is known which is formed from electroluminescence of an organic material and utilizes a phenomenon that an organic thin film emits light when an electric field is applied thereto.

An organic EL display apparatus which uses an organic EL element as a light emitting portion of a pixel has the following characteristics. In particular, the power consumption of the organic EL display apparatus is low because the organic EL element can be driven by an application voltage lower than 10 V. Since the organic EL element is a self-luminous element, the organic EL display apparatus displays an image of observability higher than that of a liquid crystal display apparatus. Besides, since an illumination member such as a backlight is not required, reduction in weight and thickness of the organic EL display apparatus can be implemented readily. Further, since the organic EL element operates at a very high response speed of approximately several microseconds, an after-image upon display of a dynamic picture image does not appear.

A flat type display apparatus such as an organic EL display apparatus or a liquid crystal display apparatus can adopt a passive matrix driving method and an active matrix driving method as a driving method thereof. A display apparatus of the active matrix type from between the two types can be implemented readily as a large-size high-definition display apparatus because the electro-optical element continues light emission over a period of one display frame. In a display apparatus of the active matrix type, current to flow to the electro-optical element is controlled by an active element such as, for example, an insulated gate type field effect transistor provided in a pixel in which the electro-optical element is provided. As the insulated gate type field effect transistor, generally a TFT (Thin Film Transistor) is used.

Incidentally, in a flat type display apparatus such as an organic EL display apparatus or a liquid crystal display apparatus, a pixel array section wherein pixels are arrayed in a matrix sometimes adopts a layout structure wherein two signal lines connected to pixel circuits belonging to two pixel columns neighboring with each other are wired in a neighboring relationship with each other. As one of layout structures of the type just described, for example, a structure is known wherein pixel circuits in an odd-numbered column and pixel circuits in an even-numbered column neighboring with each other across an axis of a column direction of a matrix pixel array are laid out symmetrically with each other with respect to the axis of the column direction.

In the following description, the structure wherein pixel circuits in an odd-numbered column and pixel circuits in an even-numbered column neighboring with each other across an axis of a column direction of a matrix pixel array are laid out symmetrically with each other with respect to the axis of the column direction is referred to as mirror type layout structure. The mirror type layout structure is advantageous in that efficient layout of the pixel array section can be anticipated and the degree of freedom is enhanced.

However, in the case where the mirror type layout structure is adopted, signal lines extending in the direction of a column sometimes neighbor with each other between pixel circuits of an odd-numbered column and an even-numbered column. Therefore, in order to prevent parasitic capacitance from existing between the signal lines neighboring with each other, a shield line is wired between the signal lines neighboring with each other as disclosed, for example, in Japanese Patent Laid-Open No. 2005-338592.

On the other hand, a flat type display apparatus such as an organic EL display apparatus or a liquid crystal display apparatus is known which adopts a selector driving method in order to achieve reduction of the number of outputs of a driving section for supplying display signals to a display panel from the outside of the display panel. A flat type display apparatus of the type described is disclosed, for example, in Japanese Patent Laid-Open No. 2002-032051. The selector driving method is sometimes called time-divisional driving method.

In the selector driving method, a plurality of signal lines from among signal lines on a display panel are allocated as a unit or group to one output of a driving section outside the display panel to carry out driving such that display signals outputted in a time series from the driving section are distributed time-divisionally to the plural signal lines by means of a selector circuit. The selector driving method is advantageous in that, in the case where the number of signals to make a unit is, for example, three, the number of outputs of the driving section outside the display panel can be reduced to ⅓ with respect to the total number of signal lines on the display panel.

SUMMARY OF THE INVENTION

The technique disclosed in Japanese Patent Laid-Open No. 2005-338592 can eliminate existence of parasitic capacitance between signal lines neighboring with each other by wiring a shield line between the neighboring signal lines. However, since the shield line is wired in addition to the signal lines, the technique is not necessarily considered an optimum technique. In particular, since the shield line originally is unnecessary for driving of the pixel circuit, it increases the number of wiring lines in the pixel array and therefore imposes restrictions to the layout of wiring lines.

On the other hand, where both of the mirror type layout structure and the selector driving method are used, if parasitic capacitance exists between two signal lines neighboring with each other, then if select timings of the selector circuit for the two signal lines are different from each other, then a fault occurs. In particular, a display signal written into a signal line first is influenced by another signal written later into the other signal line, and therefore, accurate display signals cannot be written into the signal lines (details are hereinafter described).

If accurate display signals cannot be written into the signal lines, then a resulting display image suffers from deterioration of the picture quality.

While the fault in the case where both of the mirror type layout structure and the selector driving method are used is described, also in the case where the selector driving method is used solely, if writing timings of display signals into two signal lines neighboring with each other are different from each other, then a similar fault occurs.

Therefore, it is desirable to provide a display apparatus, a layout method for a display apparatus and an electronic apparatus which make it possible to write accurate display signals even if writing timings of display signals into two signal lines connected to pixel circuits belonging to two pixel columns neighboring with each other are different from each other.

According to an embodiment of the present invention there is provided a display apparatus, including:

a pixel array section including a plurality of pixel circuits arrayed in rows and columns of a matrix and each including a light emitting portion;

a plurality of signal lines disposed individually for the pixel columns of the matrix array of the pixel circuits and connected to the pixel circuits belonging to the pixel columns; and a selector circuit for distributing display signals given thereto in a time series from an input signal line time-divisionally to the signal lines; wherein the pixel array section has, in regard to any of combinations of those two signal lines which are individually connected to the pixel circuits which belong to those two pixel columns which neighbor with each other;

a first wiring region in which, in the case where the display signals are to be distributed at different timings to the two signal lines of the combination by the selector circuit, the two signal lines are wired so as not to neighbor with each other, and a second wiring region in which, in the case where the display signals are to be distributed at the same timing to the two signal lines of the combination by the selector circuit, the two signal lines are wired so as to neighbor with each other.

According to another embodiment of the present invention there is provided a layout method for a display apparatus which includes a pixel array section including a plurality of pixel circuits arrayed in rows and columns of a matrix and each including a light emitting portion, a plurality of signal lines disposed individually for the pixel columns of the matrix array of the pixel circuits and connected to the pixel circuits belonging to the pixel columns, and a selector circuit for distributing display signals given thereto in a time series from an input signal line time-divisionally to the signal lines, the layout method including the step of:

laying out the signal lines such that, in regard to any of combinations of those two signal lines which are individually connected to the pixel circuits which belong to those two pixel columns which neighbor with each other, the two signal lines are wired so as not to neighbor with each other in the case where the display signals are to be distributed at different timings to the two signal lines of the combination by the selector circuit, but the two signal lines are wired so as to neighbor with each other in the case where the display signals are to be distributed at the same timing to the two signal lines of the combination by the selector circuit.

According to yet another embodiment of the present invention there is provided an electronic apparatus, including:

a display apparatus including a pixel array section including a plurality of pixel circuits arrayed in rows and columns of a matrix and each including a light emitting portion, a plurality of signal lines disposed individually for the pixel columns of the matrix array of the pixel circuits and connected to the pixel circuits belonging to the pixel columns, and a selector circuit for distributing display signals given thereto in a time series from an input signal line time-divisionally to the signal lines; wherein the pixel array section has, in regard to any of combinations of those two signal lines which are individually connected to the pixel circuits which belong to those two pixel columns which neighbor with each other, a first wiring region in which, in the case where the display signals are distributed at different timings to the two signal lines of the combination by the selector circuit, the two signal lines are wired so as not to neighbor with each other, and a second wiring region in which, in the case where the display signals are distributed at the same timing to the two signal lines of the combination by the selector circuit, the two signal lines are wired so as to neighbor with each other.

In the display apparatus, in any combination wherein the display signals are to be distributed by the selector circuit at different timings to the two signal lines from among the combinations of those two signal lines which are individually connected to the pixel circuits which belong to those two pixel columns which neighbor with each other, the two signal lines do not neighbor with each other. Therefore, parasitic capacitance does not exist between the two signal lines. Accordingly, even if the display signals are written at different timings from each other into the two signal lines, the display signal written first into one of the signal lines is not influenced by the signal written later into the other signal line. On the other hand, in any combination wherein the display signals are to be distributed at the same timing to the two signal lines by the selector circuit, since the two signal lines neighbor with each other, parasitic capacitance exists between the two signal lines. However, even if such parasitic resistance exists, since the display signals are written at the same timing into the two signal lines, the display signals are not influenced by each other. Accordingly, in both combinations of two signal lines, writing of accurate display signals can be achieved.

With the display apparatus, even if writing timings of display signals into signal lines of two pixel columns neighboring with each other are different from each other, accurate display signals can be written into the signal lines. Accordingly, such picture quality deterioration by an influence of parasitic capacitance as in the apparatus hitherto known can be suppressed. As a result, the image apparatus can achieve a high yield and a high definition by efficient layout of the pixel array section according to the mirror type layout structure and can achieve high picture quality by writing of accurate display signals into signal lines.

DETAILED DESCRIPTION OF THE PREFERRED EMBODIMENTS

In the following, preferred embodiments of the present invention are described in detail with reference to the accompanying drawings. It is to be noted that the description is given in the following order:

1. Organic EL Display Apparatus to Which the Invention is Applied
   1-1. System configuration
   1-2. Basic circuit operation
   1-3. Mirror type layout structure
   1-4. Selector driving method
   1-5. Fault where two signal lines neighbor with each other
2. First Embodiment
   2-1. Working example 1
   2-2. Working example 2
   2-3. Working example 3
   2-4. Second selection method
   2-5. Working example 4
3. Subject of the Selector Driving Method
4. Second Embodiment
   4-1. Working example 1
   4-2. Working example 2
   4-3. Working example 3
   4-4. Working example 4
   4-5. Working example 5
   4-6. Working example 6
   4-7. Working example 7
   4-8. Working example 8
   4-9. Working example 9
   4-10. Working example 10
   4-11. Working example 11
   4-12. Working example 12
   4-13. Working effect where the embodiment is applied to an organic EL display apparatus
5. Modifications
6. Electronic Apparatus <1. Organic EL Display Apparatus to which the Invention is Applied>

[1-1. System Configuration]

Figure 1:
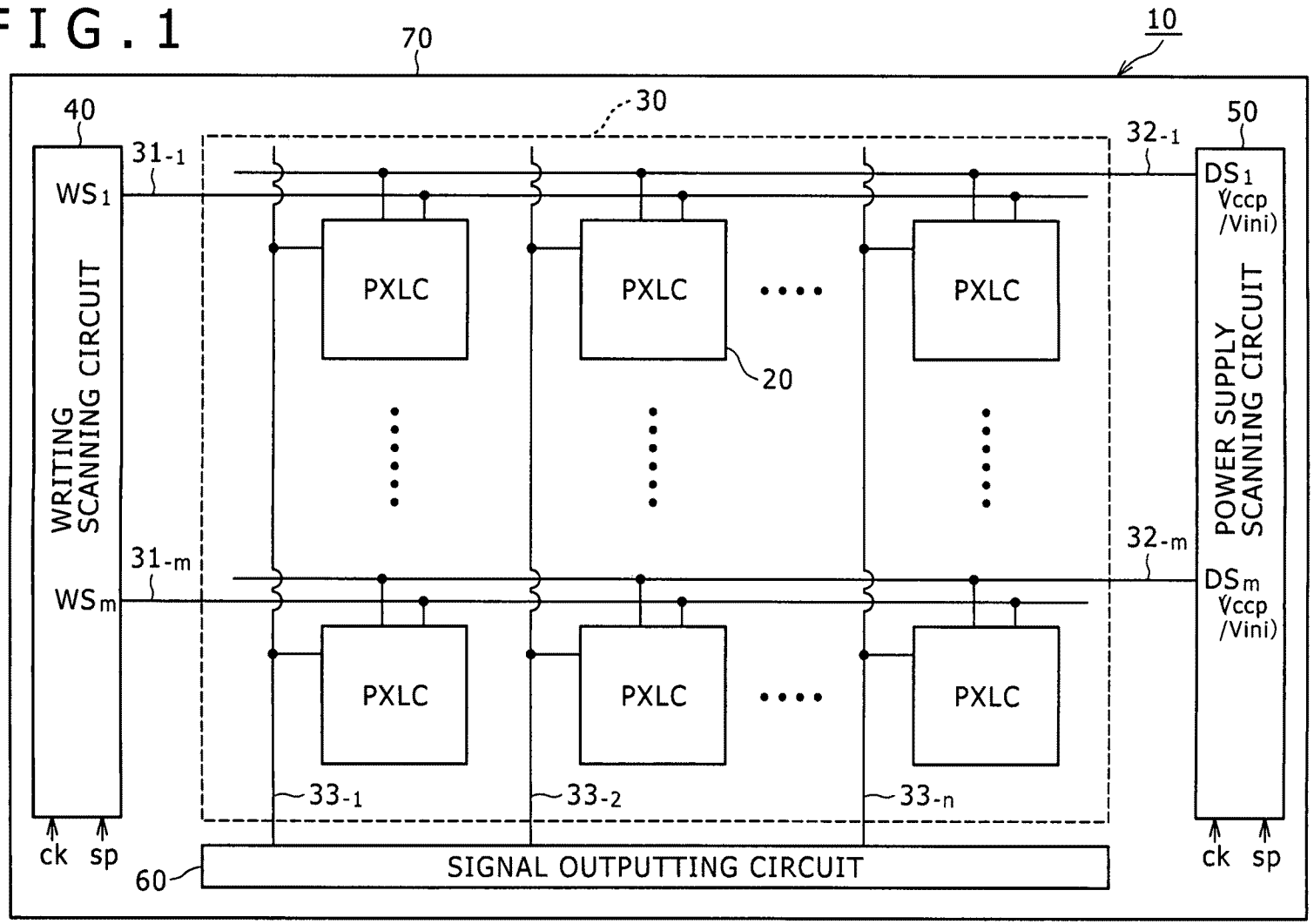
FIG. 1 is a block diagram showing a general configuration of an organic EL display apparatus to which the present invention is applied.

FIG. 1 is a system diagram showing a general configuration of an active matrix display apparatus to which the present invention is applied.

The active matrix display apparatus is a display apparatus wherein current to flow to an electro-optical element is controlled by an active element provided in a pixel in which the electro-optical element is provided such as, for example, an insulated gate field effect transistor. As the insulated gate field effect transistor, a TFT, that is, a thin film transistor, is used popularly.

Here, description is given taking an active matrix organic EL display apparatus wherein an electro-optical element of the current driven type, for example, an organic EL element, whose emitted light luminance varies in response to a current value flowing though the device is used as a light emitting element of a pixel or pixel circuit as an example.

Referring to FIG. 1, the organic EL display apparatus 10 shown includes a plurality of pixels 20 each including an organic EL element, a pixel array section 30 in which the pixels 20 are arrayed two-dimensionally in a matrix, and driving sections disposed around the pixel array section 30. The driving sections include a writing scanning circuit 40, a power supply scanning circuit 50, a signal outputting circuit 60 and so forth and drive the pixels 20 of the pixel array section 30.

Here, if the organic EL display apparatus 10 is ready for color display, one pixel, that is, a unit pixel, is configured from a plurality of subpixels which each corresponds to a pixel 20. More particularly, in a display apparatus for color display, one pixel is configured from three subpixels including a subpixel which emits red light (R), another subpixel which emits green light (G) and a further subpixel which emits blue light (B).

It is to be noted, however, that one pixel is not limited to the combination of subpixels of the three primary colors of RGB but may be configured from a subpixel of one color or a plurality of subpixels of different colors in addition to subpixels of the three primary colors. More particularly, for example, it is possible to additionally include a subpixel which emits white light (W) for enhancing the luminance to form one pixel or to additionally include at least one subpixel which emits light of a complementary color in order to expand the color reproduction range.

In the pixel array section 30, scanning lines $\mathbf{31}_{-1}$ to $\mathbf{31}_{-m}$ and power supply lines $\mathbf{32}_{-1}$ to $\mathbf{32}_{-m}$ are wired for individual pixel rows along a row direction, that is, an array direction of the pixels of the pixel rows, for the array of the pixels 20 in the m rows and n columns. Further, signal lines $\mathbf{33}_{-1}$ to $\mathbf{33}_{-n}$ are wired for the individual pixel columns along a column direction, that is, in an array direction of the pixels of the pixel columns.

The scanning lines $\mathbf{31}_{-1}$ to $\mathbf{31}_{-m}$ are individually connected to output terminals of corresponding rows of the writing scanning circuit 40. The power supply lines $\mathbf{32}_{-1}$ to $\mathbf{32}_{-m}$ are individually connected to output terminals of corresponding rows of the power supply scanning circuit 50. The signal lines $\mathbf{33}_{-1}$ to $\mathbf{33}_{-n}$ are individually connected to output terminals of corresponding columns of the signal outputting circuit 60.

The pixel array section 30 is usually formed on a transparent insulating substrate such as a glass substrate. Consequently, the organic EL display apparatus 10 has a panel structure of the planar or flat type. A driving circuit for each pixel 20 of the pixel array section 30 can be formed using an amorphous silicon TFT or a low-temperature polycrystalline silicon TFT. In the case where a low-temperature polycrystalline silicon TFT is used, also the writing scanning circuit 40, power supply scanning circuit 50 and signal outputting circuit 60 can be mounted on a display panel or board 70 on which the pixel array section 30 is formed as seen in FIG. 1.

The writing scanning circuit 40 is configured from a shift register or the like which successively shifts or transfers a start pulse sp in synchronism with a clock pulse ck. Upon writing of an image signal into the pixels 20 of the pixel array section 30, the writing scanning circuit 40 successively supplies a write scanning signal WS ($WS_1$ to $WS_m$) to the scanning lines $\mathbf{31}_{-1}$ to $\mathbf{31}_{-m}$ to scan the pixels 20 in order in a unit of a row (line-sequential scanning).

The power supply scanning circuit 50 is configured from a shift register or the like which successively shifts the start pulse sp in synchronism with the clock pulse ck. The power supply scanning circuit 50 supplies a power supply potential DS ($DS_1$ to $DS_m$), which can be changed over between a first power supply potential $V_{ccp}$ and a second power supply potential $V_{ini}$ which is lower than the first power supply potential $V_{ccp}$, to the power supply lines $\mathbf{32}_{-1}$ to $\mathbf{32}_{-m}$ in synchronism with the line-sequential scanning by the writing scanning circuit 40. As hereinafter described, control of light emission/no-light emission of the pixels 20 is carried out by the changeover of the power supply potential DS between the first power supply potential $V_{ccp}$ and the second power supply potential $V_{ini}$ as hereinafter described.

The signal outputting circuit 60 selectively outputs a signal voltage $V_{sig}$ of an image signal corresponding to luminance information supplied thereto from a signal supply line (not shown) and a reference voltage $V_{ofs}$. The reference voltage $V_{ofs}$ is a voltage used as a reference to the signal voltage $V_{sig}$ of the image signal such as, for example, a voltage corresponding to the black level of the image signal and is used upon a threshold value correction process hereinafter described.

The signal voltage $V_{sig}$/reference voltage $V_{ofs}$ outputted from the signal outputting circuit 60 is written into the pixels 20 of the pixel array section 30 in a unit of a pixel row selected by scanning by the writing scanning circuit 40 through the signal lines $\mathbf{33}_{-1}$ to $\mathbf{33}_{-n}$. In other words, the signal outputting circuit 60 uses a driving form of line-sequential writing of writing the signal voltage $V_{sig}$ in a unit of a row or line.

Pixel Circuit

Figure 2:
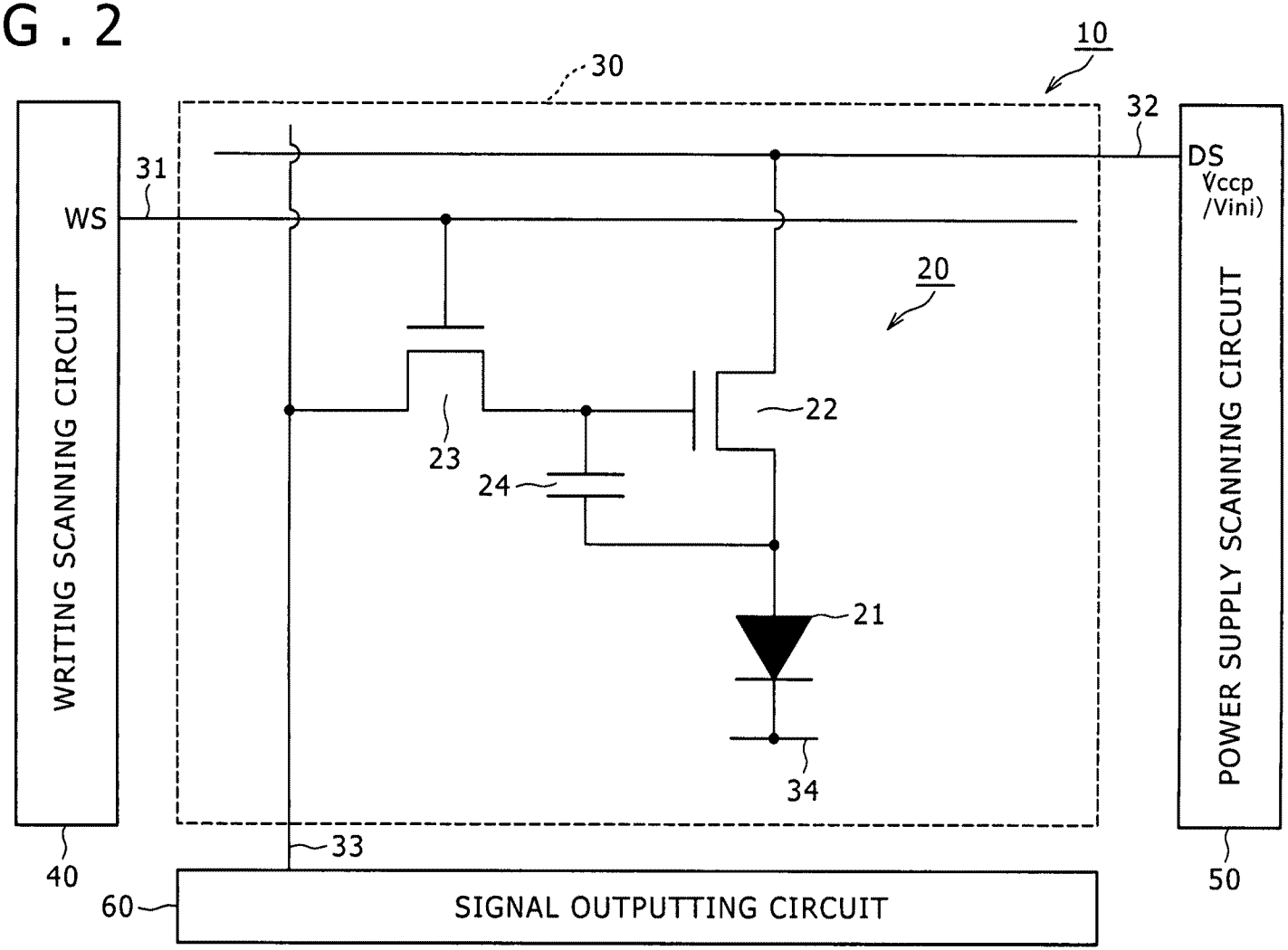
FIG. 2 is a circuit diagram showing an example of a circuit configuration of a pixel of the organic EL display apparatus.

FIG. 2 is a circuit diagram showing a particular circuit configuration of each pixel or pixel circuit 20. Referring to FIG. 2, the pixel 20 has a light emitting portion formed from an organic EL element 21 which is an electro-optical element of the current driven type whose emitted light luminance varies in response to the value of current flowing through the device.

In particular, the pixel 20 includes an organic EL element 21, and a driving circuit for supplying current to the organic EL element 21 to drive the organic EL element 21. The organic EL element 21 is connected at the cathode electrode thereof to a common power supply line 34 wired and connected commonly to all pixels 20.

The driving circuit for driving the organic EL element 21 includes a driving transistor 22, a writing transistor 23, and a holding capacitor 24. The driving transistor 22 and the writing transistor 23 may be configured using an N-channel TFT. However, the combination of the conduction types of the driving transistor 22 and the writing transistor 23 is a mere example, and the conduction types of the driving transistor 22 and the writing transistor 23 are not limited this combination.

It is to be noted that, if an N-channel TFT is used for the driving transistor 22 and the writing transistor 23, then they can be formed using an amorphous silicon (a-Si) process. Use of the a-Si process makes it possible to achieve reduction in cost of a substrate on which the TFTs are to be formed and hence in cost of the organic EL display apparatus 10. Further, if the same conduction type is used for the driving transistor 22 and the writing transistor 23, then the transistors 22 and 23 can be produced by the same process, which contributes to reduction in cost.

The driving transistor 22 is connected at one electrode thereof, that is, at one of the source/drain electrodes thereof, to the anode of the organic EL element 21 and at the other electrode thereof, that is, at the other one of the source/drain electrodes thereof, to a power supply line 32 ($\mathbf{32}_{-1}$ to $\mathbf{32}_{-m}$).

The writing transistor 23 is connected at one electrode thereof, that is, at one of the source/drain electrodes thereof, to a signal line 33 ($\mathbf{33}_{-1}$ to $\mathbf{33}_{-n}$) and at the other electrode thereof, that is, at the other one of the source/drain electrodes, to the gate electrode of the driving transistor 22. Further, the writing transistor 23 is connected at the gate electrode thereof to a scanning line 31 ($\mathbf{31}_{-1}$ to $\mathbf{31}_{-m}$).

The one electrode of the driving transistor 22 and the writing transistor 23 signifies a metal wiring line electrically connected to the source or drain region while the other electrode signifies another metal wiring line electrically connected to the drain or source region. Further, depending upon the potential relationship between the one electrode and the other electrode, the one electrode may serve as the source electrode or the drain electrode, and the other electrode may serve as the drain electrode or the source electrode.

The holding capacitor 24 is connected at one electrode thereof to the gate electrode of the driving transistor 22 and at the other electrode thereof to the other electrode of the driving transistor 22 and the anode electrode of the organic EL element 21.

It is to be noted that the circuit configuration of the driving circuit for the organic EL element 21 is not limited to that which includes the two transistors of the driving transistor 22 and the writing transistor 23 and the one capacitance element of the holding capacitor 24. For example, also it is possible for the driving circuit to have another configuration which additionally includes an auxiliary capacitor connected at one electrode thereof to the anode electrode of the organic EL element 21 and at the other electrode thereof to a fixed potential for compensating for a deficiency of the capacitance of the organic EL element 21.

In the pixel 20 having the configuration described above, the writing transistor 23 is placed into a conducting state in response to a High active writing scanning signal WS applied to the gate electrode thereof from the writing scanning circuit 40 through the scanning line 31. Consequently, the writing transistor 23 samples the signal voltage $V_{sig}$ of the image signal representative of luminance information supplied thereto from the signal outputting circuit 60 through the signal line 33 or the reference voltage $V_{ofs}$ and writes the sample voltage into the pixel 20. The signal voltage $V_{sig}$ or the reference voltage $V_{ofs}$ written in this manner is applied to the gate electrode of the driving transistor 22 and retained by the holding capacitor 24.

The driving transistor 22 operates, when the power supply potential DS of the power supply line 32 ($\mathbf{32}_{-1}$ to $\mathbf{32}_{-m}$) is the first power supply potential $V_{ccp}$, in a saturation region in which one electrode thereof serves as the drain electrode and the other electrode thereof serves as the souse electrode. Consequently, the driving transistor 22 receives supply of current from the power supply line 32 and drives the organic EL element 21 to emit light. More particularly, the driving transistor 22 operates in a saturation region thereof to supply driving current in the form of DC (Direct Current) having a current value corresponding to the voltage value of the signal voltage $V_{sig}$ retained in the holding capacitor 24 to current drive the organic EL element 21 to emit light.

Further, when the power supply potential DS changes over from the first power supply potential $V_{ccp}$ to the second power supply potential $V_{ini}$, the driving transistor 22 operates as a switching transistor such that the one electrode thereof serves as the source electrode and the other electrode thereof serves as the drain electrode. Consequently, the driving transistor 22 stops supply of driving current to the organic EL element 21 to place the organic EL element 21 into a no-light emitting state. In other words, the driving transistor 22 has a function also as a transistor for controlling light emission/no-light emission of the organic EL element 21.

The switching operation of the driving transistor 22 makes it possible to provide a period within which the organic EL element 21 is in a no-light emitting state, that is, a no-light emitting period, and control the rate between the light emitting period and the no-light emitting period, that is, the duty, of the organic EL element 21. By this duty control, after-image blurring caused by light emission of a pixel over a period of one display frame can be reduced, and consequently, the quality particularly of moving pictures can be enhanced.

The first power supply potential $V_{ccp}$ from between the first and second power supply potentials $V_{ccp}$ and $V_{ini}$ selectively supplied from the power supply scanning circuit 50 through the power supply line 32 is used to supply driving current for driving the organic EL element 21 to emit light to the driving transistor 22. On the other hand, the second power supply potential $V_{ini}$ is used to apply a reverse bias to the organic EL element 21. The second power supply potential $V_{ini}$ is set to a potential lower than the reference voltage $V_{ofs}$, for example, where the threshold voltage of the driving transistor 22 is represented by $V_{th}$, to a potential lower than $V_{ofs}-V_{th}$, preferably to a potential sufficiently lower than $V_{ofs}-V_{th}$.

[1-2. Basic Circuit Operation]

Now, basic circuit operation of the organic EL display apparatus 10 having the configuration described above is described with reference to a timing waveform diagram of FIG. 3 and also with reference to FIGS. 4A to 4H. It is to be noted that, in the circuit diagrams of FIGS. 4A to 4H, the writing transistor 23 is indicated by a symbol of a switch for the simplified illustration. Also equivalent capacitance 25 of the organic EL element 21 is shown.

Figure 3:
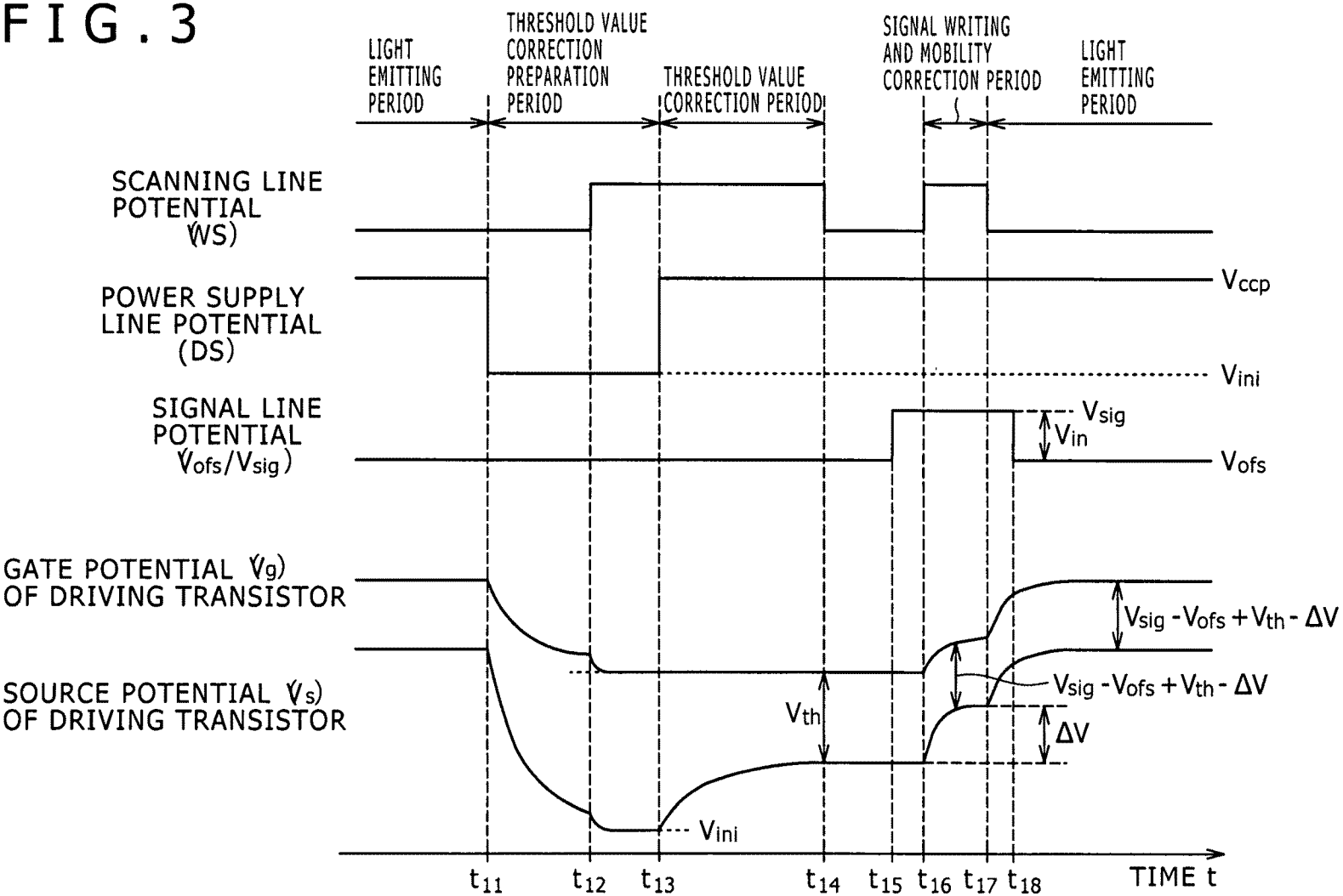
FIG. 3 is a timing chart illustrating basic circuit operation of the organic EL display apparatus.

In the timing waveform diagram of FIG. 3, the potential of the scanning line 31, that is, the write scanning signal WS, a potential of the power supply line 32, that is, the power supply potential DS, a potential $V_{sig}/V_{ofs}$ of the signal line 33 and the gate potential $V_g$ and the source potential $V_s$ of the driving transistor 22 are illustrated.

Light Emitting Period of a Preceding Display Frame

In the timing waveform diagram of FIG. 3, a period prior to time $t_{11}$ is a light emitting period of the organic EL element 21 in a preceding display frame. Within this light emitting period of the preceding display frame, the power supply potential DS has the first power supply potential (hereinafter referred to as "high potential") $V_{ccp}$ and the writing transistor 23 is in a non-conducting state.

At this time, the driving transistor 22 operates in a saturation region. Consequently, driving current $I_{ds}$ corresponding to the gate-source voltage $V_{gs}$ of the driving transistor 22 is supplied from the power supply line 32 to the organic EL element 21 through the driving transistor 22. Therefore, the organic EL element 21 emits light with a luminance in accordance with a current value of the driving current $I_{ds}$.

Threshold Value Correction Preparation Period

Figure 4A:
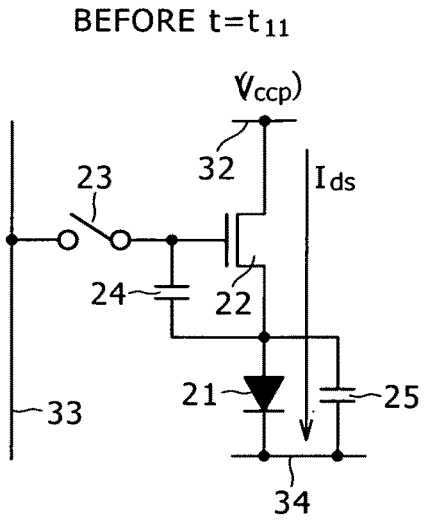
FIGS. 4A to 4H are circuit diagrams illustrating basic circuit operations of the organic EL display apparatus.
Figure 4B:
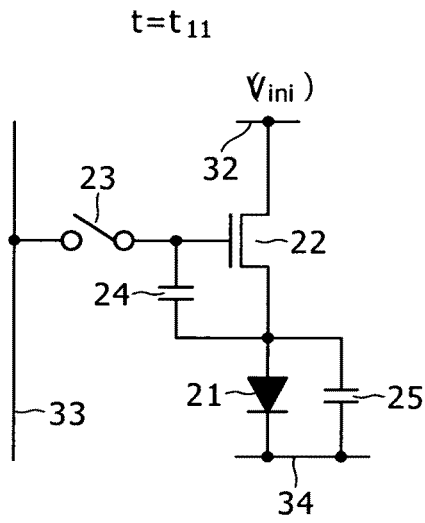

At time $t_{11}$, a new display frame or current display frame in line-sequential scanning is entered. Then as seen in FIG. 4B, the power supply potential DS of the power supply line 32 changes from the high potential $V_{ccp}$ to the second power supply potential (hereinafter referred to as "low potential") $V_{ini}$ which is sufficiently lower by $V_{ofs}-V_{th}$ than the reference voltage $V_{ofs}$ of the signal line 33.

Here, the threshold voltage of the organic EL element 21 is represented by $V_{the1}$ and the potential, that is, the cathode potential, of the common power supply line 34 is represented by $V_{cath}$. At this time, if the low potential $V_{ini}$ is set to $V_{ini}<V_{the1}+V_{cath}$, then since the source potential $V_s$ of the driving transistor 22 becomes substantially equal to the low potential $V_{ini}$, the organic EL element 21 is placed into a reversely biased state and stops the emission of light.

Figure 4C:
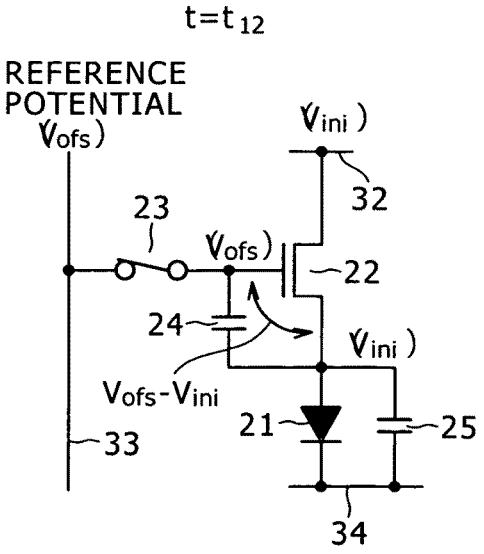

Then at time $t_{12}$, the write scanning signal WS of the scanning line 31 changes from the low potential side to the high potential side, and consequently, the writing transistor 23 is placed into a conducting state as seen in FIG. 4C. At this time, since the signal line 33 is in a state in which the reference voltage $V_{ofs}$ is supplied thereto from the signal outputting circuit 60, the gate potential $V_g$ of the driving transistor 22 becomes the reference voltage $V_{ofs}$. Meanwhile, the source potential $V_s$ of the driving transistor 22 is the low potential $V_{ini}$ sufficiently lower than the reference voltage $V_{ofs}$.

At this time, the gate-source voltage $V_g$, of the driving transistor 22 is $V_{ofs}-V_{ini}$. Here, if $V_{ofs}-V_{ini}$ is not higher than the threshold voltage $V_{th}$ of the driving transistor 22, then a threshold correction process hereinafter described cannot be carried out. Therefore, it is necessary to establish a potential relationship of $V_{ofs}-V_{ini}>V_{th}$.

The process of fixing the gate potential $V_g$ of the driving transistor 22 to the reference voltage $V_{ofs}$ and fixing the source potential $V_s$ to the low potential $V_{ini}$ to initialize them in this manner is a process for preparations, that is, for threshold value correction preparations, before a threshold value correction process or threshold value correction operation hereinafter described is carried out. Accordingly, the reference voltage $V_{ofs}$ and the low potential $V_{ini}$ are initialization potentials for the gate potential $V_g$ and the source potential $V_s$ of the driving transistor 22, respectively.

Threshold Value Correction Period

Figure 4D:
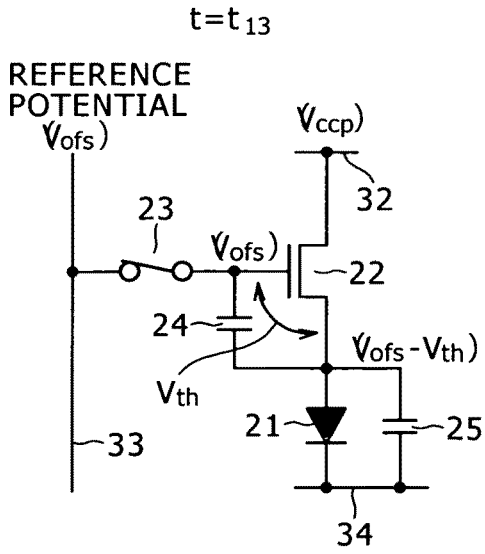

Then, when the power supply potential DS of the power supply line 32 changes over from the low potential $V_{ini}$ to the high potential $V_{ccp}$ as seen in FIG. 4D at time $t_{13}$, a threshold value correction process is started in the state in which the gate potential $V_g$ of the driving transistor 22 is maintained. In particular, the source potential $V_s$ of the driving transistor 22 starts its rise toward the potential of the difference of the threshold voltage $V_{th}$ of the driving transistor 22 from the gate potential $V_g$.

The process of varying the source potential $V_s$ of the driving transistor 22 toward the potential of the difference of the threshold voltage $V_{th}$ of the driving transistor 22 from the reference voltage $V_{ofs}$ with reference to the reference voltage $V_{ofs}$ of the gate electrode of the driving transistor 22 is referred to herein as threshold value correction process for the convenience of description. As the threshold value correction process advances, the gate-source voltage $V_{gs}$ of the driving transistor 22 soon converges to the threshold voltage $V_{th}$ of the driving transistor 22. A voltage corresponding to the threshold voltage $V_{th}$ is retained into the holding capacitor 24.

It is to be noted that, within the period within which the threshold value correction process is carried, that is, within the threshold value correction period, in order to allow current to flow to the holding capacitor 24 side but prevent current from flowing to the organic EL element 21 side, the potential $V_{cath}$ of the common power supply line 34 is set so that the organic EL element 21 has a cutoff state.

Figure 4E:
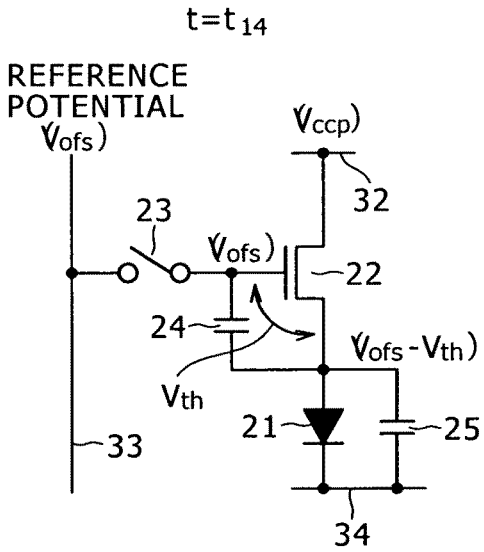

Then at time $t_{14}$, the write scanning signal WS of the scanning line 31 changes to the low potential side, and consequently, the writing transistor 23 is placed into a non-conducting state as seen in FIG. 4E. At this time, the gate electrode of the driving transistor 22 is electrically cut off from the signal line 33 and enters a floating state. However, since the gate-source voltage $V_{gs}$ is equal to the threshold voltage $V_{th}$ of the driving transistor 22, the driving transistor 22 remains in a cutoff state. Accordingly, the drain-source current $I_{ds}$ does not flow through the driving transistor 22.

Signal Writing and Mobility Correction Period

Figure 4F:
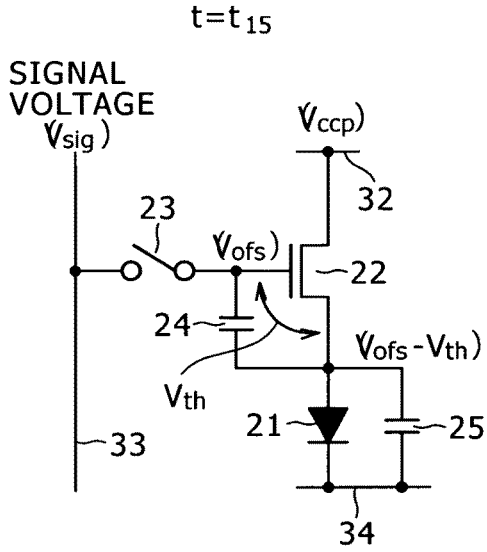
Figure 4G:
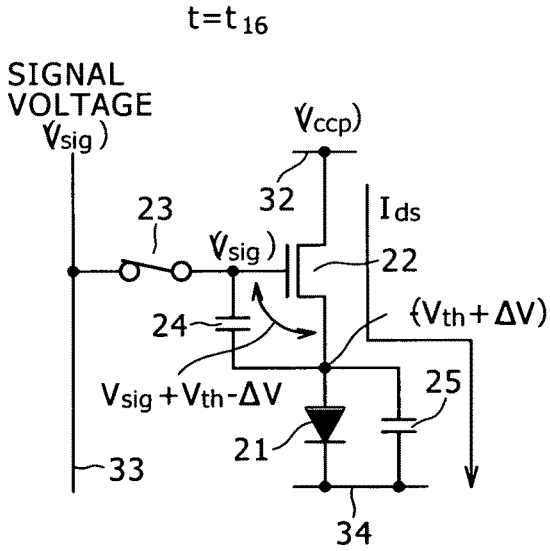

Then at time $t_{15}$, the potential of the signal line 33 changes over from the reference voltage $V_{ofs}$ to the signal voltage $V_{sig}$ of the image signal as seen in FIG. 4F. Then at time $t_{16}$, the write scanning signal WS of the scanning line 31 changes to the high potential side, and consequently, the writing transistor 23 is placed into a conducting state as seen in FIG. 4G, in which it samples the signal voltage $V_{sig}$ of the image signal and writes the sample signal voltage $V_{sig}$ into the pixel 20.

As a result of the writing of the signal voltage $V_{sig}$ by the writing transistor 23, the gate potential $V_g$ of the driving transistor 22 becomes the signal voltage $V_{sig}$. Then, upon driving of the driving transistor 22 with the signal voltage $V_{sig}$ of the image signal, the threshold voltage $V_{th}$ of the driving transistor 22 is canceled with the voltage corresponding to the threshold voltage $V_{th}$ retained in the holding capacitor 24. Details of principle of the threshold value cancellation are hereinafter described.

At this time, the organic EL element 21 is in a cutoff state or high impedance state. Accordingly, current flowing from the power supply line 32 to the driving transistor 22, that is, the drain-source current $I_{ds}$ of the driving transistor 22, in response to the signal voltage $V_{sig}$ of the image signal, flows into the equivalent capacitance 25 of the organic EL element 21. Consequently, charging of the equivalent capacitance 25 is started.

As the equivalent capacitance 25 of the organic EL element 21 is charged, the source potential $V_s$ of the driving transistor 22 rises together with passage of time. At this time, a dispersion for each pixel of the threshold voltage $V_{th}$ of the driving transistor 22 is canceled already, and the drain-source current $I_{ds}$ of the driving transistor 22 depends upon the mobility μ of the driving transistor 22. The mobility μ of the driving transistor 22 is a mobility of a semiconductor thin film which configures a channel of the driving transistor 22.

Here, it is assumed that the rate of the retained voltage $V_{gs}$ of the holding capacitor 24 to the signal voltage $V_{sig}$ of the image signal, that is, the write gain G, is 1 which is an ideal value. Consequently, when the source potential $V_s$ of the driving transistor 22 rises up to the potential of $V_{ofs}-V_{th}+\Delta V$, the gate-source voltage $V_{gs}$ of the driving transistor 22 becomes $V_{sig}-V_{ofs}+V_{th}-\Delta V$.

In other words, the rise amount ΔV of the source potential $V_s$ of the driving transistor 22 acts so as to be subtracted from the voltage retained in the holding capacitor 24, that is, from $V_{sig}-V_{ofs}+V_{th}$, or in other words, to discharge the accumulated charge of the holding capacitor 24. Consequently, negative feedback is applied. Accordingly, the rise amount ΔV of the source potential $V_s$ is equal to the feedback amount in the negative feedback.

By applying negative feedback to the gate-source voltage $V_{gs}$ with the feedback amount ΔV in accordance with the drain-source current $I_{ds}$ of the driving transistor 22 in this manner, the dependency of the drain-source current $I_{ds}$ of the driving transistor 22 upon the mobility μ can be canceled. This canceling process is the mobility correction process for correcting a dispersion of the mobility μ of the driving transistor 22 for each pixel.

More particularly, since the drain-source current $I_{ds}$ of the driving transistor 22 increases as the signal amplitude $V_{in}$ ($=V_{sig}-V_{ofs}$) of the image signal written into the gate electrode of the driving transistor 22, also the absolute value of the feedback amount ΔV in the negative feedback increases. Accordingly, a mobility correction process in accordance with the emitted light luminance level is carried out.

Further, in the case where the signal amplitude $V_{in}$ of the image signal is fixed, as the mobility μ of the driving transistor 22 increases, also the absolute value of the feedback amount ΔV in the negative feedback increases, and therefore, a dispersion of the mobility μ for each pixel can be removed. Accordingly, the feedback amount ΔV in the negative feedback can be regarded also as a correction amount in mobility correction. Details of a principle of the mobility correction are hereinafter described.

Light Emitting Period

Figure 4H:
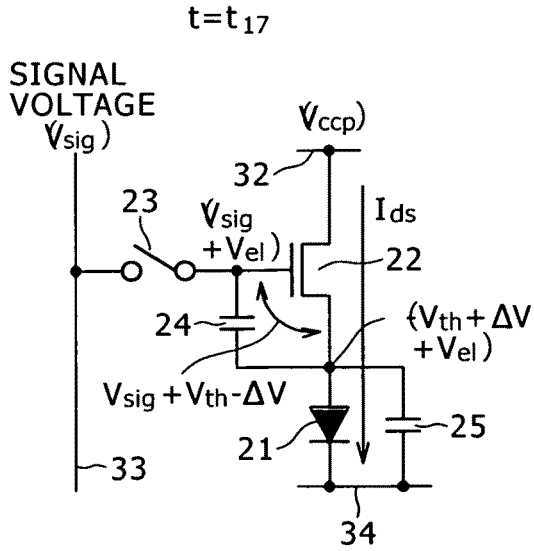

Then at time $t_{17}$, the write scanning signal WS of the scanning line 31 changes to the low potential side. Consequently, the writing transistor 23 is placed into a non-conducting state as seen in FIG. 4H. Consequently, the gate electrode of the driving transistor 22 is electrically disconnected from the signal line 33 and therefore enters a floating state.

Here, when the gate potential of the driving transistor 22 is in a floating state, since the holding capacitor 24 is connected between the gate and the source of the driving transistor 22, also the gate potential $V_g$ of the driving transistor 22 varies in an interlocking relationship with the variation of the source potential $V_s$ of the driving transistor 22. The operation of the gate potential $V_g$ of the driving transistor 22 when it varies in an interlocking relationship with the variation of the source potential $V_s$ of the driving transistor 22 is a bootstrap operation by the holding capacitor 24.

Since the gate electrode of the driving transistor 22 is placed into a floating state and simultaneously the drain-source current $I_{ds}$ of the driving transistor 22 begins to flow to the organic EL element 21, the anode potential of the organic EL element 21 rises in response to the current $I_{ds}$.

Then, when the anode potential of the organic EL element 21 exceeds $V_{the1}+V_{cath}$ driving current begins to flow to the organic EL element 21, and consequently, the organic EL element 21 begins to emit light. The rise of the anode potential of the organic EL element 21 is nothing but a rise of the source potential $V_s$ of the driving transistor 22. Then, as the source potential $V_s$ of the driving transistor 22 rises, also the gate potential $V_g$ of the driving transistor 22 rises in an interlocking relationship therewith by the bootstrap operation of the holding capacitor 24.

At this time, if it is assumed that the bootstrap gain is the ideal value 1, then the rise amount of the gate potential $V_g$ is equal to the rise amount of the source potential $V_s$. Therefore, during the light emitting period, the gate-source voltage $V_g$, of the driving transistor 22 is kept fixed at $V_{sig}-V_{ofs}+V_{th}-\Delta V$. Then, the potential of the signal line 33 changes over from the signal voltage $V_{sig}$ of the image signal to the reference voltage $V_{ofs}$ at the time $t_{18}$.

In the series of circuit operations described above, the processing operations for the threshold value correction preparations, threshold value correction, writing of the signal voltage $V_{sig}$, that is, signal writing, and mobility correction are executed within one horizontal scanning period (1H). Meanwhile, the processing operations for the signal writing and mobility correction are executed concurrently within the period from time $t_6$ to time $t_7$.

Divisional Threshold Value Correction

It is to be noted here that, while the foregoing description is given of the example of the driving method wherein the threshold value correction process is executed only once, this driving method is a mere example, and an applicable driving method is not limited to the specific driving method. For example, it is possible to adopt another driving method wherein divisional threshold value correction is carried out such that a threshold value correction process is executed for the plural times, in addition to a 1H period within which the threshold value correction process is carried out together with the mobility correction and signal wiring processes, divisionally over a plurality of horizontal scanning periods preceding to the 1H period.

According to the driving method based on the divisional threshold value correction, even if the period of time allocated to one horizontal scanning period is reduced by increase in number of pixels by increase of the definition, a sufficient period of time can be assured as the threshold value correction period over a plurality of horizontal scanning periods. Consequently, the threshold value correction process can be carried out with certainty.

Principle of Threshold Value Cancellation

Here, a principle of threshold value cancellation or threshold value correction of the driving transistor 22 is described. Since the driving transistor 22 is designed so as to operate within a saturation region, it operates as a fixed current source. Consequently, fixed drain-source current or driving current $I_{ds}$ given by the following expression (1) is supplied from the driving transistor 22 to the organic EL element 21:

$$I_{ds}=(1/2)\cdot\mu(W/L)C_{ox}(V_{gs}-V_{th})^2 \quad (1)$$

where W is the channel width of the driving transistor 22, L the channel length, and $C_{ox}$ the gate capacitance per unit area.

Figure 5A:
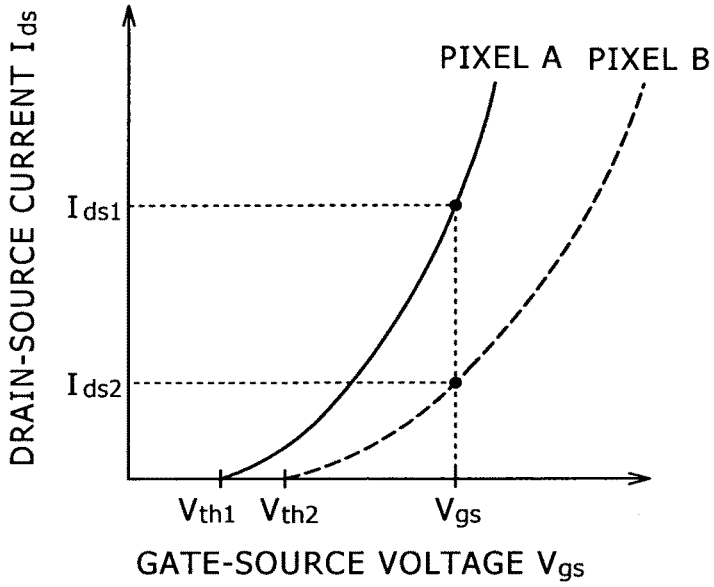
FIGS. 5A and 5B are characteristic diagrams illustrating a subject arising from a dispersion of a threshold voltage and another subject arising from a dispersion in mobility of a driving transistor, respectively.

FIG. 5A illustrates a characteristic of the gate-source voltage $V_{gs}$ with respect to the drain-source current $I_{ds}$ of the driving transistor 22.

As seen from the characteristic diagram of FIG. 5A, if a cancellation process for a dispersion of the threshold voltage $V_{th}$ of the driving transistor 22 for each pixel is not carried out, then when the threshold voltage $V_{th}$ is $V_{th1}$, the drain-source current $I_{ds}$ of the driving transistor 22 corresponding to the gate-source voltage $V_{gs}$ is $I_{ds1}$.

On the other hand, when the threshold voltage $V_{th}$ is $V_{th2}$ ($V_{th2}>V_{th1}$), the drain-source current $I_{ds}$ corresponding to the same gate-source voltage $V_{gs}$ is $I_{ds2}$ ($I_{ds2}<I_{ds1}$). In other words, if the threshold voltage $V_{th}$ of the driving transistor 22 fluctuates, then the drain-source current $I_{ds}$ fluctuates even if the gate-source voltage $V_{gs}$ is fixed.

On the other hand, in the pixel 20 or pixel circuit having the configuration described hereinabove, the gate-source voltage $V_{gs}$ of the driving transistor 22 upon emission of light is $V_{sig}-V_{ofs}+V_{th}-\Delta V$. Accordingly, if this is substituted into the expression (1) given hereinabove, then the drain-source current $I_{ds}$ is represented by the following expression (2):

$$I_{ds}=(1/2)\cdot\mu(W/L)C_{ox}(V_{sig}-V_{ofs}-\Delta V)^2 \quad (2)$$

In particular, the term of the threshold voltage $V_{th}$ of the driving transistor 22 is canceled, and the drain-source current $I_{ds}$ supplied from the driving transistor 22 to the organic EL element 21 does not depend upon the threshold voltage $V_{th}$ of the driving transistor 22. As a result, even if the threshold voltage $V_{th}$ of the driving transistor 22 disperses for each pixel due to a dispersion in the production process, a time-dependent variation and so forth of the driving transistor 22, the drain-source current $I_{ds}$ does not vary. Therefore, the emitted light luminance of the organic EL element 21 can be kept fixed.

Principle of Mobility Correction

Figure 5B:
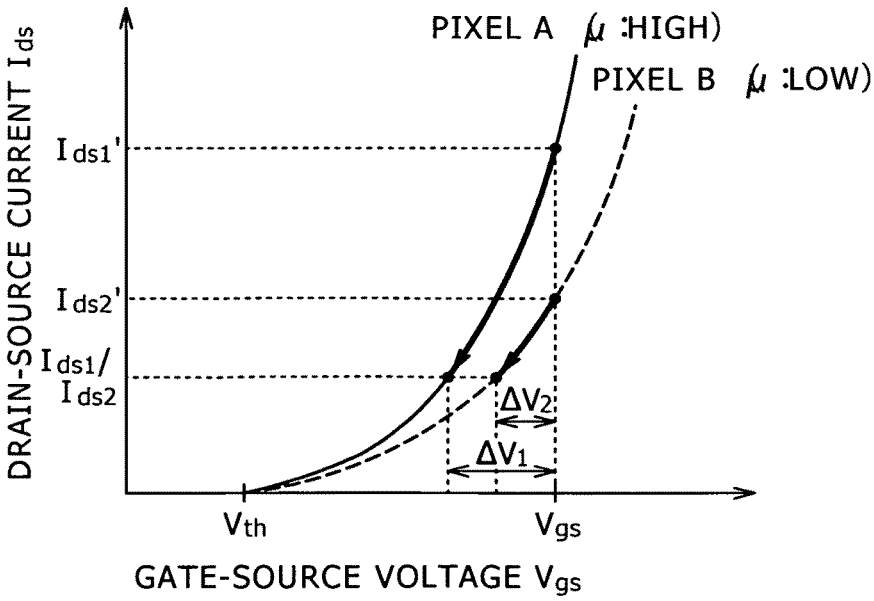

Now, a principle of the mobility correction of the driving transistor 22 is described. FIG. 5B illustrates characteristic curves of a pixel A wherein the mobility μ of the driving transistor 22 is relatively high and another pixel B wherein the mobility μ of the driving transistor 22 is comparatively low for comparison. In the case where the driving transistor 22 is configured from a polysilicon thin film transistor or the like, it cannot be avoided that the mobility μ disperses among pixels like between the pixel A and the pixel B.

A case is considered here in which signal amplitudes $V_{in}$ ($=V_{sig}-V_{ofs}$) of an equal level are written into the gate electrode of the driving transistor 22, for example, of the pixels A and B in a state in which the pixel A and the pixel B have a dispersion in mobility μ. In this instance, if correction of the mobility μ is not carried out, then a great difference appears between drain-source current $I_{ds1}$, flowing to the pixel A having the high mobility μ and the drain-source current $I_{ds2}$, flowing to the pixel B having the low mobility μ. If a great difference of the drain-source current $I_{ds}$ appears between different pixels due to a dispersion of the mobility μ between the pixels in this manner, then the uniformity of the screen image is lost.

Here, as apparent from the transistor characteristic expression (1) given hereinabove, as the mobility μ increases, the drain-source current $I_{ds}$ increases. Accordingly, the feedback amount ΔV in the negative feedback increases as the mobility μ increases. As seen from FIG. 5B, the feedback amount $\Delta V_1$ of the pixel A having the high mobility μ is higher than the feedback amount $\Delta V_2$ of the pixel B having the low mobility μ.

Therefore, if negative feedback is applied to the gate-source voltage $V_{gs}$ with the feedback amount ΔV corresponding to the drain-source current $I_{ds}$ of the driving transistor 22 by the mobility correction process, then the degree of application of the negative feedback increases as the mobility μ increases. As a result, a dispersion of the mobility μ for each pixel can be suppressed.

In particular, if correction by the feedback amount $\Delta V_1$ is applied to the pixel A having the high mobility μ, then the drain-source current $I_{ds}$ drops from $I_{ds1'}$ by a great amount to $I_{ds1}$. On the other hand, since the feedback amount $\Delta V_2$ of the pixel B having the low mobility μ is small, the drain-source current $I_{ds}$ drops from $I_{ds2'}$ to $I_{ds2}$ and does not drop very much. As a result, the drain-source current $I_{ds1}$ of the pixel A and the drain-source current $I_{ds2}$ of the pixel B become substantially equal to each other, and consequently, the dispersion of the mobility μ between the pixels A and B is corrected.

In summary, in the case where the pixel A and the pixel B are different in mobility μ from each other, the feedback amount $\Delta V_1$ of the pixel A having the high mobility μ is greater than the feedback amount $\Delta V_2$ of the pixel B having the low mobility μ. In short, the pixel having a higher mobility μ provides a greater feedback amount ΔV and exhibits a greater decreasing amount of the drain-source current $I_{ds}$.

Accordingly, by applying negative feedback to the gate-source voltage $V_{gs}$ with the feedback amount ΔV corresponding to the drain-source current $I_{ds}$ of the driving transistor 22, the current values of the drain-source current $I_{ds}$ of pixels which are different in mobility μ are uniformized. As a result, a dispersion of the mobility μ for each pixel can be corrected. In short, the process of applying negative feedback to the gate-source voltage $V_{gs}$ of the driving transistor 22 with the feedback amount ΔV corresponding to the current flowing to the driving transistor 22, that is, according to the drain-source current $I_{ds}$ of the driving transistor 22 is the mobility correction process.

[1-3. Mirror Type Layout Structure]

In the organic EL display apparatus 10 described above, in order to achieve efficient layout of the pixel array section 30 or to increase the degree of freedom in layout, it is preferable to adopt a mirror type layout structure while a basically same layout shape is applied to the pixels or pixel circuits 20. As described hereinabove, the mirror type layout structure is a structure wherein pixel circuits in an odd-numbered column and pixel circuits in an even-numbered column which neighbor with each other across an axis of a column direction of the matrix pixel array of the pixel array section 30 are laid out symmetrically with respect to the axis of the column direction.

The concept of "symmetrical" of "symmetrical with respect to the axis in the column direction" above includes not only a case in which pixel circuits in an odd-numbered column and pixel circuits in an even-numbered columns are strictly physically symmetrical but also another case in which various dispersions arising from design or production of circuit components or some differences in element size caused by difference in color and so forth are involved. Here, a mirror type layout structure is described particularly.

Figure 6:
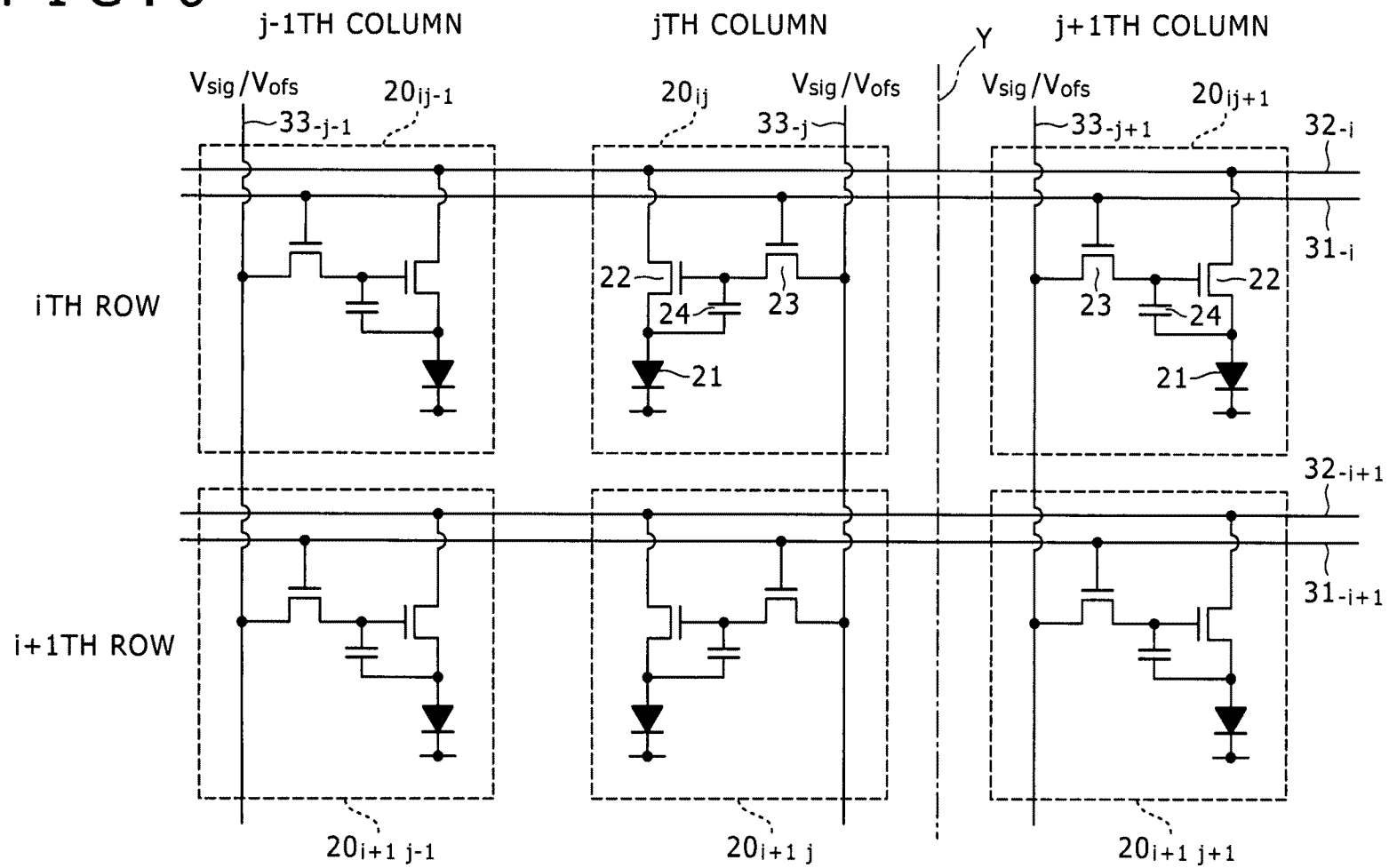
FIG. 6 is a circuit diagram showing an example of a mirror type layout structure.

FIG. 6 is a circuit diagram showing an example of a mirror type layout structure. In the figure, the same elements of FIG. 6 use the same notation as FIG. 2. In FIG. 6, a matrix pixel array regarding totaling 6 pixels in two rows including the ith row and i+1th row and three columns including the j−1th, jth and j+1th columns for the convenience of illustration. Further, for the convenience of description, it is assumed that j−1th and j+1th columns are odd-numbered columns while the jth column is an even-numbered column.

In FIG. 6, in the pixel array described above, a pixel circuit $\mathbf{20}_{i,j}$ another pixel circuit $\mathbf{20}_{i+1,j}$ which belong to the even-numbered column j and a pixel circuit $\mathbf{20}_{i,j+1}$ another pixel circuit $\mathbf{20}_{i+1,j+1}$ which belong to the odd-numbered column j+1 which neighbors with the even-numbered column j across the axis Y of the column direction of the pixel array have a mirror type layout structure. In particular, as apparent from FIG. 6, the signal line $\mathbf{33}_{-j}$ of the even-numbered column j and the signal line $\mathbf{33}_{-j+1}$ of the odd-numbered column j+1 are both wired on the axis Y side of the column direction. Further, circuit components including organic EL elements 21, driving transistors 22, writing transistors 23 and holding capacitors 24 are disposed in a leftwardly and rightwardly symmetrical relationship to each other with respect to the axis Y of the column direction.

According to this mirror type layout structure, efficient layout of the pixel array section 30 can be anticipated. In particular, it is possible to dispose a power supply line along the column direction between the pixel circuits of two neighboring columns such that the power supply line is used commonly by the pixel circuits of the two columns or use contact holes commonly between the pixel circuits of the two columns or use a drop wire of a wiring line. Further, according to the mirror type layout structure, the degree of freedom in layout increases and the density in layout can be lowered, and consequently, a high yield can be anticipated.

Here, the power supply line to be used commonly may be, for example, such as follows. In particular, the pixel 20 shown in FIG. 2 has a configuration that the reference voltage $V_{ofs}$ for threshold value correction is written into the gate electrode of the driving transistor 22 from the signal line 33 through the writing transistor 23. In contrast, it is imaginable to adopt such a configuration that a power supply line for exclusive use for transmitting the reference voltage $V_{ofs}$ is wired along the column direction, for example, between the j−1th pixel column and the jth pixel column such that the power supply line is commonly used by the pixel circuits $\mathbf{20}_{i,j-1}$ and $\mathbf{20}_{i+1,j-1}$ which belong to the j−1th column and the pixel circuits $\mathbf{20}_{i,j}$ and $\mathbf{20}_{i+1,j}$ which belong to the jth column (details are hereinafter described).

By commonly using a power supply line, commonly using contact holes or commonly using a drop line of a wiring line to an intermediate portion by and between pixel circuits in two columns in such a manner as described above, efficient layout of the pixel array section 30 can be anticipated.

[1-4. Selector Driving Method]

Referring back to FIG. 1, the signal voltage $V_{sig}$ of an image signal and the reference voltage $V_{ofs}$ for threshold value correction are selectively supplied to the signal outputting circuit 60 on the display panel 70 from a driving section provided externally of the display panel 70 such as a driver IC. Here, in order to facilitate understandings, the signal outputting circuit 60 where the signal voltage $V_{sig}$ of an image signal is supplied as a display signal is described.

The signal outputting circuit 60 adopts a known selector driving method in order to achieve reduction of the number of outputs of the driver IC. As described hereinabove, the selector driving method is a driving method wherein a plurality of signal lines from among the signal lines $\mathbf{33}_{-1}$ to $\mathbf{33}_{-n}$ of the display panel 70 are allocated as a unit or group to one output of the driver IC and a signal voltage $V_{sig}$ outputted time-sequentially from the driver IC is distributed time-divisionally to the plural signal lines.

Generally, the number of outputs of the driver IC and the number of signal lines $\mathbf{33}_{-1}$ to $\mathbf{33}_{-n}$ on the display panel 70 are set equal to each other, and output terminals of the driver IC and the signal lines $\mathbf{33}_{-1}$ to $\mathbf{33}_{-n}$ on the display panel 70 are connected in a one-by-one corresponding relationship to each other to input signal lines. However, if this configuration is adopted, then the required number of outputs of the driver IC is n and the required number of wiring lines or input signal lines which electrically connect the output terminals of the driver IC and the display panel 70 is n. Besides, the required number of terminals on the display panel 70 side is n. Therefore, the entire system configuration is complicated.

In contrast, the selector driving method is adopted such that the relationship between the outputs of the driver IC and the signal lines $\mathbf{33}_{-1}$ to $\mathbf{33}_{-n}$, of the display panel 70 is set so as to have a corresponding relationship of 1:x where x is an integer equal to or greater than 2. Then, to the x signal lines allocated to one output terminal of the driver IC, the signal voltages $V_{sig}$ outputted time-sequentially from the one output terminal are distributed time-divisionally. By adopting this selector driving method, the number of outputs of the driver IC, the number of wiring lines between the driver IC and the display panel 70 and the number of terminals of the display panel 70 side can be reduced to 1/x the number n of the signal lines $\mathbf{33}_{-1}$ to $\mathbf{33}_{-n}$.

The number x of signal lines which make a unit when the selector driving method is adopted, that is, the time division number x, is preferably set, for example, to x=3 or to a multiple of 3 in the case of an organic EL display apparatus ready for color display wherein one unit pixel is formed from three subpixels of RGB. Further, as the select method of signals by the selector circuit for one pixel row in which three subpixels are repetitively arrayed like RGBRGB . . . , roughly two select methods are available.

A first one of the two select methods is a method wherein, for example, in the case where one pixel is formed from subpixels of RGB, a signal is written time-divisionally into subpixels of one color in a group of three pixels. A second select method is a method wherein a signal is written time-divisionally into subpixels of RGB of one pixel. It is to be noted that the array order of colors of or the writing order of signals into three subpixels of RGB may be determined arbitrarily. While the case in which one pixel is formed from subpixels of RGB is taken as an example here, this is basically similar also where a single color is involved.

Figure 7:
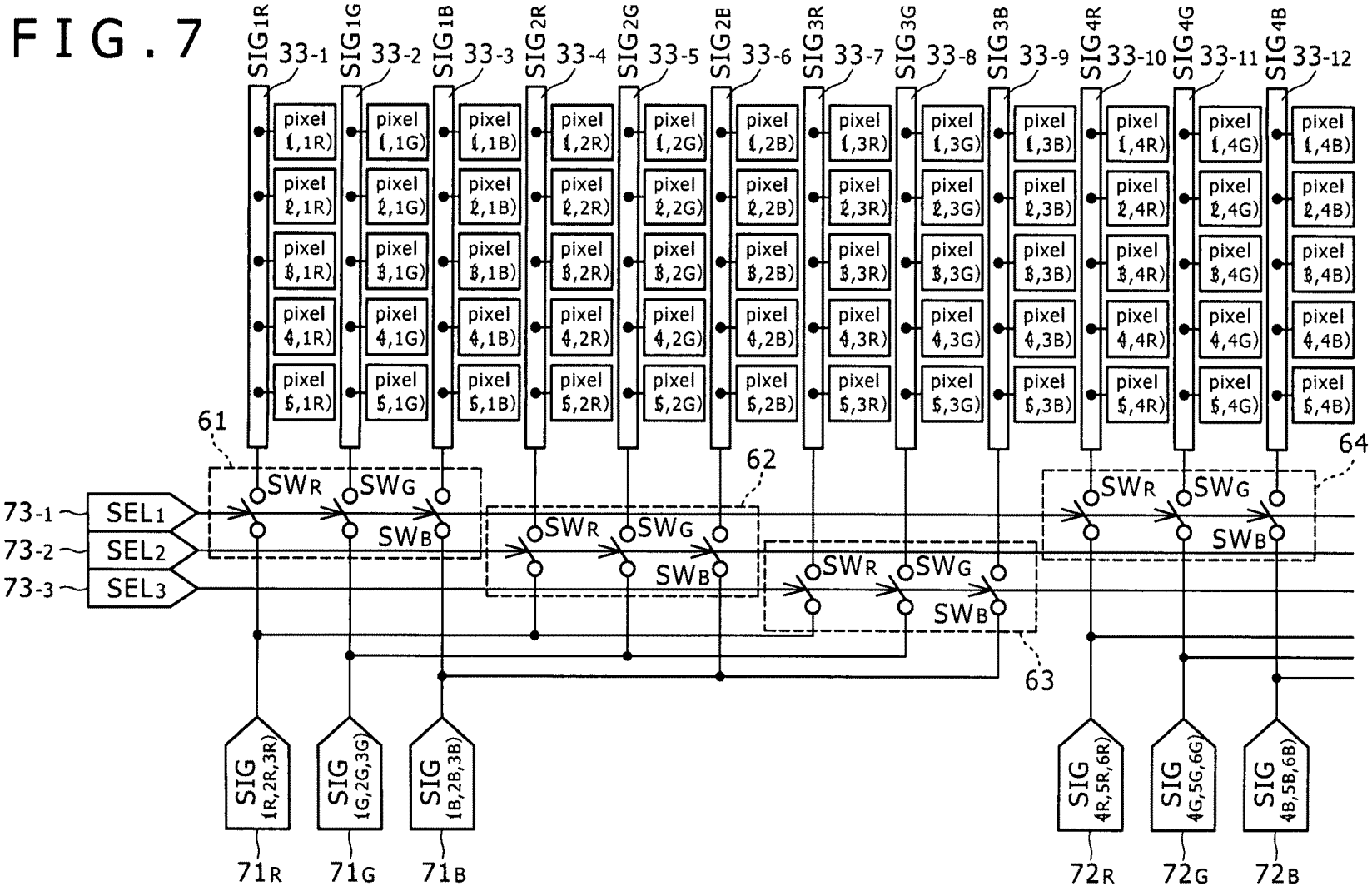
FIG. 7 is a circuit diagram showing an example of a configuration of a signal outputting circuit which adopts a selector driving method.

FIG. 7 is a circuit diagram showing an example of a configuration of the signal outputting circuit 60 which adopts the selector driving method. In order to facilitate illustration, a pixel array of five rows and 12 columns is shown in FIG. 7. Further, in the example shown in FIG. 7, the time division number x is x=3 corresponding to three subpixels of RGB and the first select method wherein a signal is written time-divisionally into subpixels of one color in a group of three pixels is adapted as the signal select method.

Referring to FIG. 7, selector circuits 61, 62, 63, . . . are disposed corresponding to pixel columns of RGB. The selector circuits 61, 62, 63, . . . are each configured from three switches $SW_R$, $SW_G$ and $SW_B$ corresponding to pixel columns of RGB and are arrayed repetitively in a unit of three selector circuit.

Then, time-sequential signals $SIG_{(1R,2R,3R)}$, $SIG_{(1G,2G,3G)}$ and $SIG_{(1B,2B,3B)}$ are inputted to the three switches $SW_R$, $SW_G$ and $SW_B$ of the three selector circuits 61, 62, 63, . . . through the three terminals $\mathbf{71}_R$, $\mathbf{71}_G$ and $\mathbf{71}_B$, respectively. Similarly, time-sequential signals $SIG_{(4R,5R,6R)}$, $SIG_{(4G,5G,6G)}$ and $SIG_{(4B,5B,6B)}$ are inputted to the three switches $SW_R$, $SW_G$ and $SW_B$ of the three selector circuits 64 (and 65 and 66) of a next group through the terminals $\mathbf{72}_R$, $\mathbf{72}_G$ and $\mathbf{72}_B$, respectively.

Further, to the selector circuits 61, 62, 63, . . . , three selection signals $SEL_1$, $SEL_2$ and $SEL_3$ are provided through the terminals $\mathbf{73}_{-1}$, $\mathbf{73}_{-2}$ and $\mathbf{73}_{-3}$ in a unit of three selector circuits, respectively. The selection signals $SEL_1$, $SEL_2$ and $SEL_3$ ON/OFF control the three switches $SW_R$, $SW_G$ and $SW_B$ of the selector circuits 61, 62, 63, . . . each three of which form a group.

Figure 8:
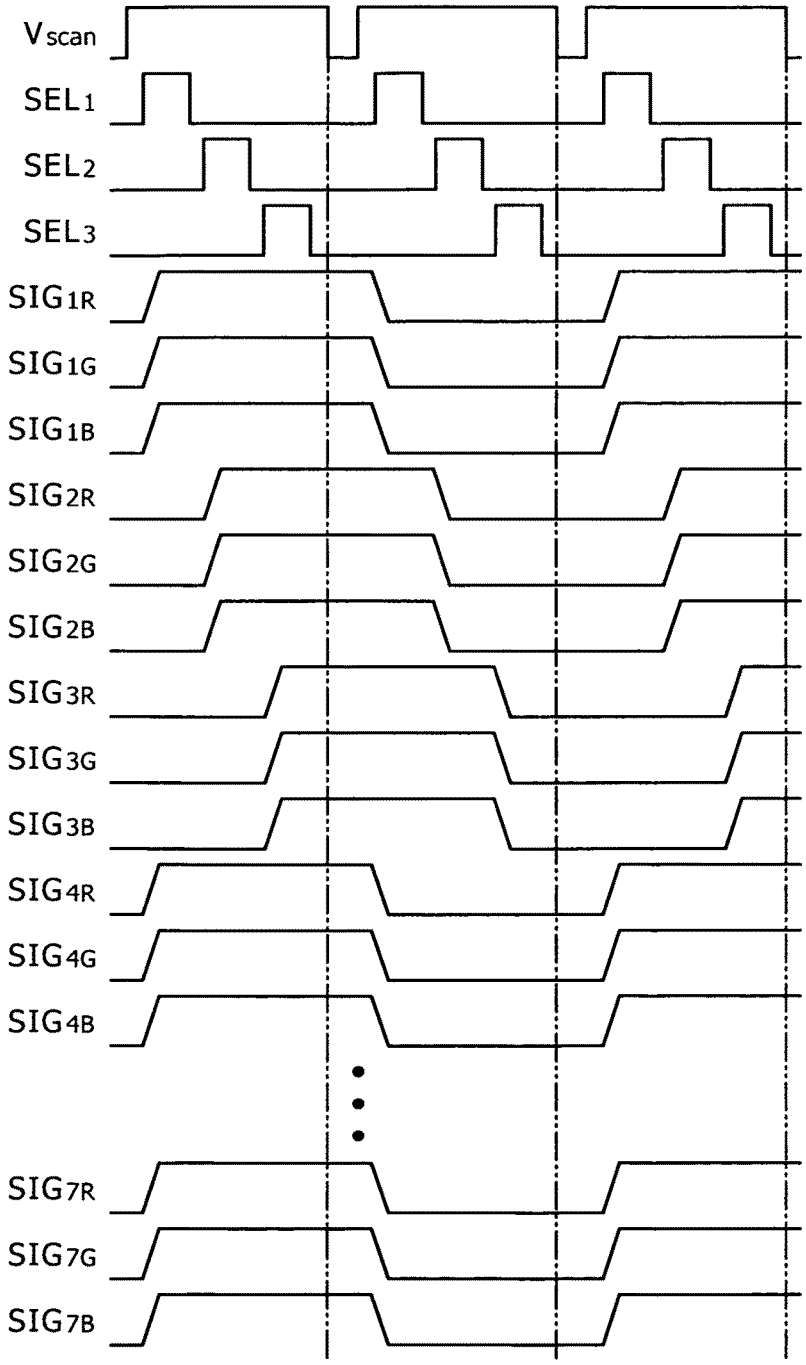
FIG. 8 is a timing chart illustrating operation timings of the selector driving method.

FIG. 8 is a timing chart illustrating operation timings of the selector driving method. FIG. 8 illustrates a timing relationship of the vertical scanning signal $V_{scan}$, three selection signals $SEL_1$, $SEL_2$ and $SEL_3$ and time-sequential signals $SIG_{(1R,2R,3R)}$, $SIG_{(1G,2G,3G)}$, $SIG_{(1B,2B,3B)}$, . . . . As apparent from the timing chart, the time-sequential signals $SIG_{(1R,2R,3R)}$, $SIG_{(1G,2G,3G)}$ and $SIG_{(1B,2B,3B)}$ are written time-divisionally into the signal lines 33 each three of which form a group by the selector circuits 61, 62, 63, . . . .

[1-5. Fault where Two Signal Lines Neighbor with Each Other]

As described hereinabove, if, for example, a mirror type layout structure is adopted, then two signal lines connected to pixel circuits belonging to pixel columns neighboring with each other are sometimes wired neighboring with each other. When the selector driving method is applied to the layout structure wherein two signal lines are wired neighboring with each other in this manner, if the writing timings of display signals into the two neighboring signal lines are different from each other, then a fault possibly occurs. In particular, since a display signal written into a signal line first is influenced by another display signal written into another signal line later, an accurate display signal cannot be written. This fault is described particularly below.

Figure 9:
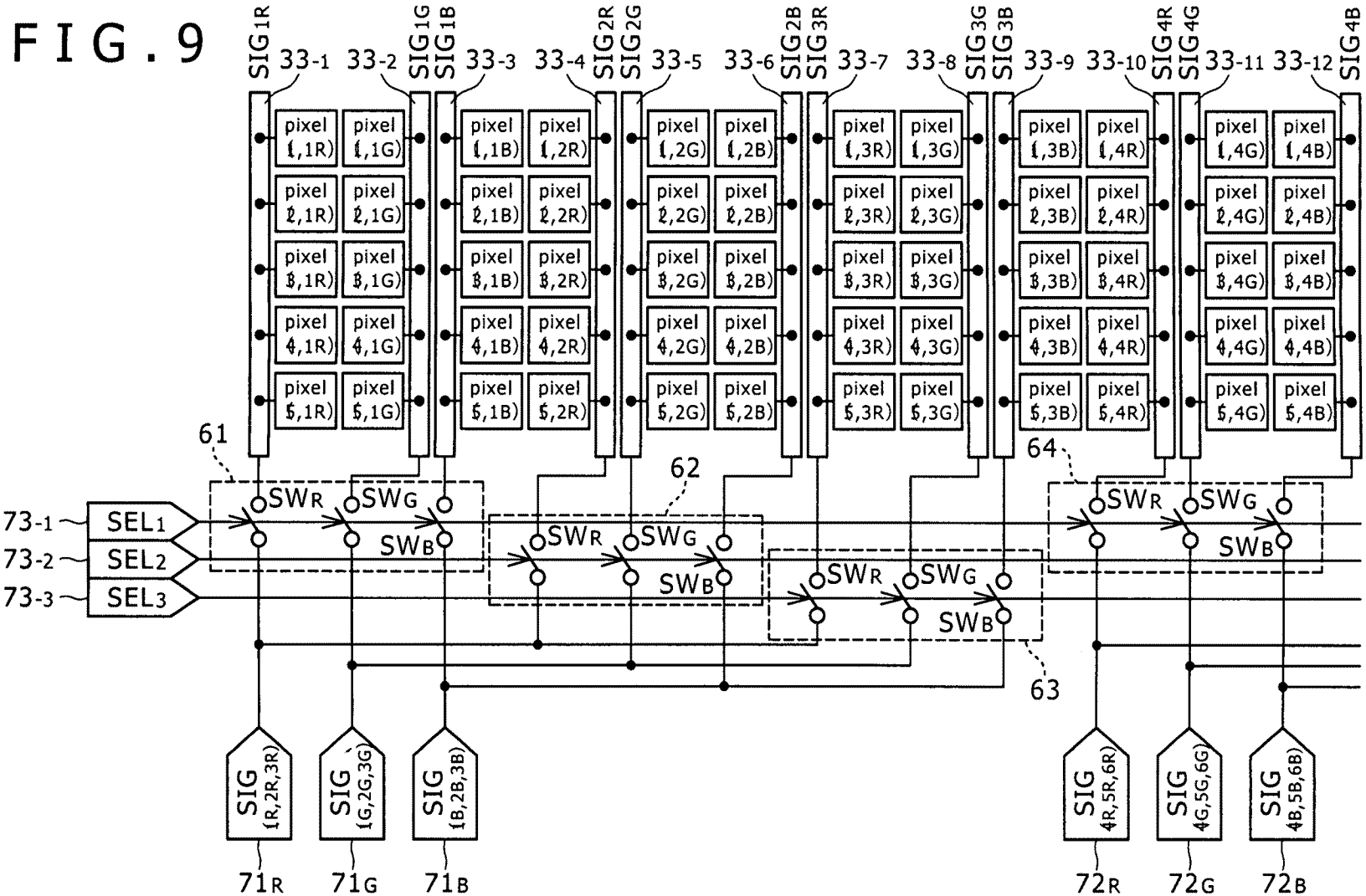
FIG. 9 is a circuit diagram showing an example of a layout structure wherein two signal lines are wired neighboring with each other between pixel columns.

FIG. 9 is a circuit diagram illustrating an example of a layout structure wherein two signal lines are wired neighboring with each other.

Referring to FIG. 9, in a pixel array of 5 lines and 12 columns shown, signal lines $\mathbf{33}_{-2}$ and $\mathbf{33}_{-3}$ are wired neighboring with each other between the second and third pixel columns, and signal lines $\mathbf{33}_{-4}$ and $\mathbf{33}_{-5}$ are wired neighboring with each other between the fourth and fifth pixel columns. Similarly, signal lines $\mathbf{33}_{-6}$ and $\mathbf{33}_{-7}$ are wired neighboring with each other between the sixth and seventh pixel columns; the signal lines $\mathbf{33}_{-8}$ and $\mathbf{33}_{-9}$ are wired neighboring with each other between the eighth and ninth pixel columns; and the signal lines $\mathbf{33}_{-10}$ and $\mathbf{33}_{-11}$ are wired neighboring with each other between the 10th and 11th pixel columns.

Figure 10:
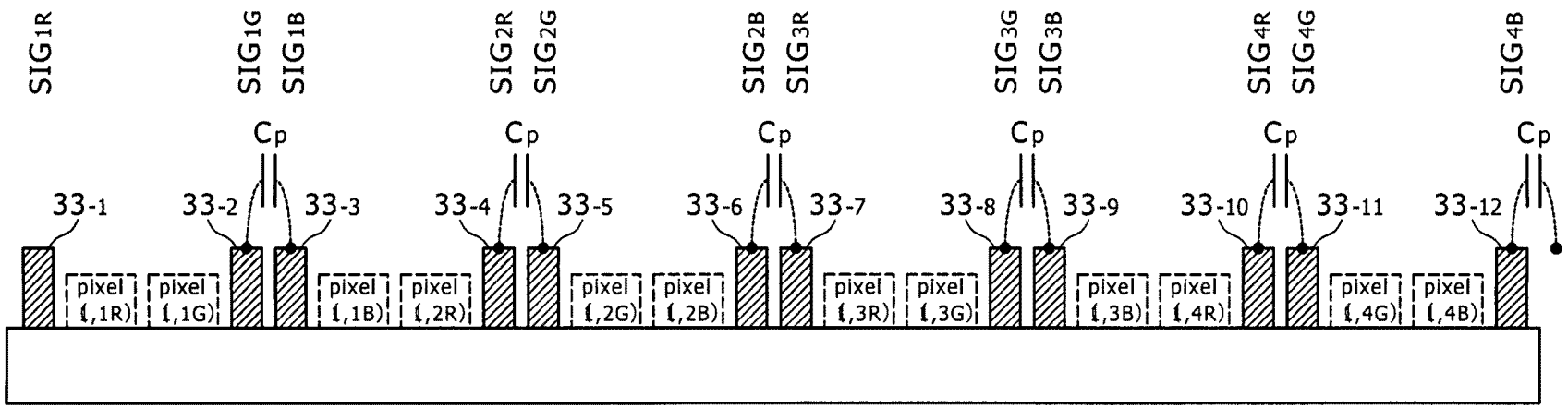
FIG. 10 is a schematic sectional view illustrating a manner in which parasitic capacitance is formed between two signal lines neighboring with each other between pixel columns.

If two signal lines are wired neighboring with each other in this manner, then parasitic capacitance $C_p$ is formed between the two neighboring signal lines $\mathbf{33}_{-2}$ and $\mathbf{33}_{-3}$, between the signal lines $\mathbf{33}_{-4}$ and $\mathbf{33}_{-5}$, between the signal lines $\mathbf{33}_{-6}$ and $\mathbf{33}_{-7}$, between the signal lines $\mathbf{33}_{-8}$ and $\mathbf{33}_{-9}$ and between the signal lines $\mathbf{33}_{-10}$ and $\mathbf{33}_{-11}$ as seen in FIG. 10. Then, it is assumed that, in a state in which the parasitic capacitance $C_p$ is formed, driving of the selector circuits 61, 62, 63, . . . is carried out at operation timings similar to those in the case of the selector driving method described hereinabove.

Figure 11:
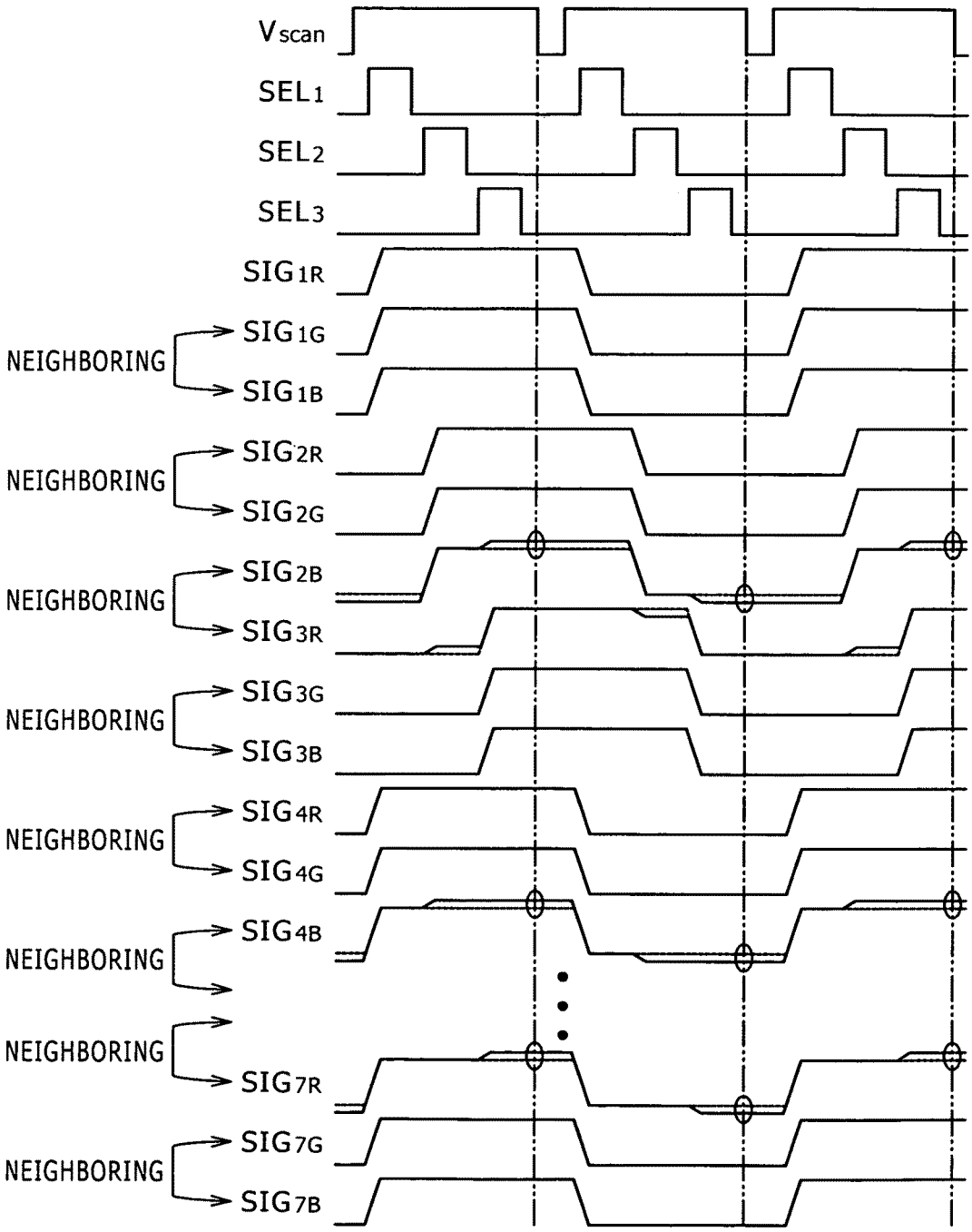
FIG. 11 is a timing chart illustrating basic operation timings of the selector driving method in the layout structure wherein two signal lines are wired neighboring with each other between pixel columns.

Operation timings in this instance are illustrated in FIG. 11. The operation timings of FIG. 11 are basically similar to the operation timings of FIG. 8. Therefore, if the selection timings of the selector circuits 61, 62, 63, . . . for two signal lines between which the parasitic capacitance $C_p$ is formed are same, then it is possible to write accurate display signals. For example, since the selection timings of the selector circuit 61 for the two signal lines $\mathbf{33}_{-2}$ and $\mathbf{33}_{-3}$ are same, the accurate display signals $SIG_{1G}$ and $SIG_{1B}$ can be written in.

On the other hand, if the selection timings of the selector circuits 61, 62, 63, . . . for the two signal lines in a state in which the parasitic capacitance $C_p$ is formed therebetween are different from each other, then accurate display signals cannot be written in. For example, since the selection timings of the selector circuits 62 and 63 for the two signal lines $\mathbf{33}_{-6}$ and $\mathbf{33}_{-7}$ are different from each other, accurate display signals $SIG_{2B}$ and $SIG_{3R}$ cannot be written as apparent from the timing chart of FIG. 11.

In particular, after the display signal $SIG_{2B}$ is written into the signal line $\mathbf{33}_{-6}$ so that it is retained into the signal line $\mathbf{33}_{-6}$, when the display signal $SIG_{3R}$ is written into the signal line $\mathbf{33}_{-7}$, the display signal $SIG_{2B}$ written formerly is fluctuated by coupling by the parasitic capacitance $C_p$. If the voltage variation amount of the display signal $SIG_{2B}$ upon writing of the display signal $SIG_{3R}$ is represented by $\Delta SIG_{2B}$, then the voltage variation amount $\Delta SIG_{2B}$ is given by the following expression (3):

$$\Delta SIG_{2B}=C_{6\text{-}7}/C_6 \cdot \Delta SIG_{3R} \tag{3}$$

where $C_{6\text{-}7}$ is a capacitance value of the parasitic capacitance $C_p$ between of the two signal lines $\mathbf{33}_{-6}$ and $\mathbf{33}_{-7}$, $C_6$ a capacitance value of the signal line $\mathbf{33}_{-6}$, and $\Delta SIG_{3R}$ is a voltage variation amount of the display signal $SIG_{3R}$ upon writing of the display signal $SIG_{3R}$.

As seen from the timing chart of FIG. 11, while the display signals $SIG_{2B}$, $SIG_{4B}$ and $SIG_{7R}$ should originally have signal waveforms indicated by broken lines, a variation in voltage occurs as seen from the signal waveforms indicated by solid lines due to an influence of coupling by the parasitic capacitance $C_p$. In the timing chart of FIG. 11, a point indicated by a ○ mark represents an instant at which the vertical scanning signal $V_{scan}$ changes from an active state to an inactive state, that is, a holding point of the display signal written in. Accordingly, the display signal written in is held while it remains in the state in which it involves the voltage variation by the coupling of the parasitic capacitance $C_p$.

In this manner, if the parasitic capacitance $C_p$ exists between two neighboring signal lines, then if the selection timings of the selector circuits 61, 62, 63, . . . for the two signal lines are different from each other, a fault occurs. In particular, as described above, since a display signal written into a signal line first is influenced by another display signal written into another signal line later, an accurate display signal cannot be written. Further, if an accurate display signal cannot be written in, then the picture quality of the display image is deteriorated.

A particular embodiment of the present invention for eliminating such a fault as described above, that is, for making it possible to write an accurate display signal even if writing timings of display signals into signals lines for two neighboring pixel columns are different from each other, is described below as a first embodiment of the present invention.

<2. First Embodiment>

The above-described mirror type layout structure or the selector driving method can be adopted suitably in a planar type display apparatus such as an organic EL display apparatus or a liquid crystal display apparatus. However, in the organic EL display apparatus according to different embodiments of the present invention described below, although it is essentially necessary to adopt the selector driving method, the mirror type layout structure may be adopted arbitrarily.

Further, in the first embodiment of the present invention, an organic EL display apparatus which adopts the selector driving method is characterized in a layout method or layout structure of two signal lines which are connected, when the signal lines $\mathbf{33}_{-1}$ to $\mathbf{33}_{-n}$, are laid out, to pixel circuits belonging to two neighboring pixel columns.

In particular, with regard to combinations of two signal lines individually connected to pixel circuits which belong to two neighboring pixel columns, that combination wherein display signals are distributed at different timings from a selector circuit, the two signal lines are wired such that they are not positioned neighboring with each other (first wiring region). On the other hand, with regard to combinations wherein display signals are distributed at the same timing by a selector circuit, the two signal lines are wired neighboring with each other (second wiring region). The pixel array section 30 has the first and second wiring regions at least at part thereof.

In the combinations in which display signals are distributed at timings different from each other by the selector circuits 61, 62, 63, . . . , since the two signal lines are not positioned neighboring with each other, no parasitic capacitance $C_p$ exists between the two signal lines. Accordingly, even if display signals are written at different timings from each other into the two signal lines, the display signal written first into one of the signal lines is not influenced by the display signal written into the other signal line later by coupling by the parasitic capacitance $C_p$.

On the other hand, in the combinations in which display signals are distributed at the same timing by the selector circuits 61, 62, 63, . . . , since the two signal lines are positioned neighboring with each other, parasitic capacitance $C_p$ exists between the two signal lines. However, even if the parasitic capacitance $C_p$ exists, since display signals are written at the same timing into the two signal lines, each of the display signals is not influenced by the other signal at all. Accordingly, in any of the combinations of two signal lines, accurate display signals can be written into signal lines.

As described above, even if writing timings of display signals into signal lines belonging to two neighboring pixel columns are different from each other, accurate display signals can be written into signal lines. Accordingly, even if such a structure as to wire a shield line between neighboring signal lines is not adopted, picture quality deterioration by an influence of coupling of the parasitic capacitance $C_p$ as in the existing art can be suppressed. Therefore, a display image of high picture quality can be obtained.

It is to be noted that, while the layout structure wherein two signal lines individually connected to pixel circuits which belong to two neighboring pixel columns are positioned neighboring with each other may be, for example, such a mirror type layout structure as described above, the layout structure in the present embodiment is not limited to the mirror type layout structure. In other words, the present embodiment can be applied to general layout structures wherein two signal lines are positioned neighboring with each other between pixel columns. In the following, particular working examples of the first embodiment are described.

[2-1. Working Example 1]

Figure 12:
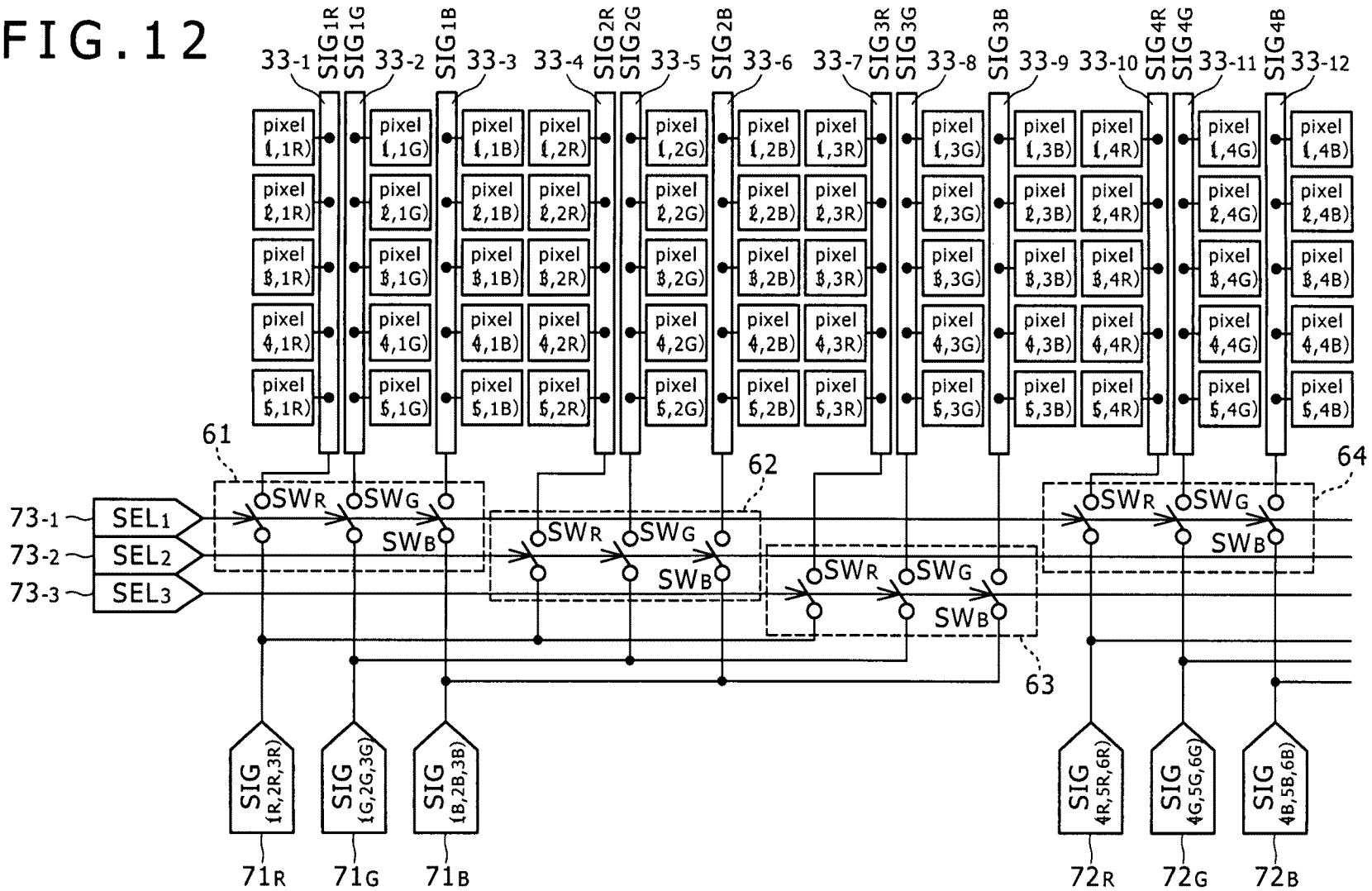
FIG. 12 is a circuit diagram showing a layout structure of a pixel array section according to a working example 1 of a first embodiment of the present invention.

FIG. 12 is a circuit diagram showing a layout structure of the pixel array section according to a working example 1. In FIG. 12, for simplified illustration, the pixel array section is shown including a pixel array of five rows and 12 columns. Further, the time division number x is x=3 corresponding to the three subpixels of RGB.

Further, as the select method of a signal by the selector circuits 61, 62, 63, . . . , the first select method wherein signals are written time-divisionally into subpixels of one color in a group of three pixels is adopted as an example. In the first select method, a time sequential signal of the individual colors is inputted as display signals to the selector circuits 61, 62 and 63 of the first group from the external driver IC through the terminals $\mathbf{71}_R$, $\mathbf{71}_G$ and $\mathbf{71}_B$, respectively.

In particular, the time-sequential R signals $SIG_{1R}$, $SIG_{2R}$ and $SIG_{3R}$ are inputted to the selector circuit 61 through the terminal 71R; the time-sequential G signals $SIG_{1G}$, $SIG_{2G}$ and $SIG_{3G}$ are inputted to the selector circuit 62 through the terminal 71G; and the time-sequential B signals $SIG_{1B}$, $SIG_{2B}$ and $SIG_{3B}$ are inputted to the selector circuit 63 through the terminal 71B. Also to the selector circuits 64, . . . of the next group and so forth, time-sequential signals are inputted similarly to the selector circuits 61, 62, 63 of the first group.

Consequently, in the selector driving method which adopts the first select method, display signals are written at the same timing into the subpixels of RGB which configure one pixel by the selector circuits 61, 62, 63 under the control of the selection signals $SEL_1$, $SEL_2$ and $SEL_3$, respectively. Further, into three pixels of one group, control signals are written at different timings from each other since the selector circuits 61, 62 and 63 are successively driven by the selection signals $SEL_1$, $SEL_2$ and $SEL_3$, respectively.

In the pixel array of five rows and 12 columns shown in FIG. 12, pixel circuits belonging to the first pixel column and pixel circuits belonging to the second pixel column, and pixel circuits belonging to the third pixel column and pixel circuits belonging to the fourth pixel column, individually have a paired relationship with each other. Further, the pixel circuits belonging to the fourth pixel column and pixel circuits belonging to the fifth pixel column, and pixel circuits belonging to the sixth pixel column and pixel circuits belonging to the seventh pixel column, individually have a paired relationship with each other. Further, the pixel circuits belonging to the seventh pixel column and pixel circuits belonging to the eighth pixel column, pixel circuits belonging to the ninth pixel column and pixel circuits belonging to the tenth pixel column, and the pixel circuits belonging to the tenth pixel column and pixel circuits belonging to the eleventh pixel column, individually have a paired relationship with each other.

In the present layout structure, the signal line $\mathbf{33}_{-1}$ connected to the pixel circuits belonging to the first pixel column and the signal line $\mathbf{33}_{-2}$ connected to the pixel circuits belonging to the second pixel column are positioned neighboring with each other. Further, the signal line $\mathbf{33}_{-4}$ connected to the pixel circuits belonging to the fourth pixel column and the signal line $\mathbf{33}_{-5}$ connected to the pixel circuits belonging to the fifth pixel column are positioned neighboring with each other. Further, the signal line $\mathbf{33}_{-7}$ connected to the pixel circuits belonging to the seventh pixel column and the signal line $\mathbf{33}_{-8}$ connected to the pixel circuits belonging to the eighth pixel column are positioned neighboring with each other. Further, the signal line $\mathbf{33}_{-10}$ connected to the pixel circuits belonging to the tenth pixel column and the signal line $\mathbf{33}_{-11}$ connected to the pixel circuits belonging to the eleventh pixel column are positioned neighboring with each other.

As apparent from the foregoing, for a combination of pixel columns in which display signals are provided at the same timing by a selector circuit, signal lines belonging to the pixel columns of the combination are wired in a neighboring relationship to each other. On the other hand, for pixel columns in which display signals are provided at different timings from each other by a selector circuit, signal lines belonging to the pixel columns are wired such that they are not positioned neighboring with each other.

In other words, in that combination, from among combinations of two signal lines individually connected to pixel circuits belonging to two neighboring pixel columns, in which display signals are distributed at different timings from each other by a selector circuit, two signal lines are wired such that they are not positioned neighboring with each other (first wiring region). In the mirror type layout structure of FIG. 12, the signal line $\mathbf{33}_{-3}$ in the third row and the signal line $\mathbf{33}_{-4}$ in the fourth row, the signal line $\mathbf{33}_{-6}$ in the sixth row and the signal line $\mathbf{33}_{-7}$ in the seventh row, and the signal line $\mathbf{33}_{-9}$ in the ninth row and the signal line $\mathbf{33}_{-10}$ in the tenth row correspond to the first wiring region.

On the other hand, in that combination in which display signals are distributed at the same timing by a selector circuit, two signal lines are wired neighboring with each other (second wiring region). In the layout structure of FIG. 12, the signal line $\mathbf{33}_{-1}$ in the first column and the signal line $\mathbf{33}_{-2}$ in the second column, the signal line $\mathbf{33}_{-4}$ in the fourth column and the signal line $\mathbf{33}_{-5}$ in the fifth column, the signal line $\mathbf{33}_{-7}$ in the seventh column and the signal line $\mathbf{33}_{-8}$ in the eighth column, and the signal line $\mathbf{33}_{-10}$ in the tenth column and the signal line $\mathbf{33}_{-11}$ in the eleventh column correspond to the second wiring region.

In the layout structure of the pixel array section 30, not all pixel columns are configured from a pair of pixel columns including the first wiring region and a pair of pixel columns including the second wiring region. In other words, also a sole pixel column exists partly. Accordingly, the pixel array section 30 has a layout structure which has first wiring regions and second wiring regions not over an overall pixel region but at least at part of the pixel region.

Figure 13:
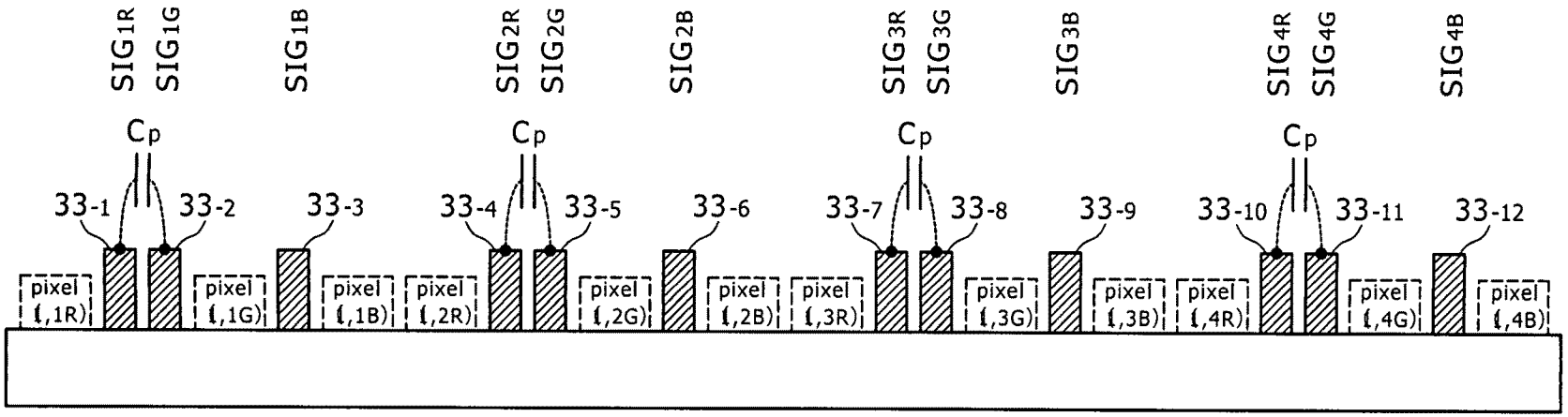
FIG. 13 is a schematic sectional view illustrating a manner in which parasitic capacitance is formed between two signal lines neighboring with each other between pixel columns in the working example 1.

In the layout structure according to the working example 1 having the configuration described above, if signal lines are positioned neighboring with each other, then parasitic capacitance $C_p$ is formed between the neighboring signal lines. In particular, the parasitic capacitance $C_p$ is formed between the neighboring signal lines $\mathbf{33}_{-1}$ and $\mathbf{33}_{-2}$, between the neighboring signal lines $\mathbf{33}_{-4}$ and $\mathbf{33}_{-5}$, between the neighboring signal lines $\mathbf{33}_{-7}$ and $\mathbf{33}_{-8}$ and between the neighboring signal lines $\mathbf{33}_{-10}$ and $\mathbf{33}_{-11}$ as seen in FIG. 13. It is assumed that, in the state in which the parasitic capacitance $C_p$ is formed, driving of the selector circuits 61, 62, 63, . . . is carried out at operation timings similar to those in the selector driving method described hereinabove.

Figure 14:
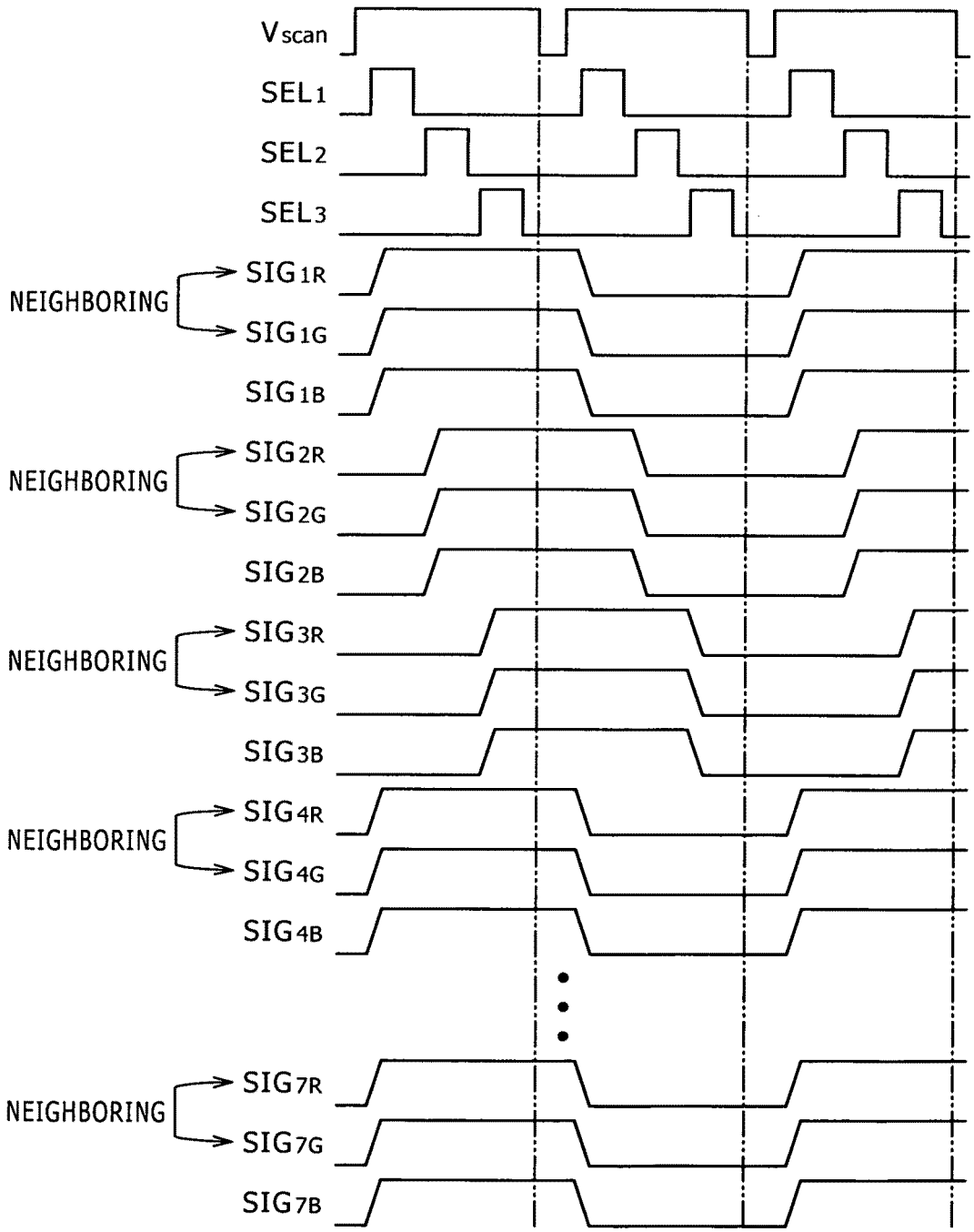
FIG. 14 is a timing chart illustrating operation timings of the pixel array section of FIG. 13.

Operation timings in this instance are illustrated in FIG. 14. Here, combinations of pixel columns to which display signals are distributed at timings different from each other by the selector circuits 61, 62, 63, . . . , particularly combinations of two pixel columns into which the signals $SIG_{1B}$ and $SIG_{2R}$, signals $SIG_{2B}$ and $SIG_{3R}$, and signals $SIG_{3B}$ and $SIG_{4R}$ are written are considered. In the combinations of the pixel columns, two signal lines belonging to the two pixel rows are not positioned neighboring with each other, the parasitic capacitance $C_p$ does not exist between the two signal lines. Accordingly, even if display signals are written into the two signal lines at different timings from each other, the display signal written first into one of the signal lines is not influenced by the display signal written later into the other signal line by coupling of the parasitic capacitance $C_p$.

Now, combinations of pixel columns to which display signals are distributed at the same timing by the selector circuits 61, 62, 63, . . . , particularly combinations of two pixel columns into which the signals $SIG_{1R}$ and $SIG_{1G}$, signals $SIG_{2R}$ and $SIG_{2G}$, and signals $SIG_{3R}$ and $SIG_{3G}$ are written are considered. In the combinations of the pixel columns, since two signal lines belonging to the two pixel columns are positioned neighboring with each other, the parasitic capacitance $C_p$ exists between the two signal lines. However, even if the parasitic capacitance $C_p$ exists, since the display signals are written at the same timing into the two signal lines, each of them is not influenced by the other display signal at all.

As described hereinabove, even if writing timings of display signals into two signal lines belonging to neighboring pixel columns are different from each other, since the two signal lines are not positioned neighboring with each other, accurate display signals can be written into the signal lines. In other words, since the two signal lines are not positioned neighboring with each other and therefore the parasitic capacitance $C_p$ does not exist between the two signal lines, picture quality deterioration by coupling of the parasitic capacitance $C_p$ can be suppressed. Consequently, a display apparatus of high picture quality can be provided by writing of accurate display signals into the individual signal lines.

It is to be noted that, while, in the working example 1, the time division number x in the selector driving method is x=3 corresponding to the three subpixels of RGB, the time division number x is not limited to x=3. In particular, the time division number x may be any number if it is equal to or greater than 2. This similarly applies also to the other working examples hereinafter described.

Figure 15:
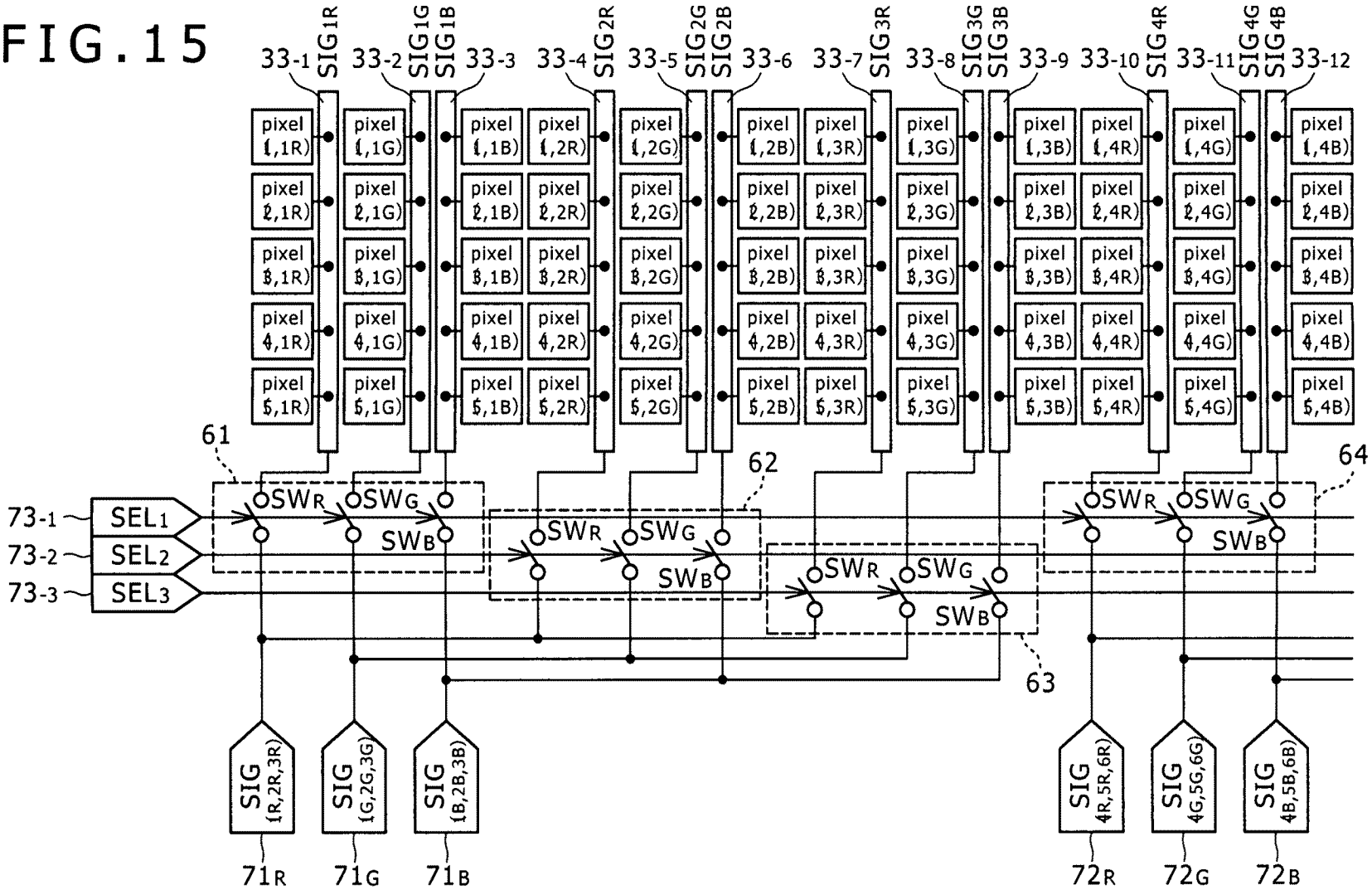
FIG. 15 is a circuit diagram showing a layout structure of a pixel array section according to a modification to the working example 1.
Figure 16:
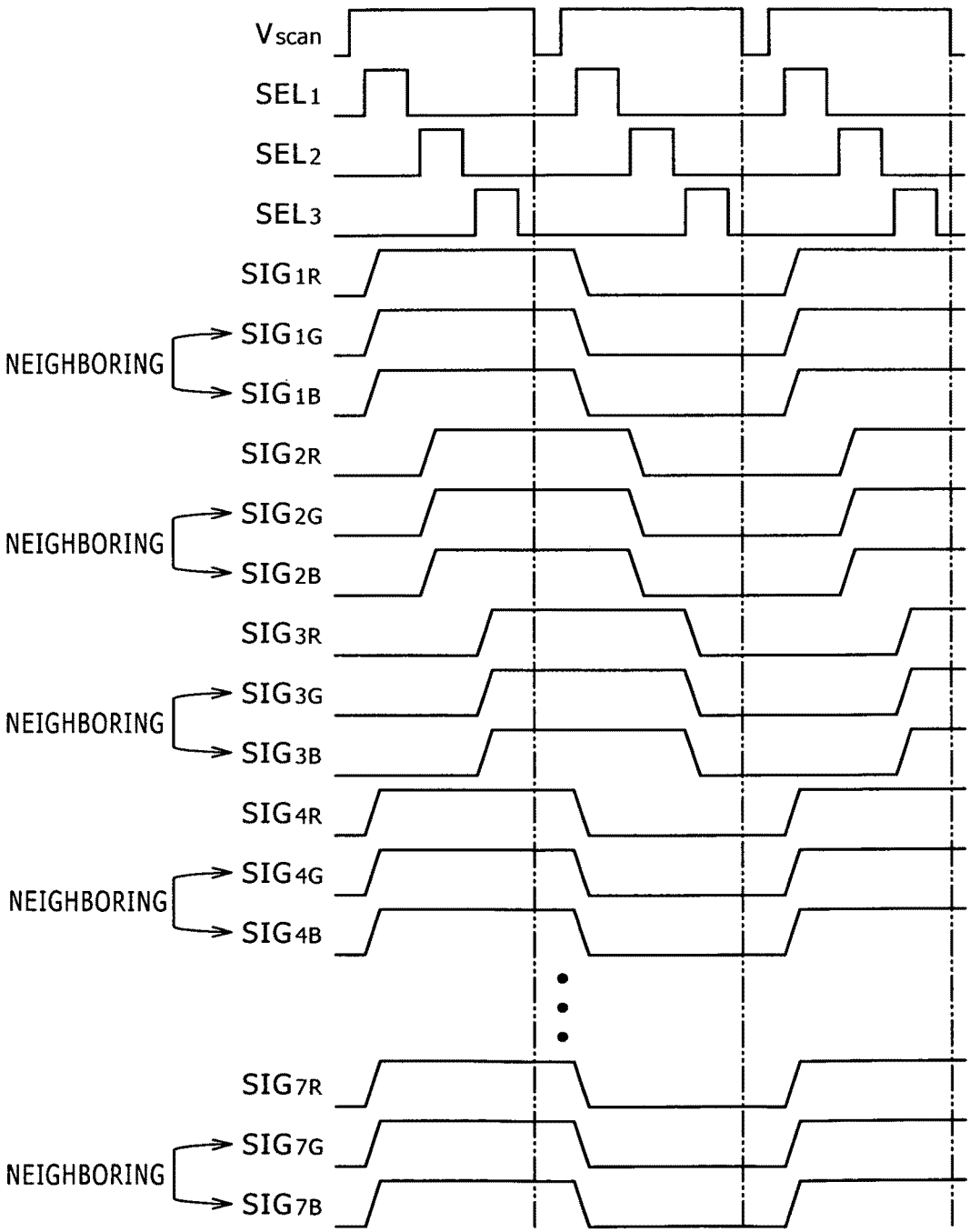
FIG. 16 is a timing chart illustrating operation timings of the pixel array section of FIG. 15.

Further, while, in the layout structure in the working example 1 described above, a signal line belonging to a pixel column of R and a signal line belonging to a pixel column of G are positioned neighboring with each other, such another layout structure as illustrated in FIG. 15 may be adopted alternatively. Referring to FIG. 15, in the layout structure shown, a signal line belonging to a pixel column of G and a signal line belonging to a pixel column of B are positioned neighboring with each other. Operation timings in the case where the layout structure shown in FIG. 15 is adopted are illustrated in FIG. 16.

Further, the layout structure of an object of application in the working example 1 may be any layout structure in which two signal lines belonging to neighboring pixel columns are positioned neighboring with each other between the pixel columns, but does not require that it has a mirror type layout structure. In particular, even if the layout structure does not have a mirror type layout structure, if two signal lines belonging to neighboring pixel columns with each other are positioned between the neighboring pixel rows, then the layout structure can achieve working effects similar to those achieved by the working example 1 described above.

[2-2. Working Example 2]

Figure 17:
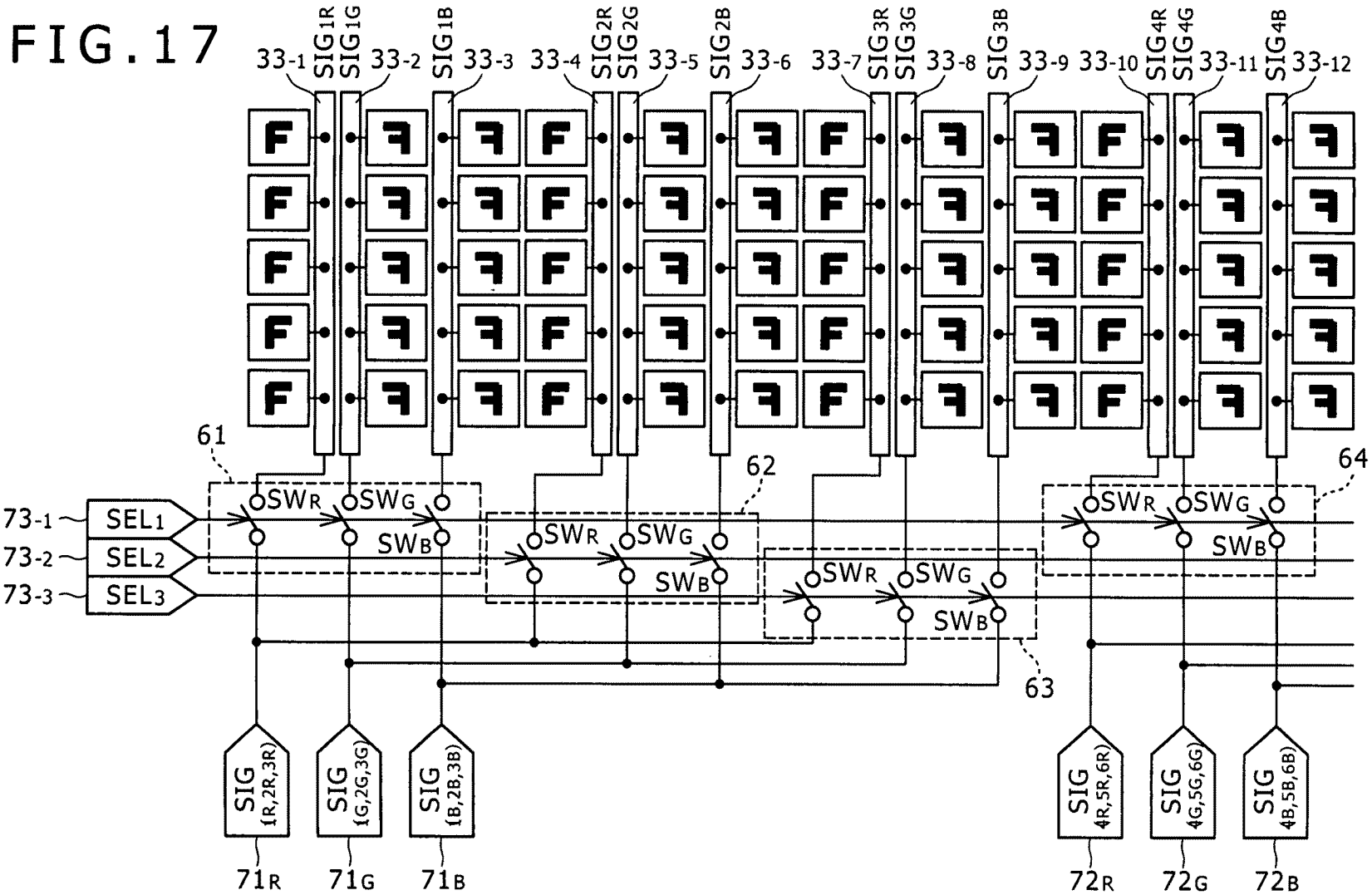
FIG. 17 is a circuit diagram showing a layout structure of a pixel array section according to a working example 2 of the first embodiment of the present invention.

FIG. 17 is a circuit diagram showing a layout structure of the pixel array section according a working example 2 of the present invention. Also in FIG. 17, for simplified illustration, the pixel array section is shown including a pixel array of five rows and 12 columns. Further, the time division number x is x=3 corresponding to the three subpixels of RGB. Further, as a select method for signals by the selector circuits 61, 62 and 63, the first select method of writing signals time-divisionally into subpixels of one color in a group of 3 pixels is adopted.

While, in the layout structure according to the working example 1, it does not matter whether or not the pixel circuits have the same layout shape, it is premised on an assumption that the pixel circuits in the layout structure according to the working example 2 basically have the same layout shape. Further, the pixel circuits belonging to two neighboring pixel columns have a mirror type structure such that they are substantially symmetrical with each other with respect to the axis Y of a column direction of the pixel array or they move in parallel to each other in a row direction.

In particular, referring to FIG. 17, the pixel circuits belonging to the first pixel column and the pixel circuits belonging to the second pixel column, and the pixel circuits belonging to the third pixel column and the pixel circuits belonging to the fourth pixel column, individually have a mirror type layout structure. Further, the pixel circuits belonging to the fourth pixel column and the pixel circuits belonging to the fifth pixel column, and the pixel circuits belonging to the sixth pixel column and the pixel circuits belonging to the seventh pixel column, individually have a mirror type layout structure.

Further, the pixel circuits belonging to the seventh pixel column and the pixel circuits belonging to the eighth pixel column, the pixel circuits belonging to the ninth pixel column and the pixel circuits belonging to the tenth pixel column, and the pixel circuits belonging to the tenth pixel column and the pixel circuits belonging to the eleventh pixel column, individually have a mirror type layout structure.

Further, in the pixel array of five rows and 12 columns shown in FIG. 17, the pixel circuits belonging to neighboring pixel columns of R and G in a unit of a pixel column of three subpixels of R, G and B which configure one pixel have a layout structure wherein they move in parallel in a row direction of the pixel array each by one pixel pitch.

In the mirror type layout structure described above, the signal line $\mathbf{33}_{-1}$ connected to the pixel circuits belonging to the first pixel column and the signal line $\mathbf{33}_{-2}$ connected to the pixel circuits belonging to the second pixel column neighbor with each other. Further, the signal line $\mathbf{33}_{-4}$ connected to the pixel circuits belonging to the fourth pixel column and the signal line $\mathbf{33}_{-5}$ connected to the pixel circuits belonging to the fifth pixel column neighbor with each other. Further, the signal line $\mathbf{33}_{-7}$ connected to the pixel circuits belonging to the seventh pixel column and the signal line $\mathbf{33}_{-8}$ connected to the pixel circuits belonging to the eighth pixel column neighbor with each other. Furthermore, the signal line $\mathbf{33}_{-10}$ connected to the pixel circuits belonging to the tenth pixel column and the signal line $\mathbf{33}_{-11}$ connected to the pixel circuits belonging to the eleventh pixel column neighbor with each other.

As apparent from the foregoing, in a combination of those pixel columns to which display signals are provided at the same timing by the selector circuits, signal lines belonging to the pixel columns of the combination are wired such that they neighbor with each other in accordance with the mirror type layout structure. On the other hand, between those pixel columns to which display signals are applied at different timings by the selector circuits, the signal lines belonging to the pixel columns are disposed so as not to neighbor with each other.

In other words, in those combinations in which display signals are distributed at different timings by the selector circuits from among the combinations of two signal lines connected to the pixel circuits belonging to two neighboring pixel columns, the two signal lines are wired such that they do not neighbor with each other (first wiring region). In the mirror type layout structure of FIG. 12, the signal line $\mathbf{33}_{-3}$ for the third row and the signal line $\mathbf{33}_{-4}$ for the fourth row, the signal line $\mathbf{33}_{-6}$ for the sixth row and the signal line $\mathbf{33}_{-7}$ for the seventh row, and the signal line $\mathbf{33}_{-9}$ for the ninth row and the signal line $\mathbf{33}_{-18}$ for the tenth row, correspond to the first wiring region.

On the other hand, in those combinations wherein display signals are distributed at the same timing by the selector circuits, the two signal lines are wired neighboring with each other (second wiring region). In the mirror type layout structure, the signal line $\mathbf{33}_{-1}$ for the first row and the signal line $\mathbf{33}_{-2}$ for the second row, the signal line $\mathbf{33}_{-4}$ for the fourth row and the signal line $\mathbf{33}_{-5}$ for the fifth row, the signal line $\mathbf{33}_{-7}$ for the seventh row and the signal line $\mathbf{33}_{-8}$ for the eighth row, and the signal line $\mathbf{33}_{-10}$ for the tenth row and the signal line $\mathbf{33}_{-11}$ for the eleventh row, correspond to the second wiring line region.

Here, in the layout structure of the pixel array section 30, not all of the pixel circuits are configured from a pair of pixel columns including a first wiring region and a pair of pixel columns including a second wiring region. In other words, also a sole pixel column exists locally. Accordingly, the pixel array section 30 has a layout structure wherein it has a first wiring region and a second wiring region not over an overall pixel region but at least in part of the overall pixel region.

Also in the mirror type layout structure according to the working example 2 having the configuration described above, parasitic capacitance $C_p$ is formed between neighboring signal lines. Thus, in the state in which the parasitic capacitance $C_p$ is formed, driving of the selector circuits 61, 62 and 63 is carried out at operation timings similar to those in the case of the selector driving method described hereinabove.

As described hereinabove, where both of the mirror type layout structure and the selector driving method are utilized, even if the wiring timings of display signals into two signal lines belonging to neighboring pixel columns are different from each other, since the two signal lines are not positioned neighboring with each other, accurate display signals can be written. In other words, since such two signal lines do not neighbor with each other, the parasitic capacitance $C_p$ does not exist between the two signal lines, and consequently, picture quality deterioration by coupling by the parasitic capacitance $C_p$ can be suppressed.

Consequently, a display apparatus of a high yield and a high definition can be implemented by efficient layout of the pixel array section 30 based on the mirror type layout structure, and a display apparatus of high picture quality can be provided by writing of an accurate display signal into each of the signal lines. As described hereinabove, one of effects provided by the mirror type layout structure is that a power supply line can be wired along a column direction such that it is used commonly by pixel circuits of two columns.

Figure 18:
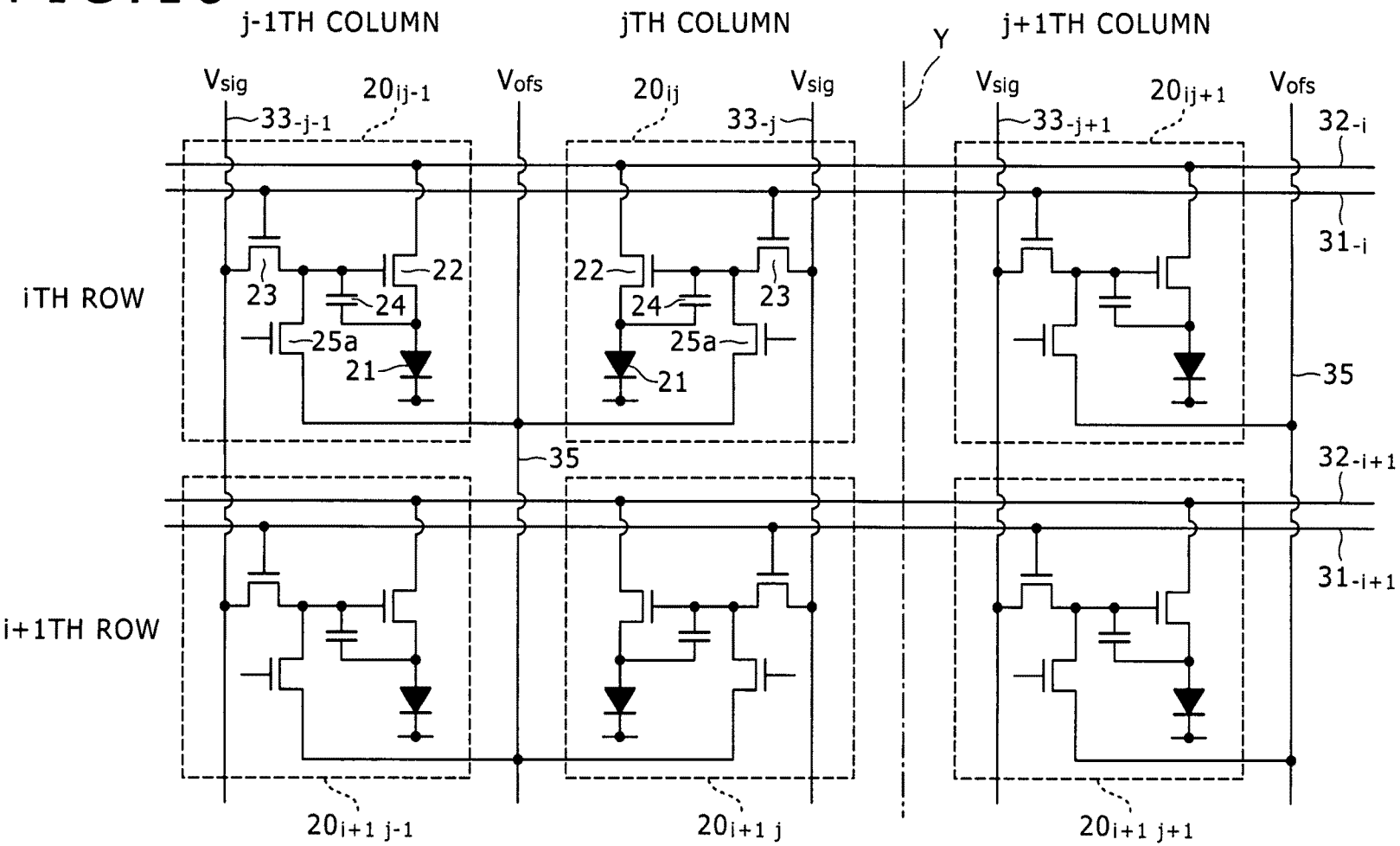
FIG. 18 is a circuit diagram showing another circuit configuration of a pixel.

As a power supply line used commonly by pixel circuits of two columns, a power supply line for transmitting a reference voltage $V_{ofs}$ for threshold value correction can be applied as an example. The pixel circuit 20 shown in FIG. 2 is configured such that the reference voltage $V_{ofs}$ for threshold value correction is written into the gate electrode of the driving transistor 22 from the signal line 33 through the writing transistor 23. In contrast, another pixel configuration is adopted wherein, as shown in FIG. 18, a switching transistor 25*a* is provided additionally in the pixel circuit 20 such that the reference voltage $V_{ofs}$ for threshold value correction is fetched not from the signal line 33 but from a power supply line 35 wired along a column direction into the pixel through the switching transistor 25*a*.

Figure 19:
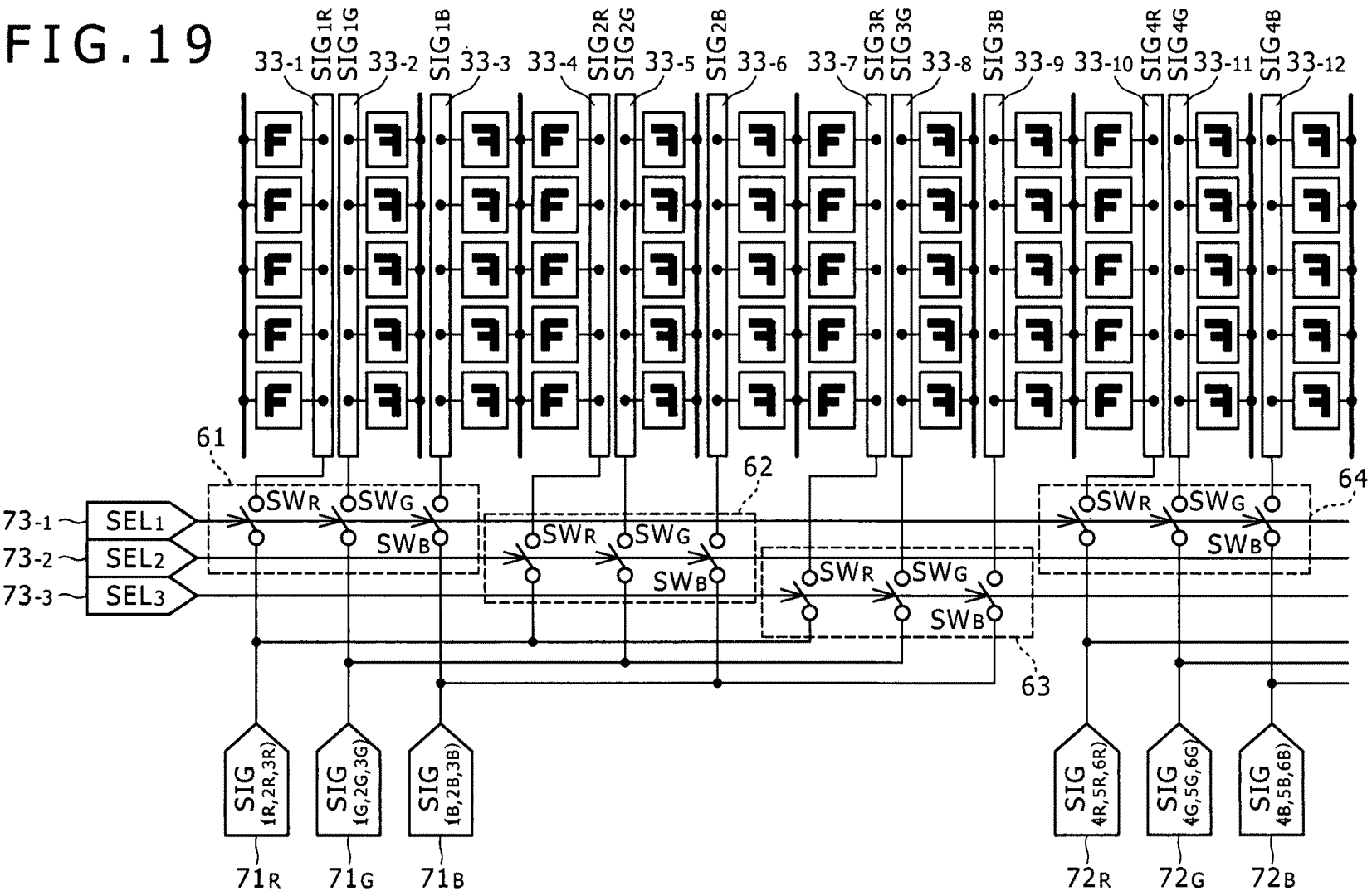
FIG. 19 is a circuit diagram showing a layout structure in the case wherein a power supply line is used commonly by and between pixel circuits belonging to two pixel columns.

Further, as seen in FIG. 19, the power supply line 35 is wired along the column direction between two pixel columns between which the signal line 33 is not wired such that the power supply line 35 is used commonly by the pixel circuits belonging to the two pixel columns. The example of FIG. 19 has a layout structure wherein the power supply line 35 for transmitting the reference voltage $V_{ofs}$ for threshold value correction is commonly used by the pixel circuits belonging to the two third and fourth pixel columns, by the pixel circuits belonging to the two sixth and seventh pixel columns and by the pixel circuits belonging to the two ninth and tenth pixel columns.

[2-3. Working Example 3]

Figure 20:
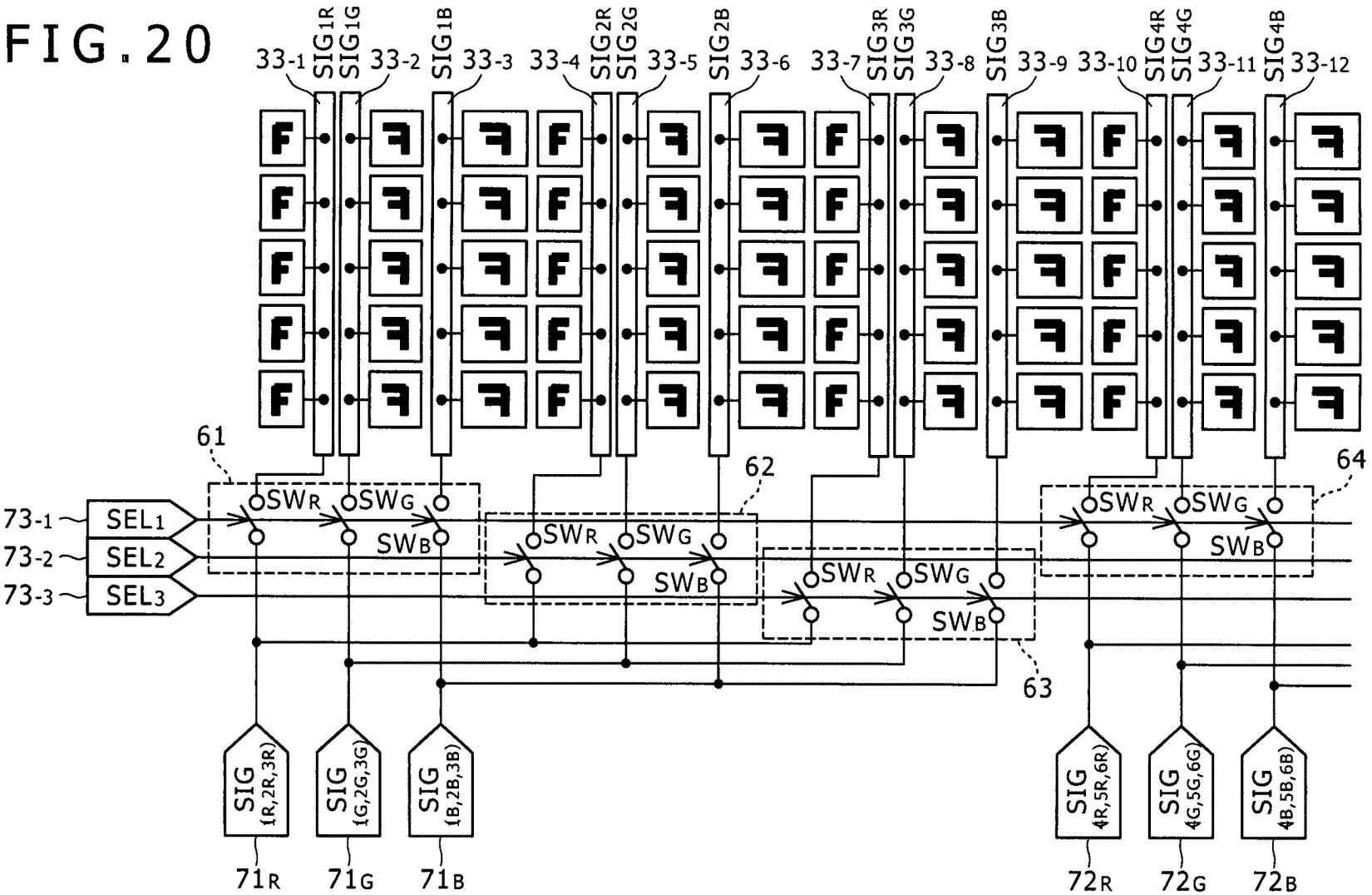
FIG. 20 is a similar view but showing a circuit having a layout structure of a pixel array section according to a working example 3 of the first embodiment.

FIG. 20 is a circuit diagram showing a layout structure of the pixel array section according a working example 3 of the present invention. Also in FIG. 20, for simplified illustration, the pixel array section is shown including a pixel array of five rows and 12 columns. Further, the time division number x is x=3 corresponding to the three subpixels of RGB. Further, as a select method for signals by the selector circuits 61, 62, 63, . . . , the first select method of writing signals time-divisionally into subpixels of one color in a group of three pixels is adopted.

In the layout structure according to the working example 2, it is premised on an assumption that the pixel circuits basically have the same layout shape. In FIG. 20, a "character of F" and a "horizontally reversed character of F" in pixels represent that the pixels have a basically same layout structure and have a relationship of a mirror type layout structure. However, in some organic EL display apparatus or a like apparatus, subpixels for RGB have different pixel constants, or in other words, subpixels for RGB have different layout shapes, due to a difference in light emitting efficiency or a white balance of organic EL elements of RGB.

Here, RGB pixel sizes are studied. The pixel size is sometimes changed depending upon the life in which the luminance of an organic EL element decreases to one half (such life is hereinafter referred to simply as "life"). The life of an organic EL element becomes shorter as the luminance per unit area increases, or in other words, as the current flowing per unit area increases. Accordingly, even if the emitted light luminance of the display panel is fixed, the life becomes shorter as the size of the light emitting area increases.

Therefore, organic EL elements of RGB are designed such that the organic EL element of a color whose life is short has a large pixel size so that the life of the display panel can be made longer than that in an alternative case in which all organic EL elements of RGB are designed so as to have the same size. In organic EL display apparatus, generally the pixel size for B, that is, for blue, is in most cases made comparatively great.

Further, as another determination factor of the pixel size of RGB pixels, the size sometimes depends upon the size of transistors and/or a capacitor of a pixel circuit. For example, in a pixel circuit having a mobility correction function described hereinabove, where the mobility correction time is represented by t, the current $I_{ds}$ flowing to the driving transistor 22 is represented by the following expression (4):

$$I_{ds}=(\beta/2)\cdot\{1/(1/V_{sig})\cdot(\beta/2)\cdot(t/C)\}^2 \quad (4)$$

where β is a coefficient (=μ·(W/L)·Cox) including the mobility μ, and C is the capacitance value of a node discharged when the mobility correction is carried out, for example, a composite capacitance value of the holding capacitor 24 and a capacitance component of the organic EL element 21.

Here, the current $I_{ds}$ differs among the RGB pixels depending upon the light emission efficiency or the whiteness degree setting. If the current $I_{ds}$ becomes high and the mobility correction time t is set to a fixed period of time (it is necessary to make the mobility correction time t fixed because the correction time periods for RGB pixels are same), in order to allow the RGB pixels to carry out equivalent operation even if the current $I_{ds}$ differs among them, the following magnifications should be applied:

$I_{ds}$: n times

β: n times

C: n times t: 1 time $V_{sig}$: 1 time

Further, even if it is impossible to cause the RGB pixels to carry out fully same or equivalent operation, it is preferable to increase, as the current $I_{ds}$ increases, the capacitance value C of the node to be discharged when the mobility correction is carried out. To increase the capacitance value C signifies to increase the size of the holding capacitor 24 or of a capacitor for assisting the holding capacitor 24. In an organic EL display apparatus, generally the light emission efficiency of organic EL elements of B is low, and therefore, the pixel size of subpixels of B is frequently designed in a greater size.

In the case where RGB subpixels have different pixel constants from each other, that is, have different layout shapes from each other, pixel circuits belonging to two neighboring pixel columns do not necessarily have a mirror type layout structure, different from the layout structure according to the working example 2. In this instance, the pixel circuits are preferably laid out on the right side or the left side as viewed from the signal line connected to the pixel circuits as seen in FIG. 20. Whether the pixel circuits should be laid out on the right side or the left side is selected suitably based on the pixel size and so forth. In the example illustrated in FIG. 20, the pixel circuits are designed such that the subpixels of B have the greatest pixel size while the subpixels of R have the smallest pixel size.

By suitably selecting whether the pixel circuits should be laid out on the right side or the left side of the signal line based on the pixel size and so forth, the layout structure becomes such that two signal lines belonging to two neighboring pixel columns neighbor with each other between the pixel columns, for example, as seen in FIG. 20. Here, whether the pixel circuits should be laid out on the right side or the left side of the signal lines is, in other words, whether the signal lines should be laid out on the left side or the right side of the pixel circuits.

As described hereinabove, if an organic EL display apparatus in which RGB subpixels have different layout shapes from each other adopts the layout structure wherein two signal lines belonging to two neighboring pixel columns neighbor with each other between the pixel columns, then similar effects to those achieved by the mirror type layout structure can be achieved.

In other words, efficient layout of the pixel array section 30 can be achieved. In particular, it is possible to wire a power supply line along a direction of a column between pixel circuits of two neighboring columns such that the power supply line is commonly used by the pixel circuits of the two columns or to use contact holes commonly between the pixel circuits of two columns or else to commonly use a lead line of a wiring line to an intermediate portion of the same. Further, the degree of freedom in layout is enhanced, and since the density in layout can be lowered, an enhanced yield can be anticipated.

Further, similarly as in the case of the working example 1 or the working example 2, in those combinations in which display signals are distributed at different timings from among the combinations of two signal lines connected to the pixel circuits belonging to two neighboring pixel columns, the two signal lines are wired such that they do not neighbor with each other. On the other hand, in those combinations wherein display signals are distributed at the same timing, the two signal lines are wired neighboring with each other.

In the combinations in which display signals are distributed at different timings, since two signal lines do not neighbor with each other, the parasitic capacitance $C_p$ does not exist between the two signal lines. Accordingly, even if display signals are written into the two signal lines at different timings from each other, such a situation that the display signal written into one of the signal lines first is influenced by the display signal written later into the other signal line by coupling by the parasitic capacitance $C_p$ does not occur.

On the other hand, in the combinations in which display signals are distributed at the same timing, since the two signal lines neighbor with each other, the parasitic capacitance $C_p$ exists between the two signal lines. However, even if the parasitic capacitance $C_p$ exists, since the display signals are written into the two signal lines at the same timing, they are not influenced by the other display signals.

Accordingly, in both cases of the combinations of two signal lines, accurate display signals can be written into signal lines. Consequently, even if such a structure that a shield line is wired between neighboring signal lines as in the prior art is not adopted, picture quality degradation by an influence of coupling by the parasitic capacitance $C_p$ can be suppressed, and consequently, a display image of high picture quality can be obtained.

Modifications to the Working Examples 2 and 3

In the working examples 2 and 3, pixel circuits have a layout structure wherein they are positioned on one side as viewed from a signal line, or in other words, a signal line is positioned on one side as viewed from pixel circuits. However, the layout structure need not necessarily be such that pixel circuits and a signal line are relatively positioned on one side as viewed from the other. For example, the layout structure may be such that a signal line traverses pixel circuits at the center of some of the pixel circuits.

In those combinations in which display signals are distributed at different timings by the selector circuits from among combinations of two signal lines connected to pixel circuits belonging to two neighboring pixel columns, the two signal lines are wired such that they do not neighbor with each other. On the other hand, in those combinations wherein display signals are distributed at the same timing by the selector circuits, the two signal lines are wired neighboring with each other.

Basically, by adopting the layout structure described above, even if writing timings of display signals into signal lines belonging to two neighboring pixel columns are different from each other, accurate display signals can be written into the signal lines. Accordingly, even if such a structure that a shield line is wired between neighboring signal lines as in the known art is not adopted, picture quality degradation by an influence of coupling by the parasitic capacitance $C_p$ can be suppressed.

[2-4. Second Select Method]

In the working examples 1 to 3, when one pixel is composed of subpixels of RGB, the first select method of time-divisionally writing signals into subpixels of one color in a group of three pixels is adopted. Here, the second select method of time-divisionally carrying out writing into subpixels of RGB of one pixel is described.

Figure 21:
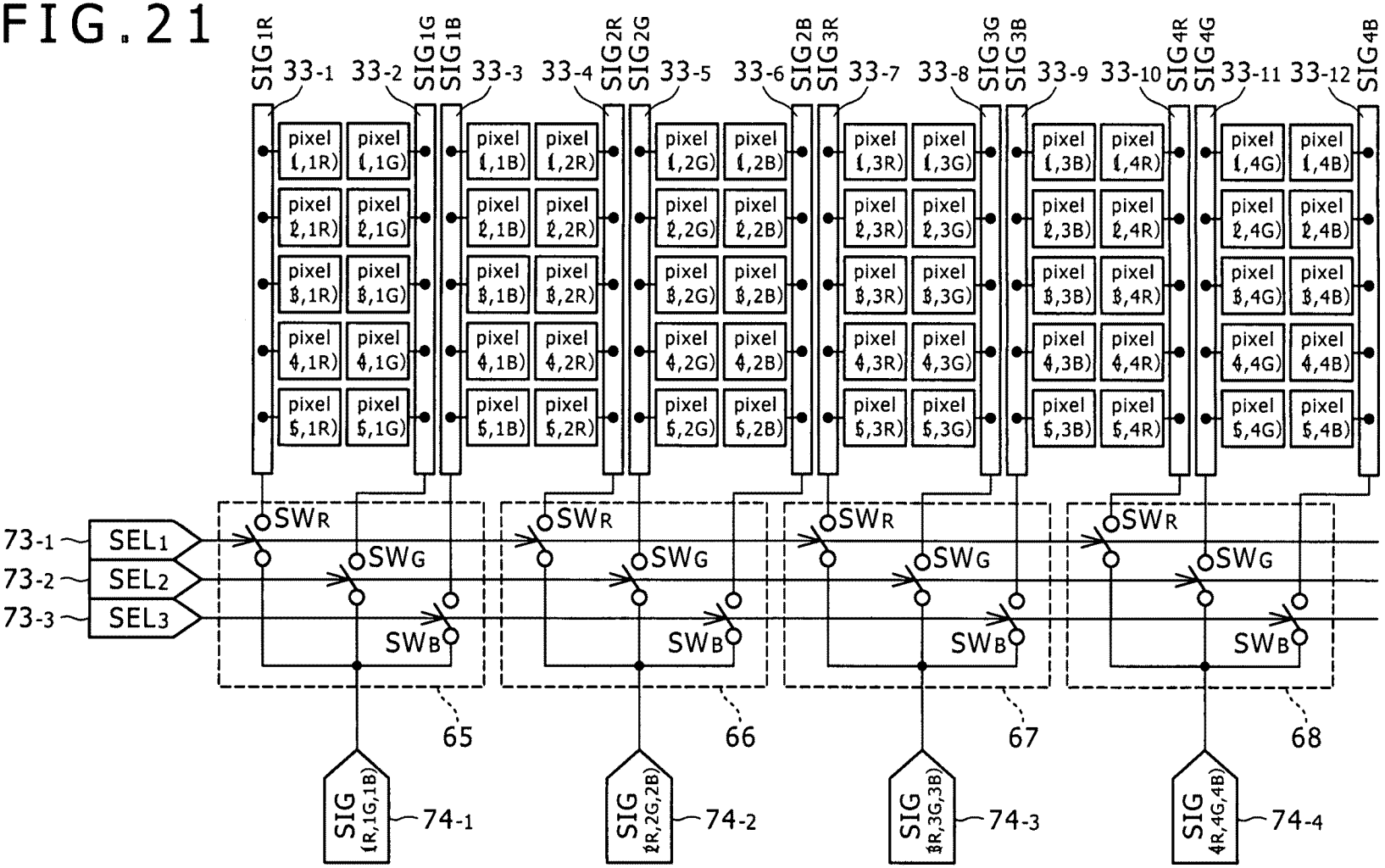
FIG. 21 is a similar view but showing a layout structure of a pixel array section in the case where writing is carried out time-divisionally into RGB subpixels of one pixel.

FIG. 21 is a circuit diagram showing a layout structure of a pixel array section in the case of the second select method. The pixel array section 30 has a layout structure same as that described hereinabove with reference to FIG. 8.

In particular, in a pixel array of five rows and 12 columns shown in FIG. 21, signal lines $\mathbf{33}_{-2}$ and $\mathbf{33}_{-3}$ neighbor with each other between the second and third pixel columns, and signal lines $\mathbf{33}_{-4}$ and $\mathbf{33}_{-5}$ neighbor with each other between the fourth and fifth pixel columns. Similarly, signal lines $\mathbf{33}_{-6}$ and $\mathbf{33}_{-7}$ neighbor with each other between the sixth and seventh pixel columns and signal lines $\mathbf{33}_{-8}$ and $\mathbf{33}_{-9}$ neighbor with each other between the eighth and ninth pixel columns while signal lines $\mathbf{33}_{-10}$ and $\mathbf{33}_{-11}$ neighbor with each other between the tenth and eleventh columns.

If two signal lines neighbor with each other in this manner, then parasitic capacitance $C_p$ is formed between the two neighboring signal lines $\mathbf{33}_{-2}$ and $\mathbf{33}_{-3}$, between the signal lines $\mathbf{33}_{-4}$ and $\mathbf{33}_{-5}$, between the signal lines $\mathbf{33}_{-6}$ and $\mathbf{33}_{-7}$, between the signal lines $\mathbf{33}_{-8}$ and $\mathbf{33}_{-9}$ and between the signal lines $\mathbf{33}_{-10}$ and $\mathbf{33}_{-11}$. Here, it is assumed that, in the state in which the parasitic capacitance $C_p$ is formed, driving of time-divisionally writing display signals into subpixels of RGB of one pixel is carried out by the selector circuits 65, 66, 67 and 68.

Figure 22:
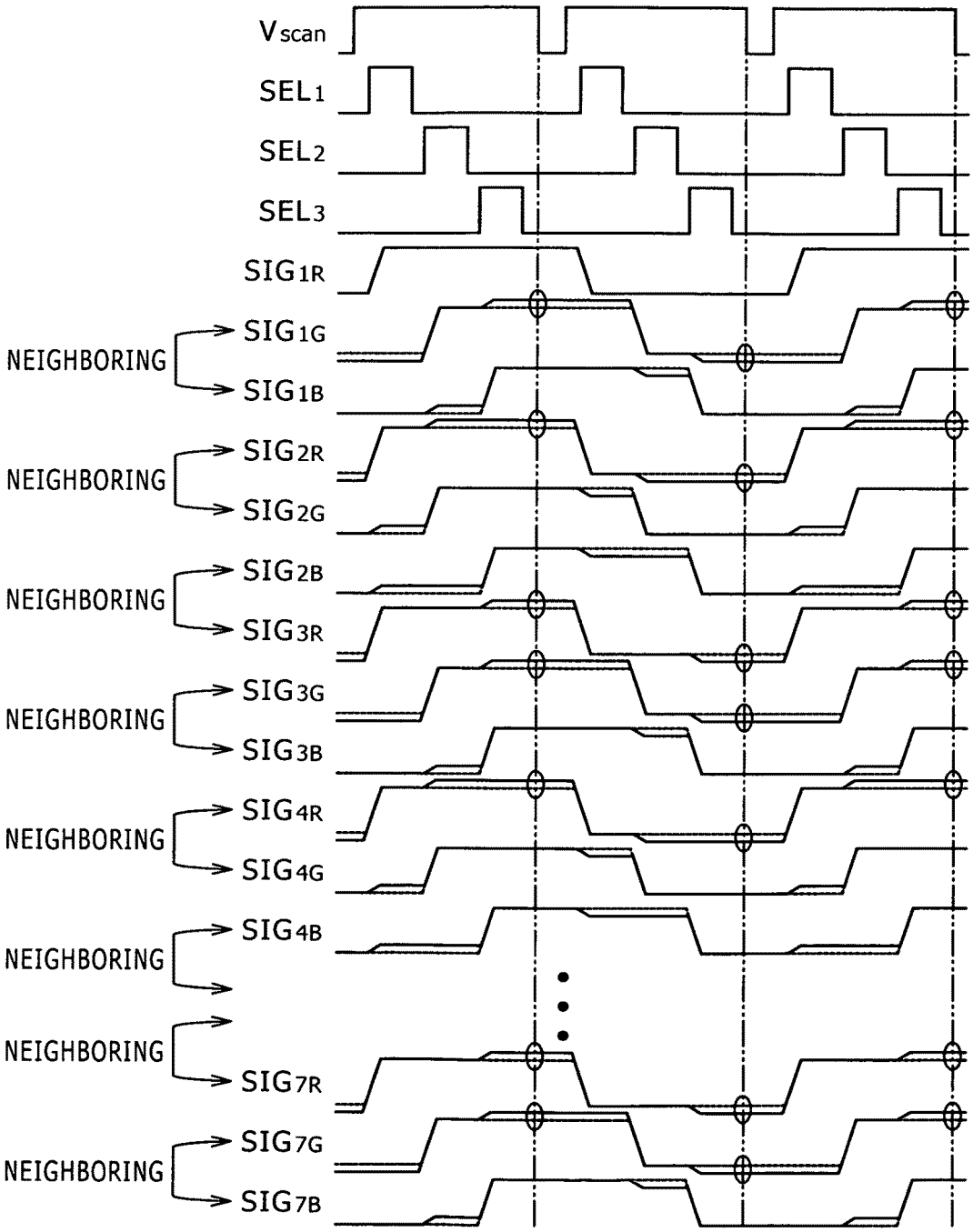
FIG. 22 is a timing chart illustrating a fault in the case where writing is carried out time-divisionally into RGB subpixels of one pixel.

Operation timings in this instance are illustrated in FIG. 22. To the selector circuit 65, time series signals $SIG_{1R}$, $SIG_{1G}$ and $SIG_{1B}$ are inputted through a terminal $\mathbf{74}_{-1}$. To the selector circuit 66, time series signals $SIG_{2R}$, $SIG_{2G}$ and $SIG_{2B}$ are inputted through a terminal $\mathbf{74}_{-2}$. To the selector circuit 67, time series signals $SIG_{3R}$, $SIG_{3G}$ and $SIG_{3B}$ are inputted through a terminal $\mathbf{74}_{-3}$. To the selector circuit 68, time series signals $SIG_{4R}$, $SIG_{4G}$ and $SIG_{4B}$ are inputted through a terminal $\mathbf{74}_{-4}$. Then, all of the selector circuits 65, 66, 67 and 68 time-divisionally carry out writing into the subpixels of one pixel in the order of, for example, R→G→B.

Here, signals are written at different timings from each inter into the signal lines $\mathbf{33}_{-2}$ and $\mathbf{33}_{-3}$, signal lines $\mathbf{33}_{-4}$ and $\mathbf{33}_{-5}$, signal lines $\mathbf{33}_{-6}$ and $\mathbf{33}_{-7}$, signal lines $\mathbf{33}_{-9}$ and $\mathbf{33}_{-9}$ and signal lines $\mathbf{33}_{-10}$ and $\mathbf{33}_{-11}$ which neighbor with each other between the pixel columns. If the writing timings of signals by the two signal lines in a state in which the parasitic capacitance $C_p$ is formed therebetween are different from each other, then accurate display signals cannot be written. In particular, since a display signal written first into a signal line is influenced by another display signal written into the other signal line later due to coupling by the parasitic capacitance $C_p$, accurate display signals cannot be written.

Although the display signals $SIG_{1G}$, $SIG_{2R}$, $SIG_{3R}$, $SIG_{3G}$ and $SIG_{4R}$ should originally have signal waveforms indicated by broken lines as seen in the timing chart of FIG. 22, a fluctuation in voltage occurs with the display signals like signal waveforms indicated by solid lines due to an influence of coupling by the parasitic capacitance $C_p$. In the timing chart of FIG. 22, a point indicated by a ○ mark is an instant at which the vertical scanning signal $V_{scan}$ changes from an active state into an inactive state, that is, a hold point of the display signal written in. Accordingly, the display signal written in is held while it remains in the state in which the voltage fluctuation is exhibited by coupling by the parasitic capacitance $C_p$.

[2-5. Working Example 4]

Figure 23:
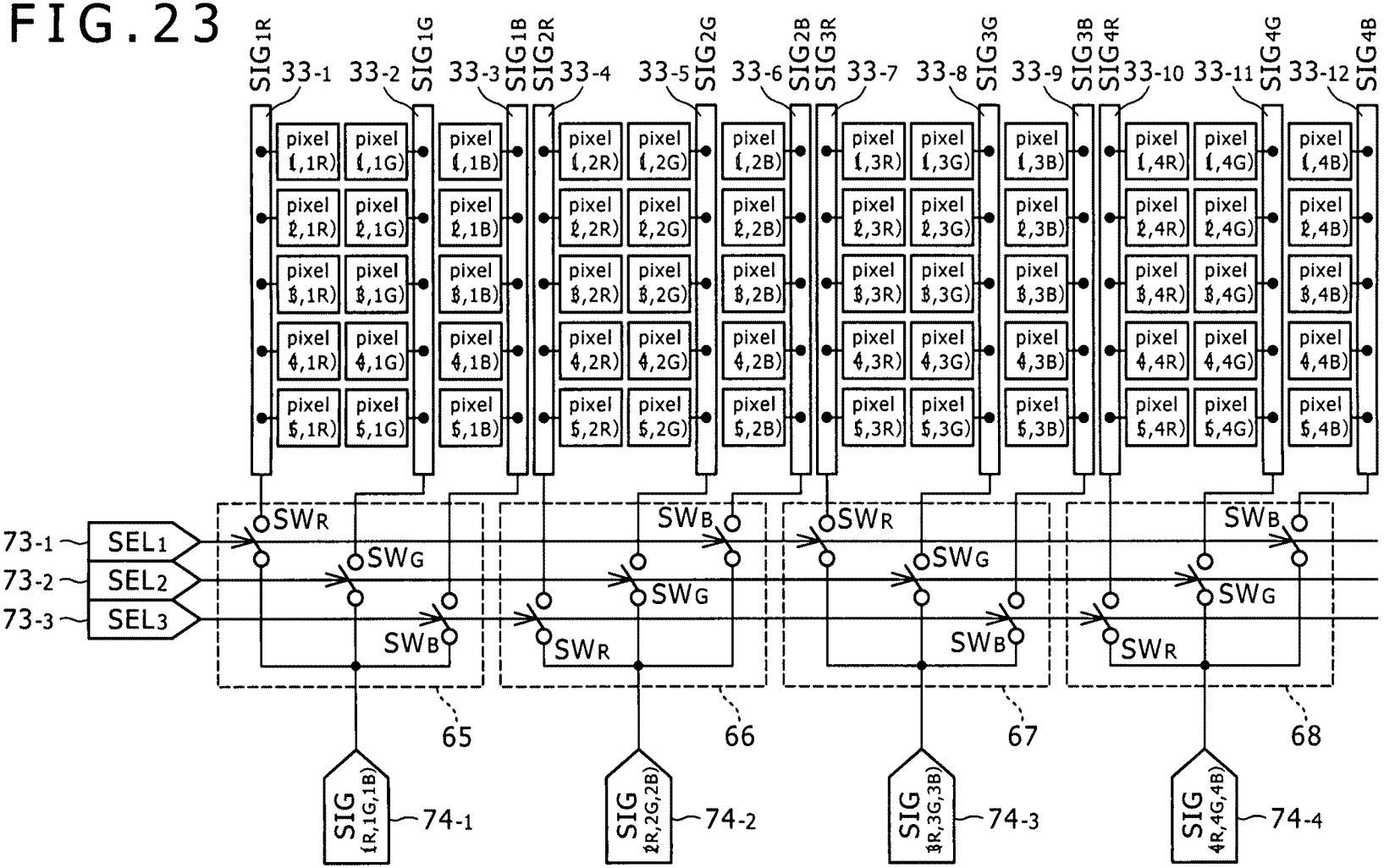
FIG. 23 is a circuit diagram showing a layout structure of a pixel array section according to a working example 4 of the first embodiment.

FIG. 23 is a circuit diagram showing a layout structure of a pixel array section according to a working example 4 of the present invention. Also in FIG. 23, for simplified illustration, the pixel array section is shown including a pixel array of five rows and 12 columns. Further, the time division number x is x=3 corresponding to the three subpixels of RGB. Furthermore, as a select method of a signal by the selector circuits 65, 66, 67 and 68, the second select method of time-divisionally carrying out writing into subpixels of RGB of one pixel is adopted.

In the layout structure according to the working example 4, on a boundary between pixels composed of subpixels of RGB, that is, between pixel columns, a signal line connected to the pixel circuits belonging to the pixel column of B and another signal line connected to the pixel circuits belonging to the pixel column of R neighbor with each other. Further, for the layout structure, the selector circuits 65 and 67 carry out writing of signals in the order of R→G→B, and the selector circuits 66 and 68 carry out writing of signals in the order of B→G→R.

Figure 24:
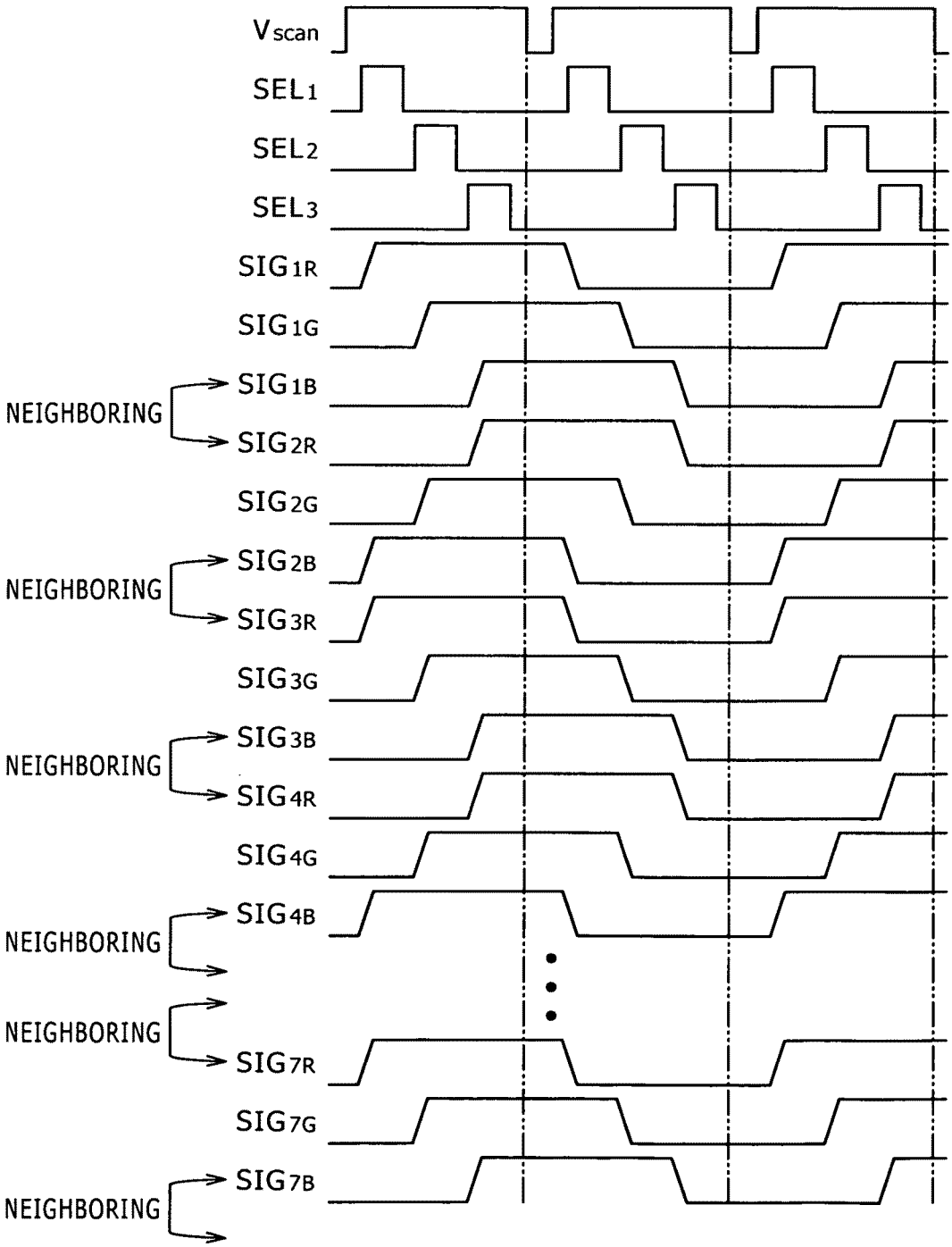
FIG. 24 is a timing chart illustrating operation timings of the pixel array section of FIG. 23.

Consequently, signals are written at the same timing into the signal lines $\mathbf{33}_{-2}$ and $\mathbf{33}_{-3}$, signal lines $\mathbf{33}_{-4}$ and $\mathbf{33}_{-5}$, signal lines $\mathbf{33}_{-6}$ and $\mathbf{33}_{-7}$, signal lines $\mathbf{33}_{-8}$ and $\mathbf{33}_{-9}$ and signal lines $\mathbf{33}_{-10}$ and $\mathbf{33}_{-11}$ which neighbor with each other between the pixel columns. Accordingly, even if such a structure that a shield line is wired between neighboring signal lines as in the prior art is not adopted, accurate display signals can be written into the signal lines neighboring with each other as apparently seen from the timing chart of FIG. 24. Consequently, picture quality degradation by an influence of coupling by the parasitic capacitance $C_p$ can be suppressed.

<3. Subject of the Selector Driving Method>

Incidentally, in the case where the selector driving method is adopted, a luminance difference arising from the order of selection of the selection circuits sometimes occurs. If a luminance difference arising from the selection order of the selection circuits occurs, then since periodical luminance unevenness occurs with a display image, the picture quality of the image is deteriorated.

In an organic EL display apparatus, a polycrystalline silicon TFT whose active layer is formed from polycrystalline silicon is used popularly for transistors as active elements from a reason that the driving capacity is high and the pixel size can be designed small. In contrast, it is widely known that polycrystalline silicon TFTs exhibit a significant dispersion in characteristic. Accordingly, in an organic EL display apparatus, various correction operations such as threshold value correction and mobility correction are carried out as described also in the basic circuit operation described hereinabove.

Here, a luminance difference arising from a selection order of the selector circuit in the case where, for example, a threshold value correction operation is involved is studied. In particular, the period after an end of threshold value correction till signal writing exhibits a difference in time depending upon the selection order of the selector circuits. Then, if very low leak current flows to the organic EL element 21 within a period from an end of threshold value correction till signal writing, then a luminance difference appears depending upon the selection order of the selection circuits, that is, in the writing order of signals.

This similarly applies also in the case where a mobility correction operation is involved. In particular, while the mobility correction is carried out in parallel to signal writing, a difference in time is provided in a period after an end of the signal writing till mobility correction of a next frame depending upon the selection order of the selection circuits. Then, if very low leak current flows to the organic EL element 21 within a period after the end of the signal writing till the mobility correction of the next frame, then periodical luminance unevenness is produced in the display image by the luminance difference arising from the selection order of the selector circuits.

Since the life of a liquid crystal apparatus is reduced if it is driven by dc, ac voltage driving of driving the liquid crystal display apparatus by applying an ac voltage is used. In order words, driving wherein the polarity of the voltage applied to the liquid crystal is reversed in a fixed cycle such as a frame cycle or a line cycle is used. Accordingly, in the case of a liquid crystal display apparatus, even if a luminance difference appears depending upon the selection order of the selector circuits, since the luminance difference is reversed and cancels the former luminance difference upon reversed driving, the average luminance difference is moderated.

In contrast, in the organic EL display apparatus, dc corresponding to a display signal supplied to a signal line is supplied to the organic EL element 21 in a pixel circuit to drive the organic EL element 21 to emit light. Consequently, in the organic EL display apparatus, the display luminance has a single directional relationship with the input data or display signal. Accordingly, a luminance difference arising from the selection order of the selector circuits is liable to appear particularly in comparison with the liquid crystal display apparatus.

Further, in the case wherein, within one horizontal period, the same signal is written collectively before display signals are distributed or divided time-divisionally to a plurality of signal lines, a time difference appears for a period of time until display signals are selected and written by the selector circuits, particularly a luminance difference is liable to appear. Here, as an example in the case where the same signal is written collectively before display signals are distributed time-divisionally to a plurality of signal lines, a case in which, upon threshold value correction, a reference voltage $V_{ofs}$ for the correction is collectively written as a single signal is listed.

Further, when a scanning line 21 is selected after display signals are time-divisionally distributed to a plurality of signal lines within one horizontal period in a non-selected state of the pixel 20, since a time difference appears after signal writing into a signal line by the selector circuits till selection of the organic EL element 21, a luminance difference is particularly liable to appear. In the organic EL display apparatus, luminance unevenness arising from a characteristic dispersion of TFTs is liable to matter as described above, and usually an operation for correcting the characteristic dispersion is carried out. Thus, in the organic EL display apparatus, an operation for controlling the writing period of signals, that is, the conduction period of the writing transistor 23, is carried out as a correction operation for a characteristic dispersion.

Selector Driving Method Hitherto Known

Incidentally, as a select method of signals by selector circuits for one pixel row, a first select method wherein signals are written time-divisionally into subpixels of one color in a group of three pixels and a second select method wherein signals are written time-divisionally into subpixels of RGB of one pixel are available as described hereinabove. Here, some known examples of the first and second select methods are described.

Second Select Method

Figure 25:
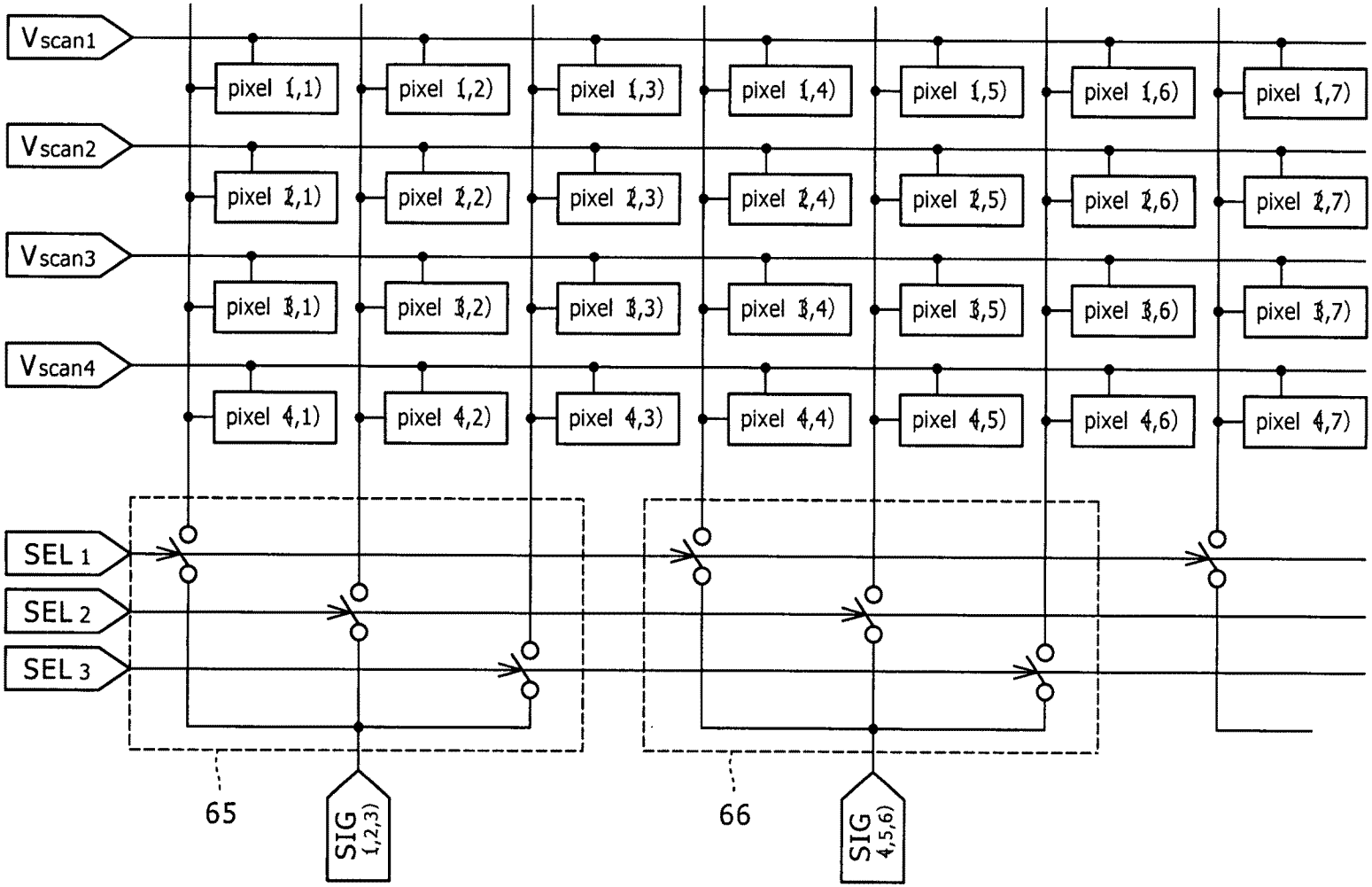
FIG. 25 is a block diagram showing a configuration of a display panel which adopts a second select method and includes pixels for single color display.
Figure 26:
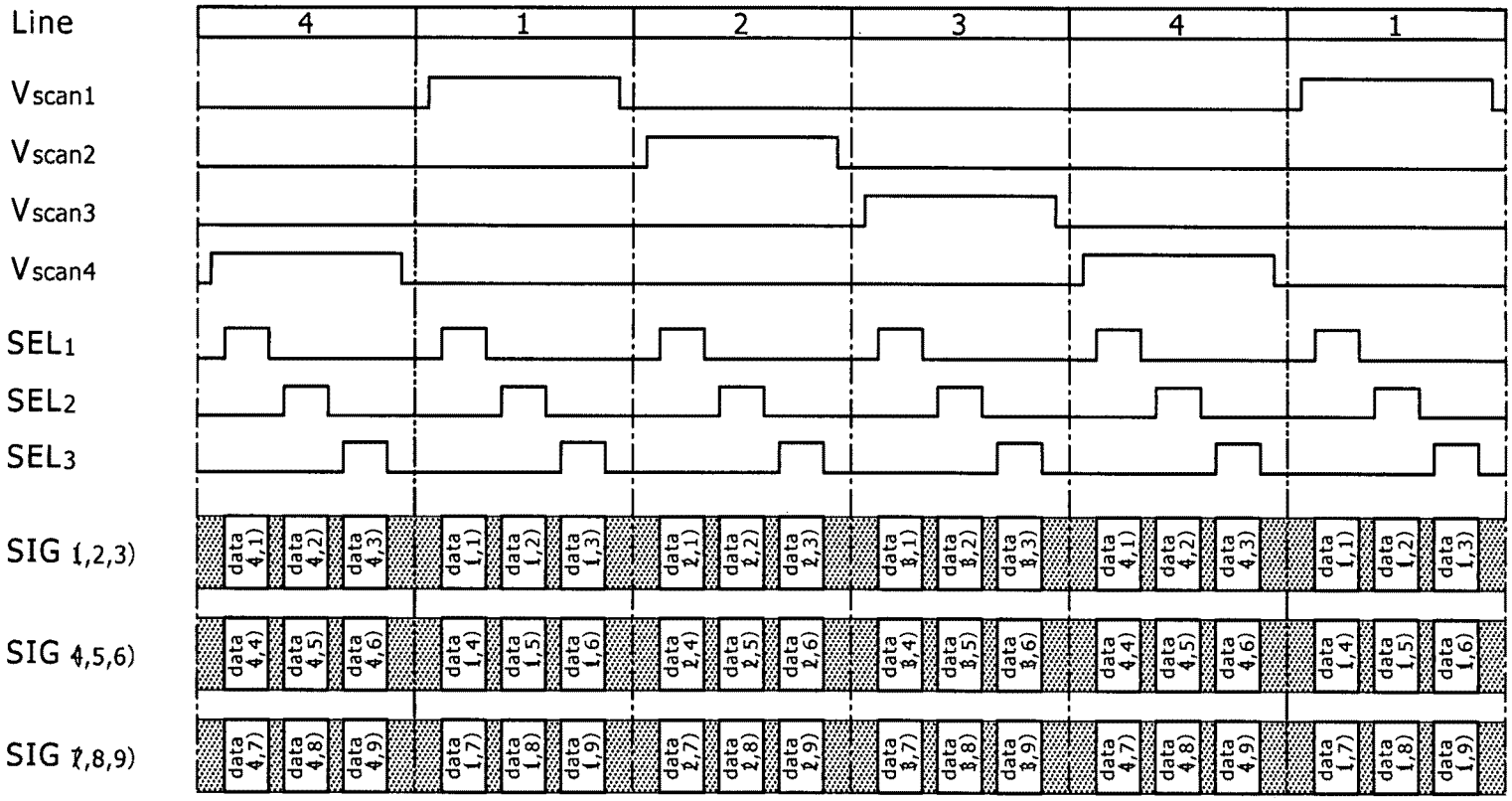
FIG. 26 is a timing chart illustrating driving timings of a known display panel which adopts the second select method and includes pixels for single color display.
Figure 27:
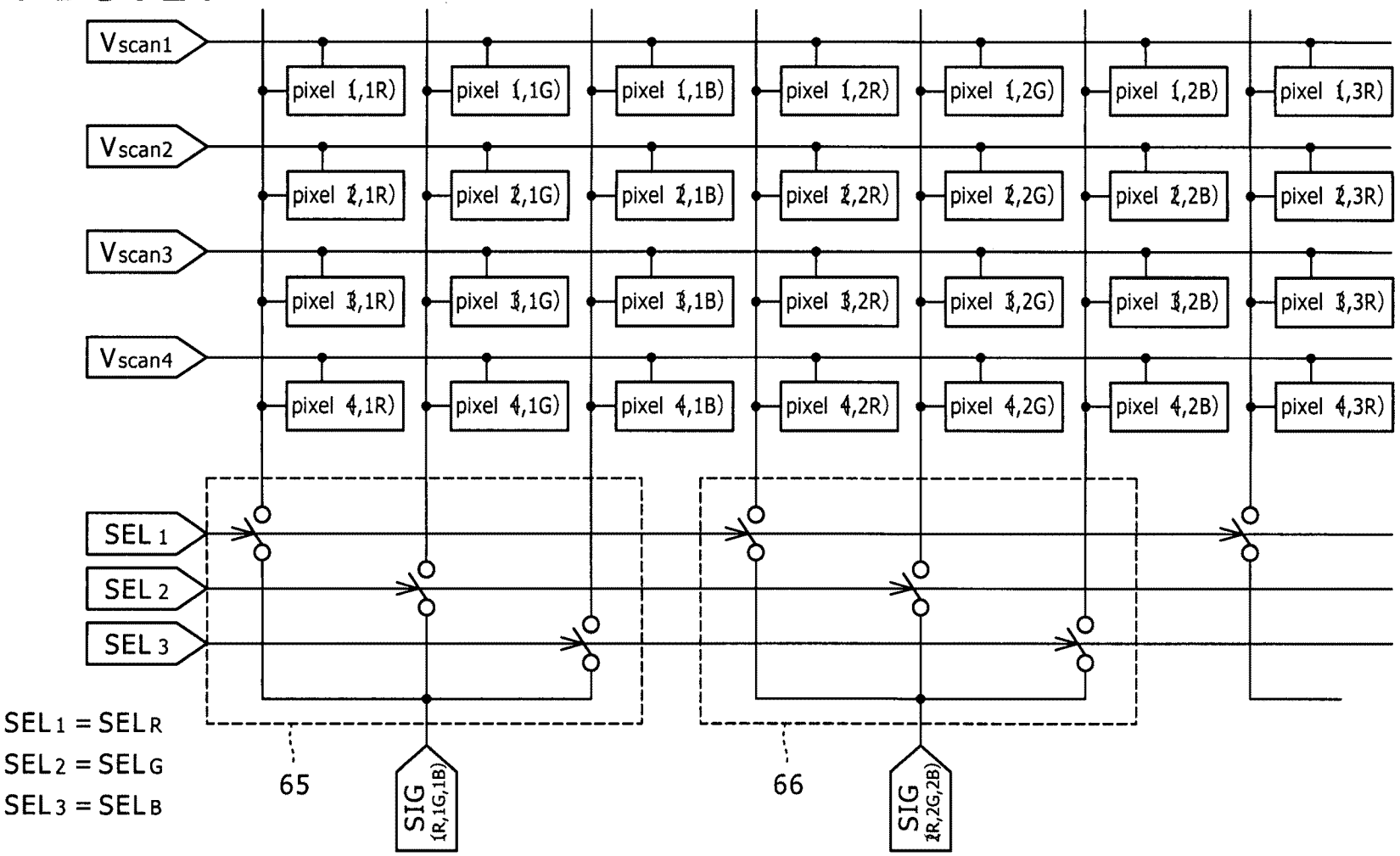
FIG. 27 is a block diagram showing a configuration of a display panel which adopts the second select method and includes pixels each formed from RGB subpixels.
Figure 28:
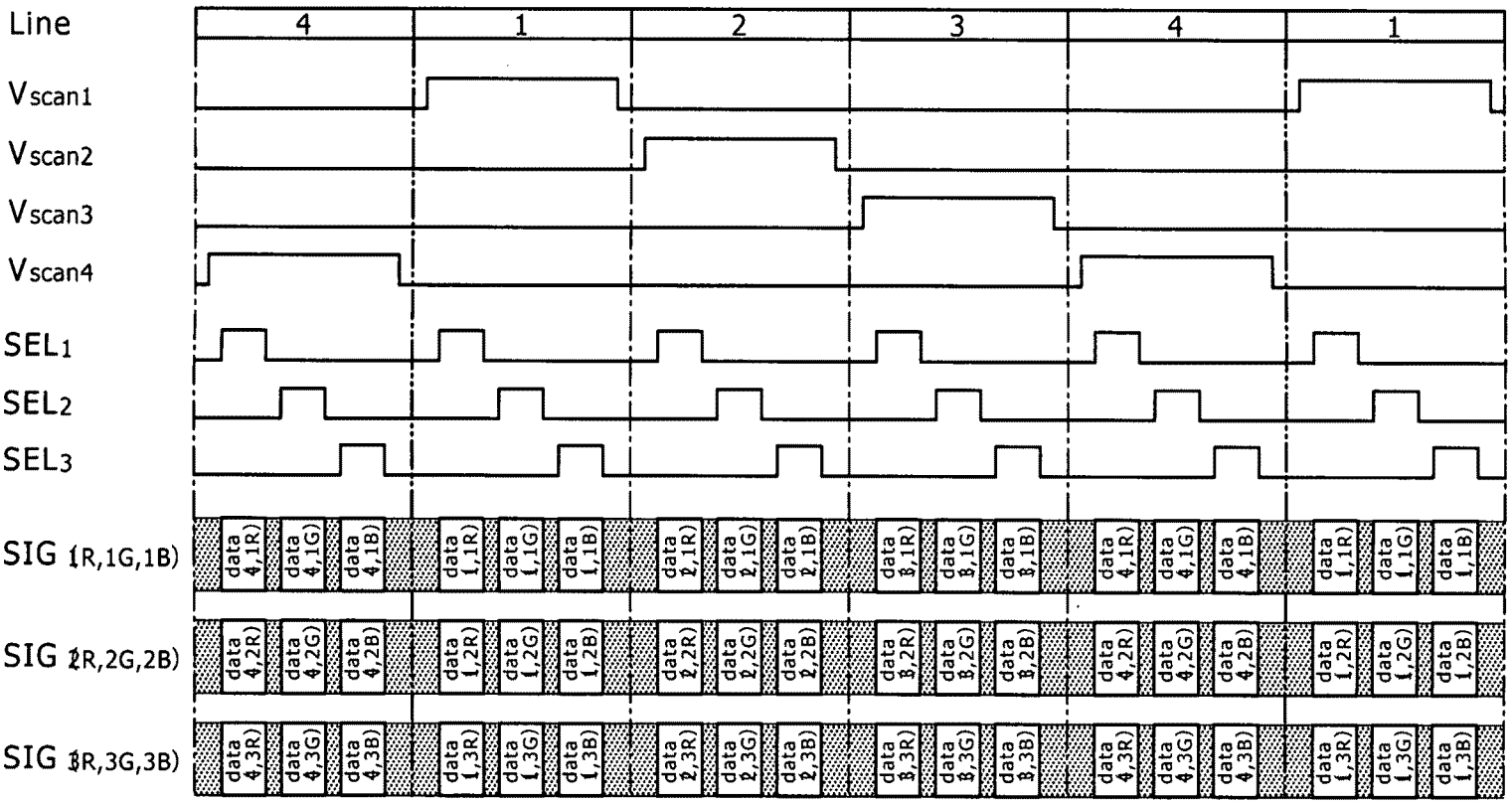
FIG. 28 is a timing chart illustrating driving timings of a known display panel which adopts the second select method and includes pixels each formed from RGB subpixels.

A configuration of a display panel which adopts the second select method and uses pixels for a single color is shown in FIG. 25, and operation of the display panel is illustrated in a flow chart of FIG. 26. Further, a configuration of a display panel which adopts the second select method and uses pixels each composed of subpixels of RGB is shown in FIG. 27, and operation of the display panel of FIG. 27 is illustrated in a flow chart of FIG. 28. In both of the display panels, the time division number x is x=3. However, the time division number is not limited to x=3.

In the second select method, commonly the selection signals $SEL_1$, $SEL_2$ and $SEL_3$ corresponding to the time division number x=3 are used to select the selector circuits 65, 66, . . . in the order of $$SEL_1 \rightarrow SEL_2 \rightarrow SEL_3$$

through all frames. If the selection order of the selector circuits 65, 66, . . . is fixed through all frames in this manner, then a luminance difference arising from the selection order of the selector circuits 65, 66, . . . appears from the reason described in <3. Subject of the Selector Driving Method> hereinabove.

Particularly in the case where a pixel is composed of subpixels of RGB, the selection signals $SEL_1$, $SEL_2$ and $SEL_3$ select subpixels of R, subpixels of G and subpixels of B, respectively. Accordingly, if the selection order of the selector circuits 65, 66, . . . is fixed, then there is a problem that the luminance balance of RGB is displaced from a predetermined luminance balance.

First Select Method

Figure 29:
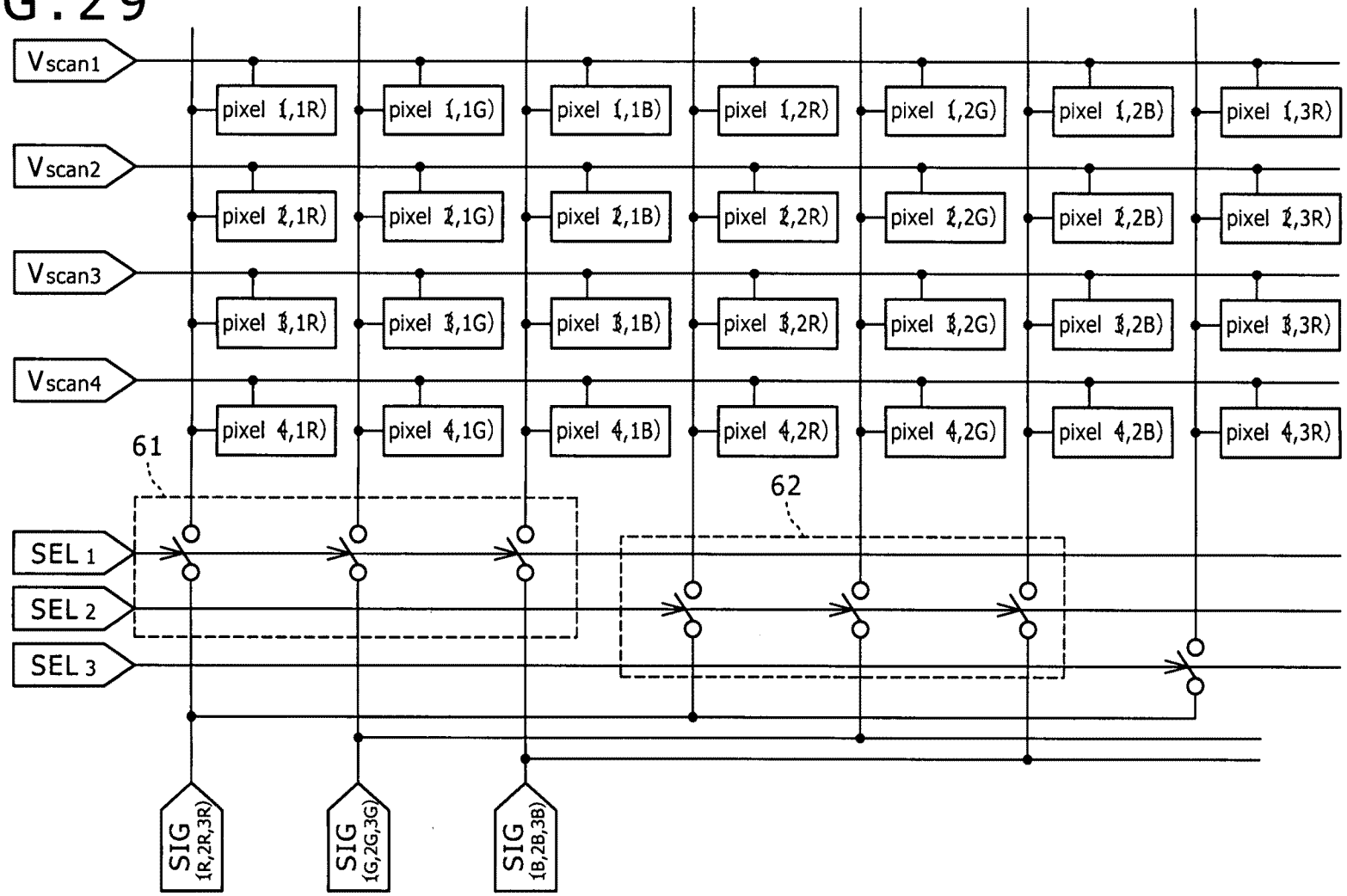
FIG. 29 is a block diagram showing a configuration of a display panel which adopts a first select method and includes pixels each formed from RGB subpixels.
Figure 30:
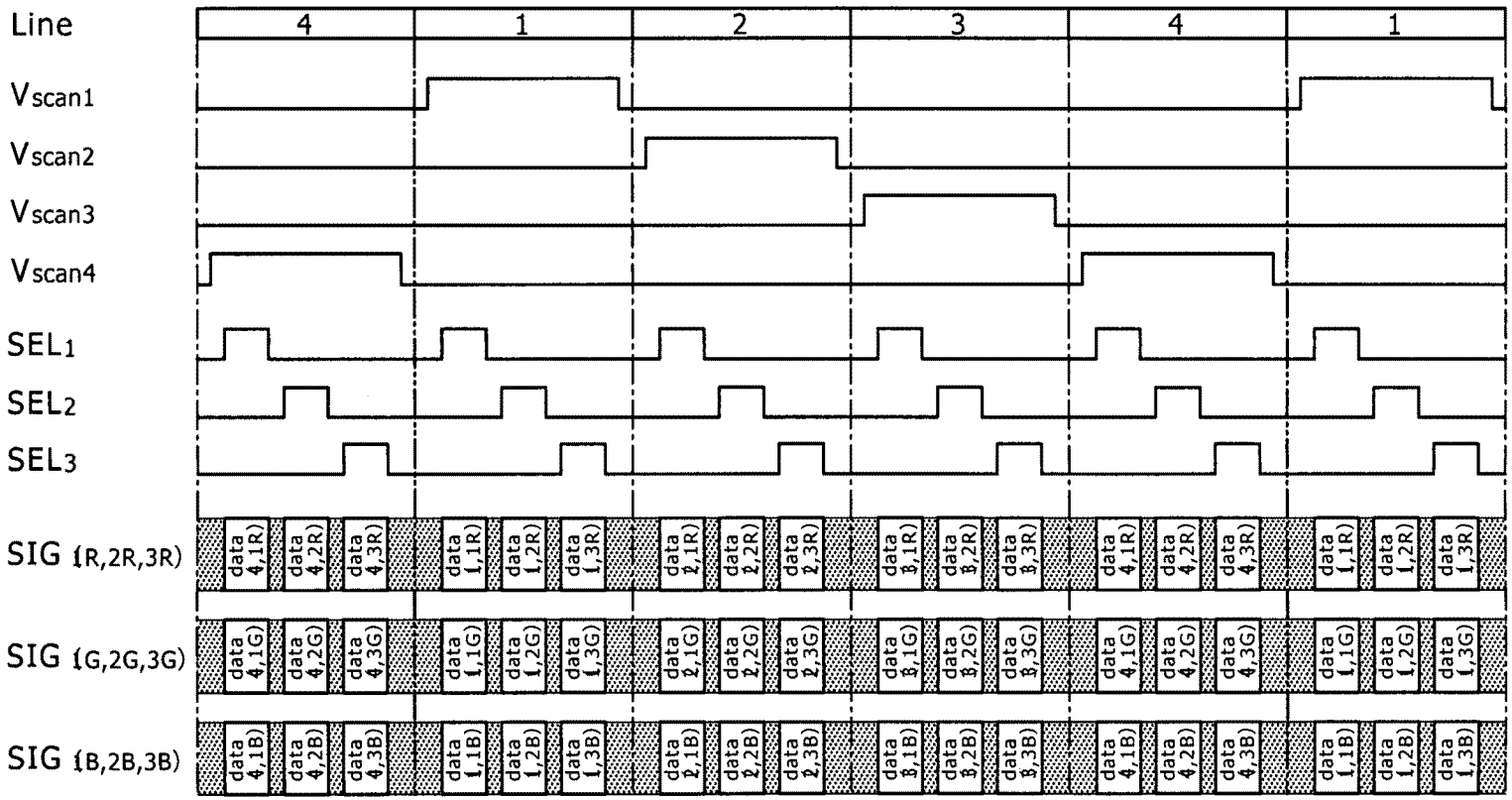
FIG. 30 is a timing chart illustrating driving timings of a known display panel which adopts the first select method and includes pixels each formed from RGB subpixels.

A configuration of a display panel which adopts the first select method and uses pixels each formed from subpixels of RGB is shown in FIG. 29, and operation of the display panel is illustrated in a flow chart of FIG. 30. Further, operation of a display panel which adopts the first select method and uses pixels for a single color is illustrated in a flow chart of FIG. 31. Also in the case of the select method, the time division number x is x=3 corresponding to the three subpixels of RGB. However, the time division number is not limited to x=3.

Figure 31:
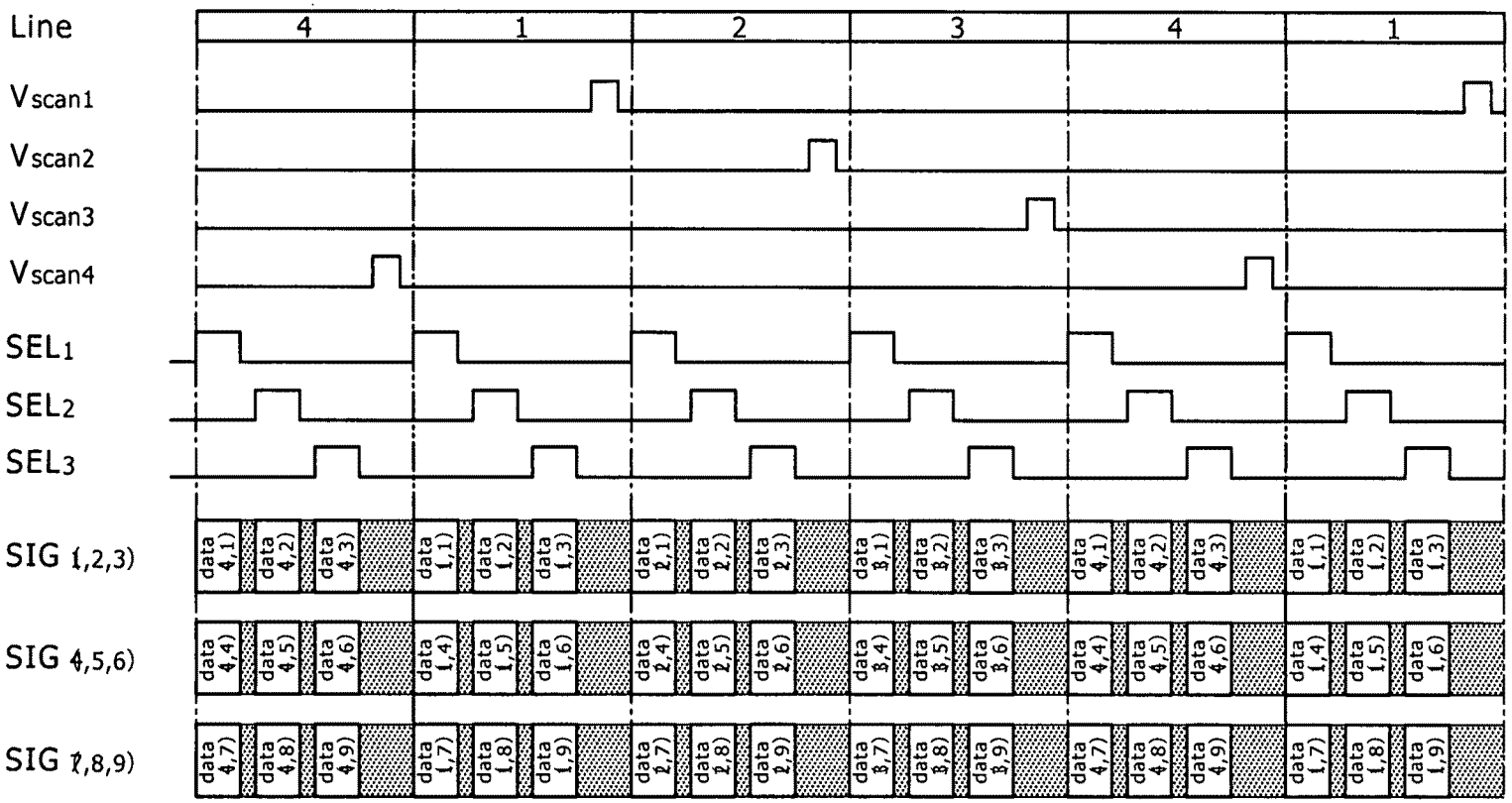
FIG. 31 is a timing chart illustrating driving timings of a known display panel which adopts the first select method and includes pixels for single color display.

In the timing charts of FIGS. 30 and 31, the driving timings illustrated are different from each other in the following point. In particular, in the former timing chart, after a pixel row is selected, display signals data are written time-divisionally. In contrast, in the latter timing chart, after display signals data are written time-divisionally, a pixel row is selected and the signals are written into the pixels of the selected pixel row. In both cases, the selection signals $SEL_1$, $SEL_2$ and $SEL_3$ are selected in order for the subpixels of RGB, and consequently, a periodical luminance difference appears in the colors of R, G and B.

A particular embodiment for implementing a display apparatus which displays an image of high picture quality superior in color reproducibility by solving such subjects of the selector driving methods, that is, by reducing a luminance difference or a displacement in luminance balance arising from the selection order of the selector circuit, is described below as a second embodiment of the present invention.

<4. Second Embodiment>

In the second embodiment of the present invention, in order to reduce a luminance difference and/or a displacement in luminance balance arising from the selection order, that is, from the division order or distribution order, of the selector circuits, the selection order of the selector circuits is changed, for example, reversed, in a fixed cycle. Here, the fixed cycle is a frame cycle, a line cycle or the like. By changing the selection order of the selector circuits in a fixed cycle, although a periodical luminance difference appears, such luminance difference is uniformized and a luminance difference or a displacement in luminance balance arising from the selection order of the selector circuit can be reduced. Consequently, the display apparatus achieves display of an image of high picture quality and superiority in color reproducibility. In the following, particular working examples of the second embodiment are described.

[4-1. Working Example 1]

Figure 32:
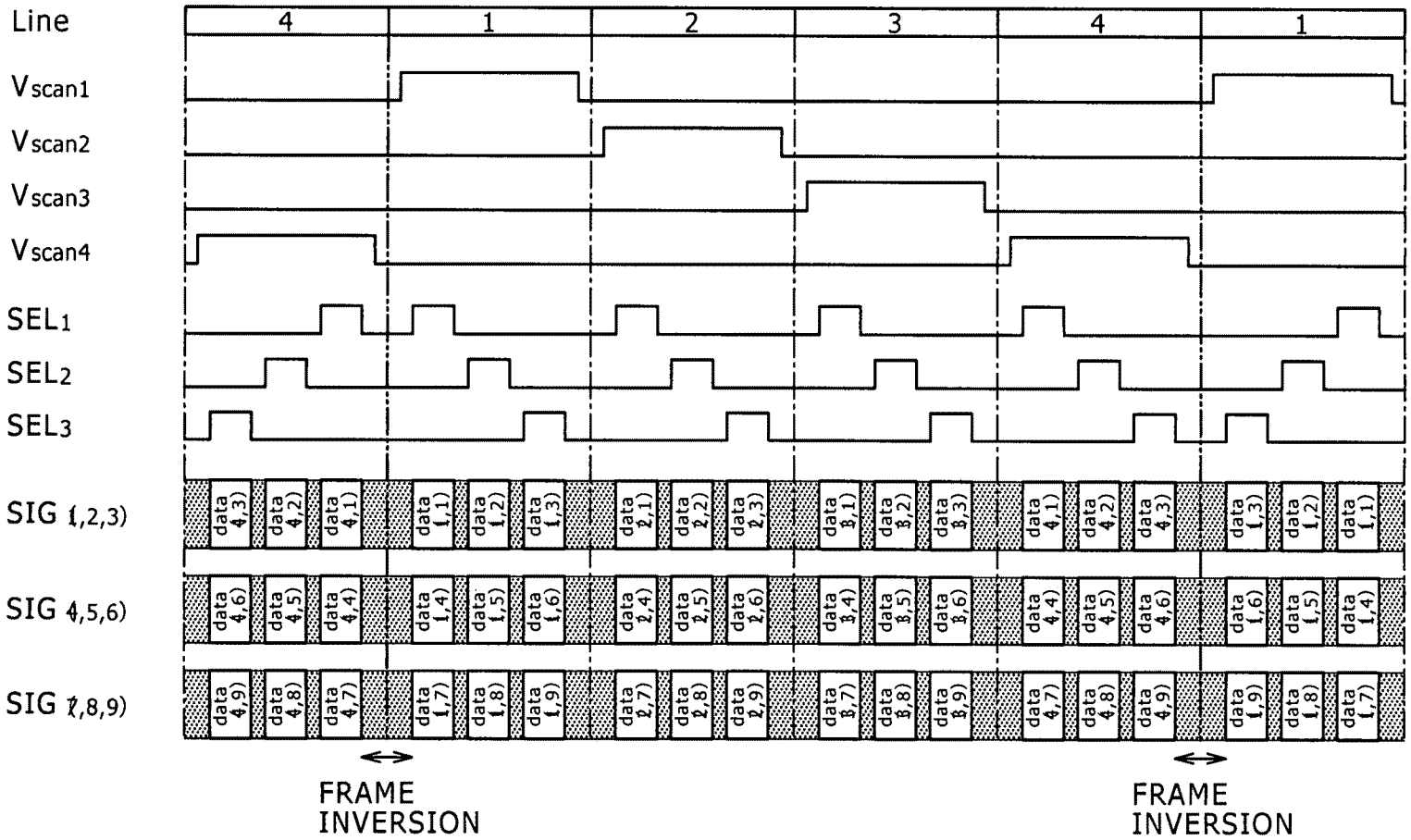
FIG. 32 is a block diagram showing a configuration of a display panel according to the working example 1 which adopts the second select method and includes pixels each formed from RGB subpixels.

FIG. 32 is a timing chart illustrating driving timings according to a working example 1 of a display panel which adopts the second select method and uses pixels for a single color. The display panel has a configuration same as that described hereinabove with reference to FIG. 25.

The driving method according to the working example 1 adopts a configuration wherein the selection order or distribution order of the selector circuits 65, 66, . . . is changed, for example, reversed, with reference to a one-frame unit or one-frame cycle in such a manner that, within a certain frame, the selection order is $$SEL_1 \rightarrow SEL_2 \rightarrow SEL_3$$

but within the next frame, the selection order is $$SEL_3 \rightarrow SEL_2 \rightarrow SEL_1$$

By reversing the selection order or distribution order of the selector circuits 65, 66, . . . in a unit of one frame in this manner, the luminance difference arising from the selection order of the selector circuits 65, 66, . . . is averaged in a unit of two frames. Accordingly, the luminance difference arising from the selection order of the selector circuits 65, 66, . . . and actually visually observed can be reduced.

Figure 33A:
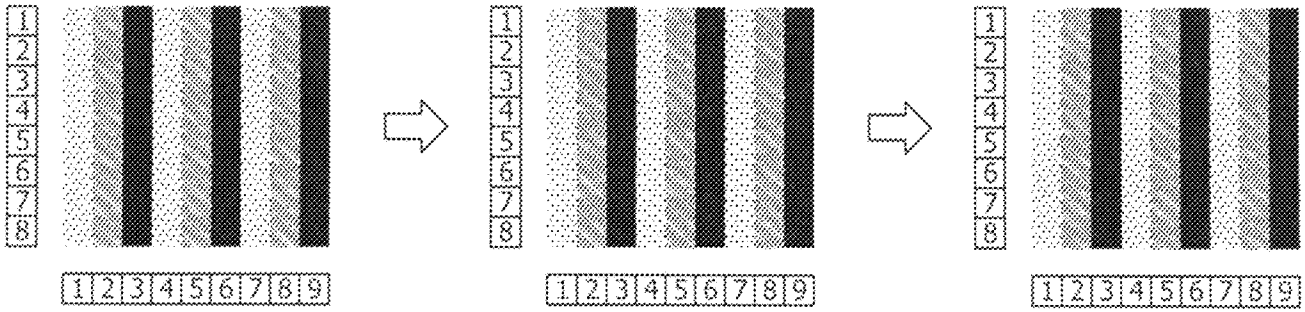
FIGS. 33A to 33C are schematic views illustrating working effects of working examples of a second embodiment of the present invention.
Figure 33B:
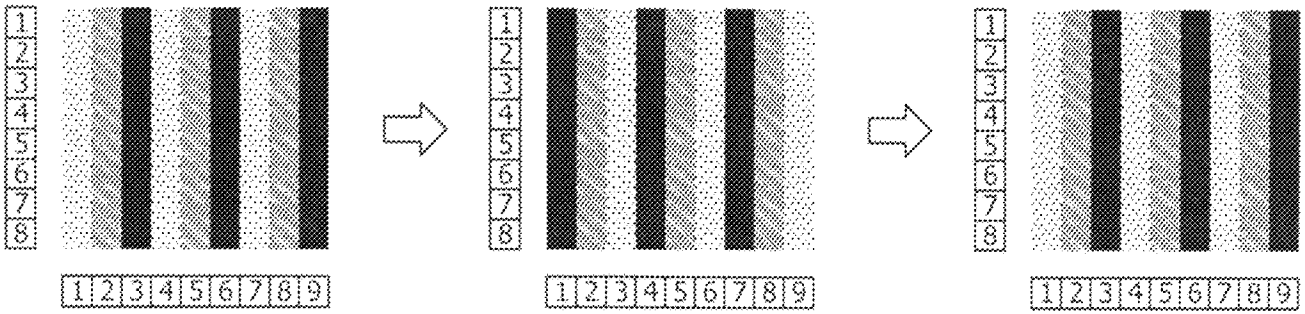
Figure 33C:
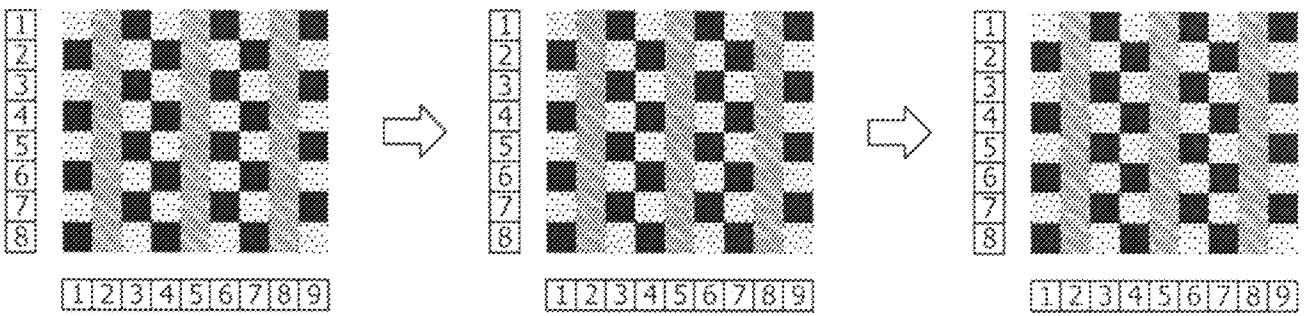

This is described more particularly with reference to FIGS. 33A to 33C. Here, a case in which light of a higher luminance is emitted from a pixel having a lower number in order. In the case of the known example, a periodical luminance difference appears in a horizontal direction from the selection order of the selector circuits 65, 66, . . . as seen in FIG. 33A. In contrast, in the case of the working example 1, a periodical luminance difference appears in the horizontal direction on an image of one frame similarly as in the case of the conventional example as seen in FIG. 33B. However, it can be recognized that, since such luminance difference is averaged over two frames, the periodic luminance difference in the horizontal direction is reduced.

In FIGS. 33A to 33C, a figure on the left side indicates a certain frame, and a middle figure indicates a next frame and then a figure on the right side indicates a further next frame. Further, each of the numerals 1, 2, 3, . . . in the left side views represents a luminance, and 1 represents the highest luminance and 2 represents the second highest luminance while 3 represents the third highest luminance. Further, the numerals 4, 5, 6, 7, 8 and 9 represent repetitions of the luminance of the numerals 1, 2 and 3.

As described above, with the driving method according to the working example 1, since the luminance difference arising from the selection order of the selector circuits 65, 66, . . . in the second select method in the case where the pixels are for a single color can be reduced, the display apparatus can achieve display of an image of high picture quality. Further, since the selector driving method is adopted, effects provided by the selector driving method described hereinabove can be achieved. In particular, it is possible to decrease the number of input signal lines for inputting display signals supplied from the external driver IC of the display panel 70 to the signal outputting circuit 50 in FIG. 1 can be reduced. Consequently, since the number of inputs to the signal outputting circuit 50 decreases, the display apparatus can be implemented at a low cost. Further, since the pitch of the input signal lines can be reduced, the display apparatus can be implemented such that it has a high definition.

It is to be noted that, in the case where the period in which the selection order of the selector circuits 65, 66, . . . is reversed is long, there is the possibility that a luminance difference between different periods may be visually observed and may be recognized as flickers of the screen image. Accordingly, the selection order of the selector circuits 65, 66, . . . is preferably reversed in a cycle as short as possible, for example, in a cycle of one frame. However, the one-frame cycle is a preferable example, and the cycle is not limited to one frame, but even in the case where the selection order is reversed in a cycle of a unit of two or more frames, the effect of luminance difference reduction can be achieved in comparison with the alternative case in which the selection order is not reversed. However, if the period of reversal of the selection order is long, then there is another advantage that the driving system can be made simple and convenient.

While, in the description of the working example 1, the selection number of the selector circuits 65, 66, . . . , that is, the time division number x, is set to 3 as an example, the number is not limited to x=3. Even if the number is x=2 or x=4 or more, similar effects to those achieved in the case where x=3 can be achieved. This similarly applies also to the working examples described below.

[4-2. Working Example 2]

Figure 34:
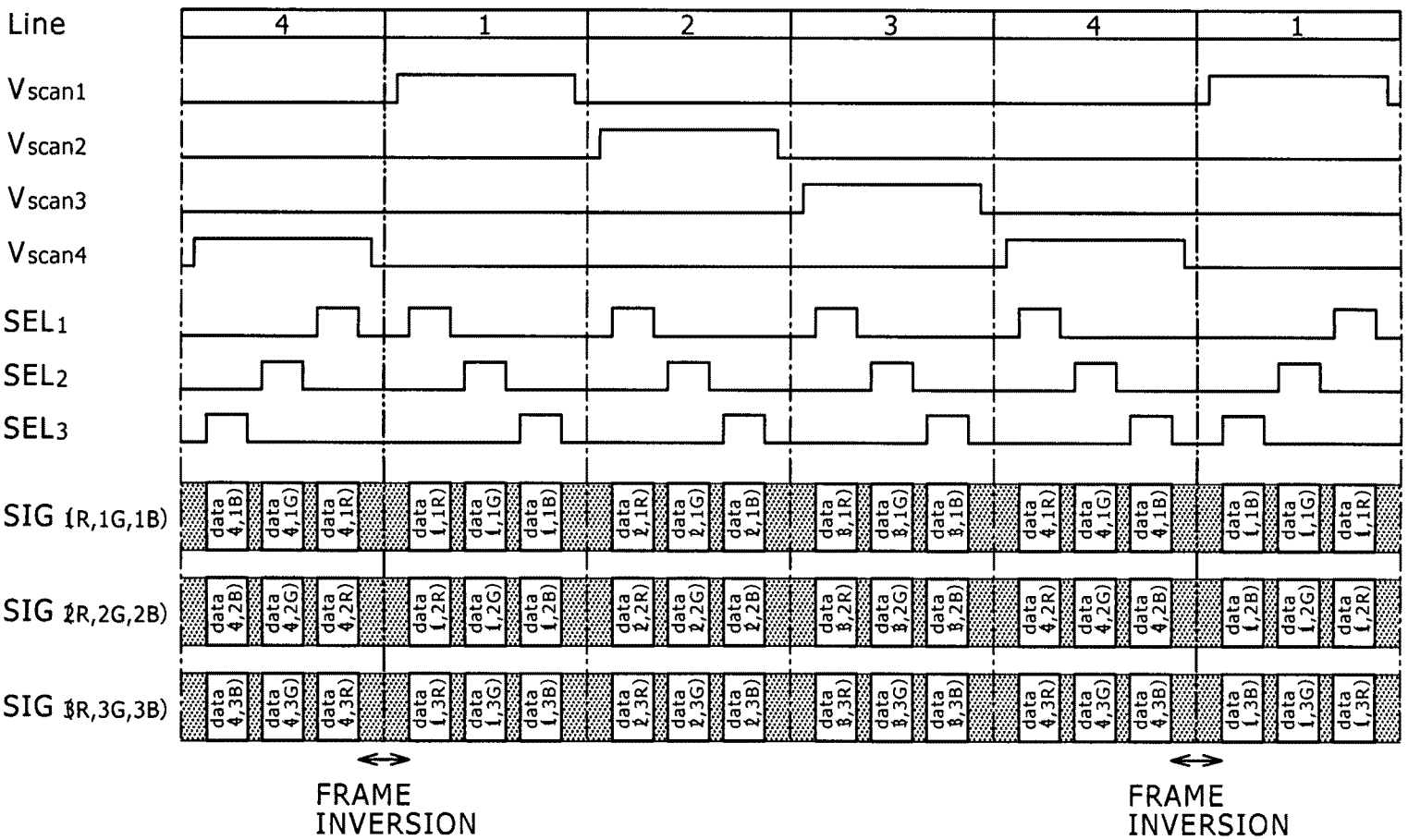
FIG. 34 is a timing chart illustrating driving timings of a display panel according to a working example 2 of the second embodiment which adopts the second select method and includes pixels each formed from RGB subpixels.

FIG. 34 is a timing chart illustrating driving timings according to a working example 2 in the case where the second select method is adopted and each pixel is composed of subpixels of RGB. The display panel has a configuration similar to that described hereinabove with reference to FIG. 27.

In the second select method in the case where a pixel is composed of subpixels of RGB, the selection signals $SEL_1$, $SEL_2$ and $SEL_3$ select subpixels of R, subpixels of G and subpixels of B, respectively. Therefore, in the driving method according to the working example 2, a configuration for reversing the selection order of the selector circuits 65, 66, . . . for each frame is adopted similarly as in the case of the working example 1. Consequently, the displacement in luminance balance among RGB can be reduced.

As described above, with the driving method according to the working example 2, since the displacement in luminance balance among RGB can be reduced in the second select method wherein a pixel is composed of subpixels of RGB, the image display apparatus can implement accurate color reproduction. Further, since the selector driving method is adopted, working effects similar to those in the working example 1 can be anticipated.

[4-3. Working Example 3]

Figure 35:
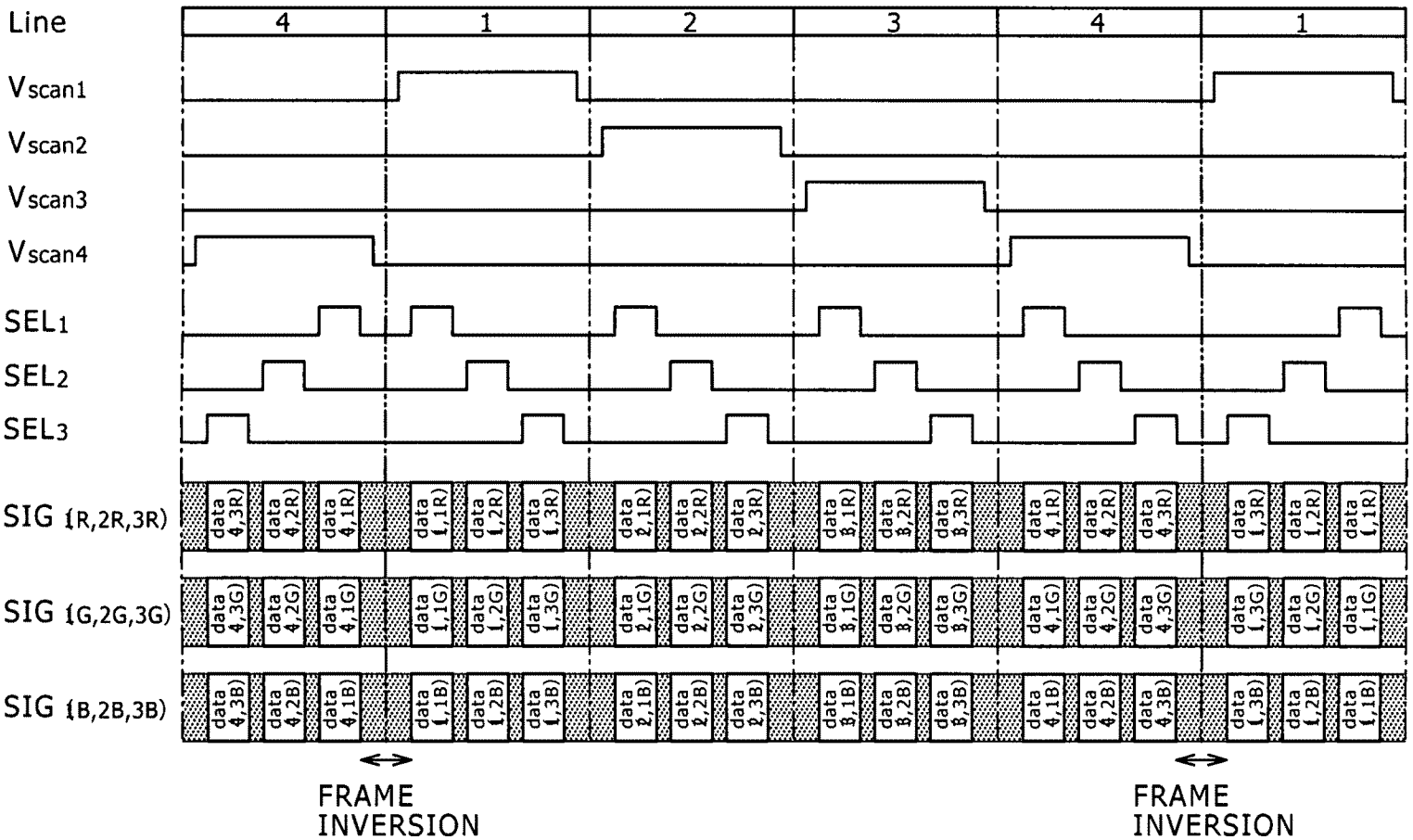
FIG. 35 is a timing chart illustrating driving timings of a display panel according to a working example 3 of the second embodiment which adopts the first select method and includes pixels each formed from RGB subpixels.

FIG. 35 is a timing chart illustrating driving timings according to the working example 3 in the case in which the first select method is adopted and a pixel is composed of subpixels of RGB. The display panel has a configuration same as that of FIG. 29.

In the first select method, the selection signals $SEL_1$, $SEL_2$ and $SEL_3$ are selected in order for the subpixels of RGB, respectively. Therefore, in the driving method according to the working example 3, a configuration wherein the selection order of the selection signals $SEL_1$, $SEL_2$ and $SEL_3$ is reversed for each frame similarly as in the case of the working example 1 is adopted. Consequently, a periodical luminance difference arising from the selection order of the selection signals $SEL_1$, $SEL_2$ and $SEL_3$ can be reduced.

As described above, with the driving method according to the working example 3, since the luminance difference arising from the selection order of the selection signals $SEL_1$, $SEL_2$ and $SEL_3$ in the first select method in the case where a pixel is composed of subpixels of RGB can be reduced, the display apparatus can achieve a display image of high picture quality. Further, since the selector driving method is adopted, working effects similar to those in the working example 1 can be anticipated.

In the known example of the second select method in the case where a pixel is composed of subpixels of RGB, the luminance difference is sometimes less likely to be visually confirmed since it is a difference in luminance value among RGB. In contrast, in the known example of the first select method in the case where a pixel is composed of subpixels of RGB, a periodical luminance difference appears with subpixels of each of the RGB colors and therefore is liable to be visually observed. Accordingly, by carrying out the driving method according to the working example 3, the effect that the luminance difference can be reduced is enhanced.

Further, in the working example, 3, since the selection signals $SEL_1$, $SEL_2$ and $SEL_3$ select subpixels of RGB, respectively, it is considered that the luminance difference is less likely to be visually observed. For example, in the case where the time division number is any other than multiples of 3, for example, in the case where the time division number is 4 and four selection signals $SEL_1$, $SEL_2$, $SEL_3$ and $SEL_4$ are used, according to the known example, a periodical luminance difference appears with each of the RGB colors because the colors of RGB corresponding to the selection signals $SEL_1$, $SEL_2$, $SEL_3$ and $SEL_4$ change periodically. Accordingly, by carrying out the driving method according to the working example 3, the effect that the luminance difference can be reduced is enhanced.

Further, even in the case where the time division number is 3, if the time division number is different from 3 such as 6 or 9, for example, if the time division number is 6 and six selection signals $SEL_1$, $SEL_2$, $SEL_3$, $SEL_4$, $SEL_5$ and $SEL_6$ are used, then each of the selection signals $SEL_1$, $SEL_2$, $SEL_3$, $SEL_4$, $SEL_5$ and $SEL_6$ is allocated to one of the RGB colors. However, since each of the RGB colors has a luminance difference which has a periodicity by two cycles, the luminance difference becomes liable to be visually observed. Accordingly, by carrying out the driving method according to the working example 3, the effect that the luminance difference can be reduced is enhanced.

[4-4. Working Example 4]

Figure 36:
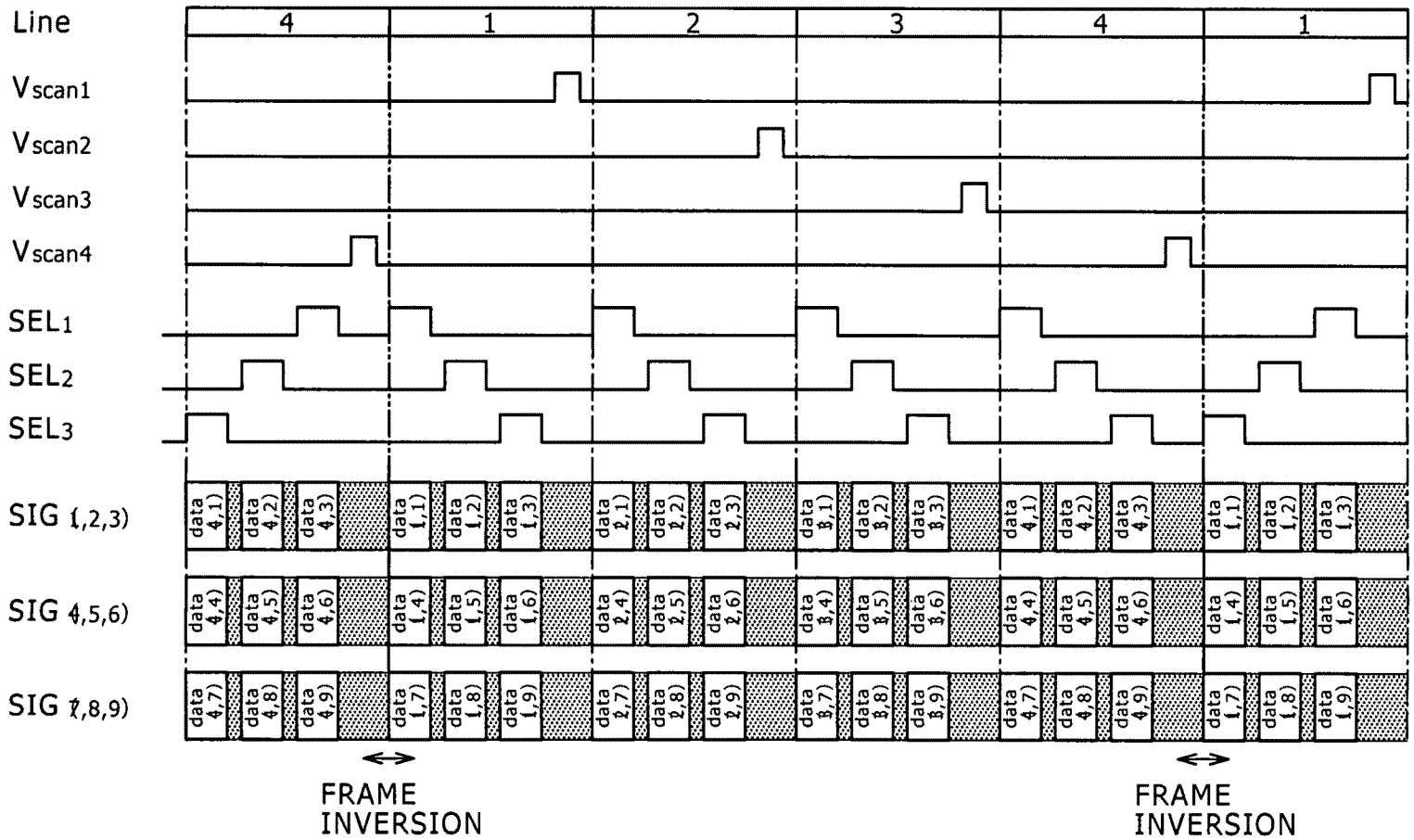
FIGS. 36, 37, 38, 39 and 40 are timing charts illustrating driving timings of display panels according to working examples 4, 5, 6, 7 and 8 of the second embodiment which adopt the first select method and includes pixels for single color display, respectively.

FIG. 36 is a timing chart illustrating driving timings according to a working example 4 in the case in which the first select method is adopted and a pixel is for a single color. The display panel has a configuration basically same as that of FIG. 29 although it is different regarding whether a pixel is for a single color or is composed of subpixels for RGB.

As apparent from comparison between the timing charts of FIGS. 32 and 36, the working example 4 is different from the working example 1, in which a pixel is for a single color similarly, in the phase relationship of the selection signals $SEL_1$ to $SEL_3$ and the vertical scanning signals $V_{scan1}$ to $V_{scan4}$. In this manner, in all working examples, the detailed phase relationship of signals need not necessarily be same as those in the present working example. In particular, in the case where a luminance difference appears depending upon the selection order of the selector circuits, the present embodiment can be applied even if the phase relationship of the selection signals $SEL_1$ to $SEL_3$ and the vertical scanning signals $V_{scan1}$ to $V_{scan4}$ is different.

In the working examples described above, the number of scanning lines of the display apparatus is four, and also the number of lines for timing is four. However, in an ordinary display apparatus, the number of lines for timing is greater than the number of scanning lines. In other words, generally a vertical blanking period is provided. Also in such a case, a similar idea can be applied.

Further, in the working example 1, after a pixel row is selected with the vertical scanning signals $V_{scan1}$ to $V_{scan4}$ writing of signals is carried out time-divisionally into signal lines by selective driving with the selection signals $SEL_1$ to $SEL_3$. In other words, after writing of signals is carried out time-divisionally into signal lines by selective driving with the selection signals $SEL_1$ to $SEL_3$, a pixel row is selected with the vertical scanning signals $V_{scan1}$ to $V_{scan4}$ and writing of signals into the pixels of the pixel row is carried out.

In this manner, in the case of the driving method wherein writing of signals into pixels of a selected pixel row after writing of signals is carried out time-divisionally into the signal lines, particularly a luminance difference is liable to appear because a time difference occurs till writing of the signals by the selector circuits. Accordingly, by carrying out the driving method according to any one of the working examples 1 to 3 in the present driving method, the effect that the luminance difference can be reduced is further enhanced.

[4-5. Working Example 5]

Figure 37:
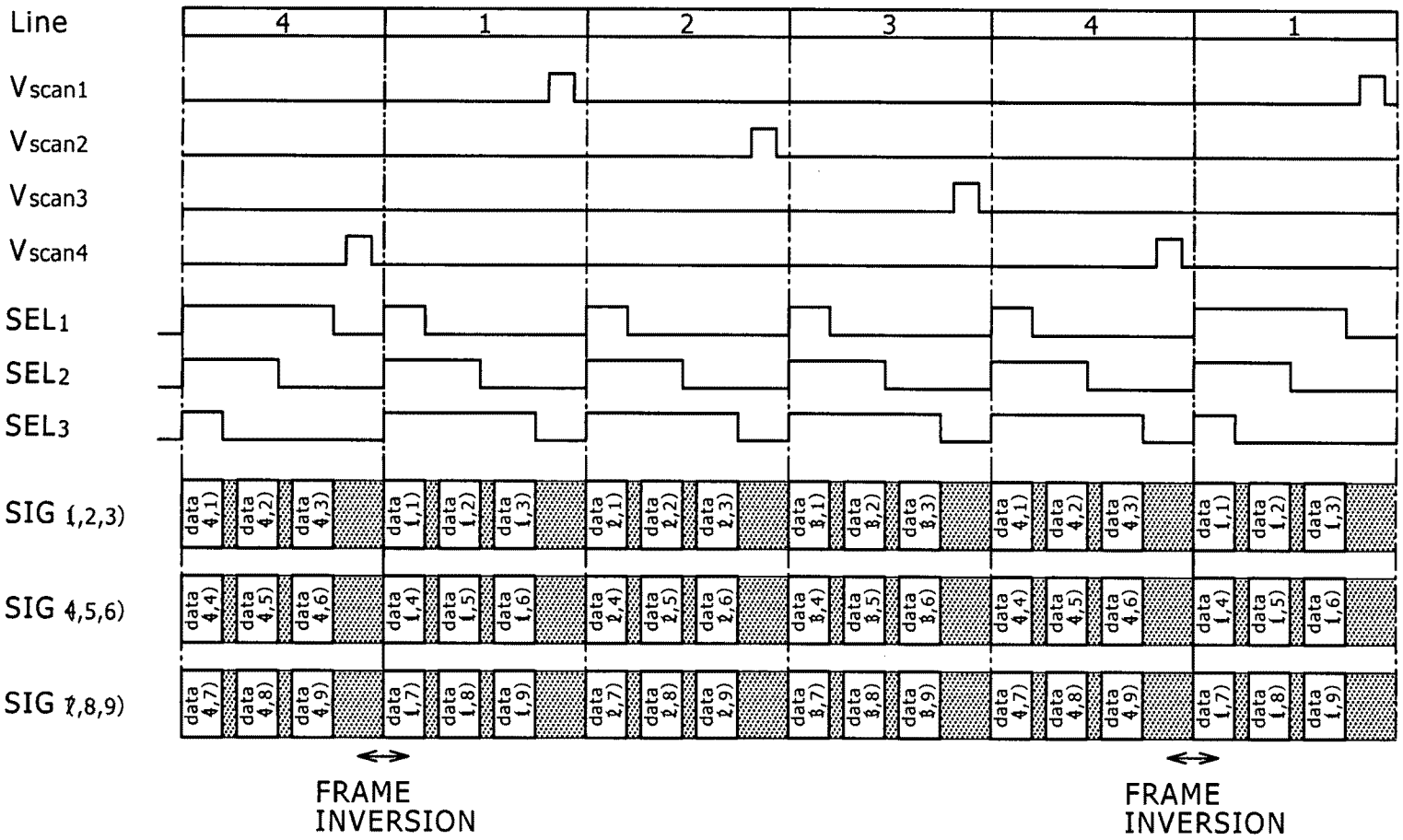

FIG. 37 is a timing chart illustrating driving timings according to a working example 5 in the case in which the first select method is adopted and a pixel is for a single color. The display panel has a configuration basically same as that of FIG. 29 although it is different whether a pixel is for a single color or is composed of subpixels for RGB.

As apparent from comparison between the timing charges of FIGS. 32 and 37, the working example 5 is different from the working example 1, in which a pixel is for a single color similarly, in a manner in which the selection signals $SEL_1$ to $SEL_3$ are placed into an active state, that is, in a manner of selection of signals by the selector circuits. In particular, in the case of the working example 1, the selection signals $SEL_1$, $SEL_2$ and $SEL_3$ are placed into an active state in the order. In contrast, in the case of the working example 5, when the selection signal $SEL_1$ is placed into an active state, the selection signals $SEL_2$ and $SEL_3$ are placed into an active state simultaneously. Thereafter, the selection signals $SEL_1$, $SEL_2$ and $SEL_3$ are placed into an inactive state in this order.

In particular, when the selection signal $SEL_1$ is in an active state, also the selection signals $SEL_2$ and $SEL_3$ are in an active state; when the selection signal $SEL_2$ is in an active state, the selection signal $SEL_1$ is in an inactive state and the selection signal $SEL_3$ is in an active state; and when the selection signal $SEL_3$ is in an active state, the selection signals $SEL_1$ and $SEL_2$ are in an inactive state and consequently only the selection signal $SEL_3$ is in an active state. In this instance, since signals inputted to the selector circuits finally are time-series signals, signals corresponding to them are written with the selection signals $SEL_1$, $SEL_2$ and $SEL_3$.

In this manner, although several cases are available with regard to the manner of selection of signals by the selector circuits, in the case where a luminance difference appears depending upon the selection order of the selector circuits, it is possible to apply the driving methods according to the working examples 1 to 3.

[4-6. Working Example 6]

Figure 38:
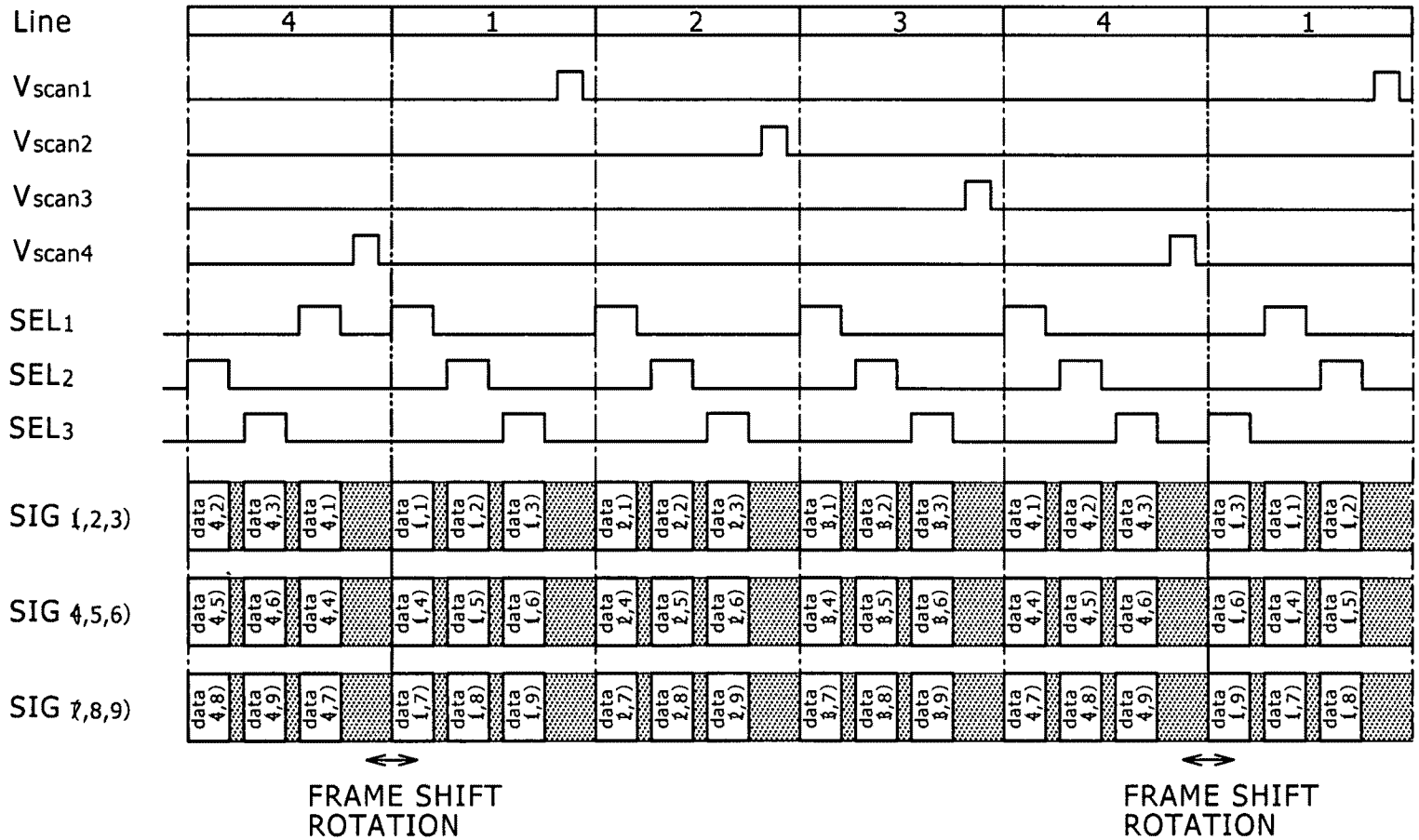

FIG. 38 is a timing chart illustrating driving timings according to a working example 6 in the case in which the first select method is adopted and a pixel is for a single color. The display panel has a configuration basically same as that of FIG. 29 although it is different whether a pixel is for a single color or is composed of subpixels for RGB.

In the working examples 1 to 5, the selection order of the selector circuits is reversed for each frame. In particular, the selection order of the selector circuits 61, 62, . . . is reversed in a unit of one frame, that is, in a cycle of one frame, in such a manner that, within a certain frame, the selection order is $$SEL_1 \rightarrow SEL_2 \rightarrow SEL_3$$

but within the next frame, the selection order is $$SEL_3 \rightarrow SEL_2 \rightarrow SEL_1$$

In contrast, in the working example 6, the selection order of the selector circuits 61, 62, . . . is shifted to rotate for each frame in such a manner that, within a certain frame, the selection order is $$SEL_1 \rightarrow SEL_2 \rightarrow SEL_3$$

but within the next frame, the selection order is $$SEL_2 \rightarrow SEL_3 \rightarrow SEL_1$$

but then within the next frame, the selection order is $$SEL_3 \rightarrow SEL_1 \rightarrow SEL_2$$

In the case of the driving method according to the working examples 1 to 5, since the selection order is reversed for each frame, the luminance difference is averaged in two frames. In contrast, in the case of the driving method of the working example 6, since the selection order is shifted for each frame to rotate, the luminance difference is averaged over a plurality of frames, in the present example, over three frames.

In this manner, with the driving method according to the working example 6, although the frame cycle for averaging becomes longer, in other words, although the frame frequency becomes higher, since the selection signals $SEL_1$, $SEL_2$ and $SEL_3$ are generated for all lines, there is an advantage that the luminance difference can be averaged with certainty.

[4-7. Working Example 7]

Figure 39:
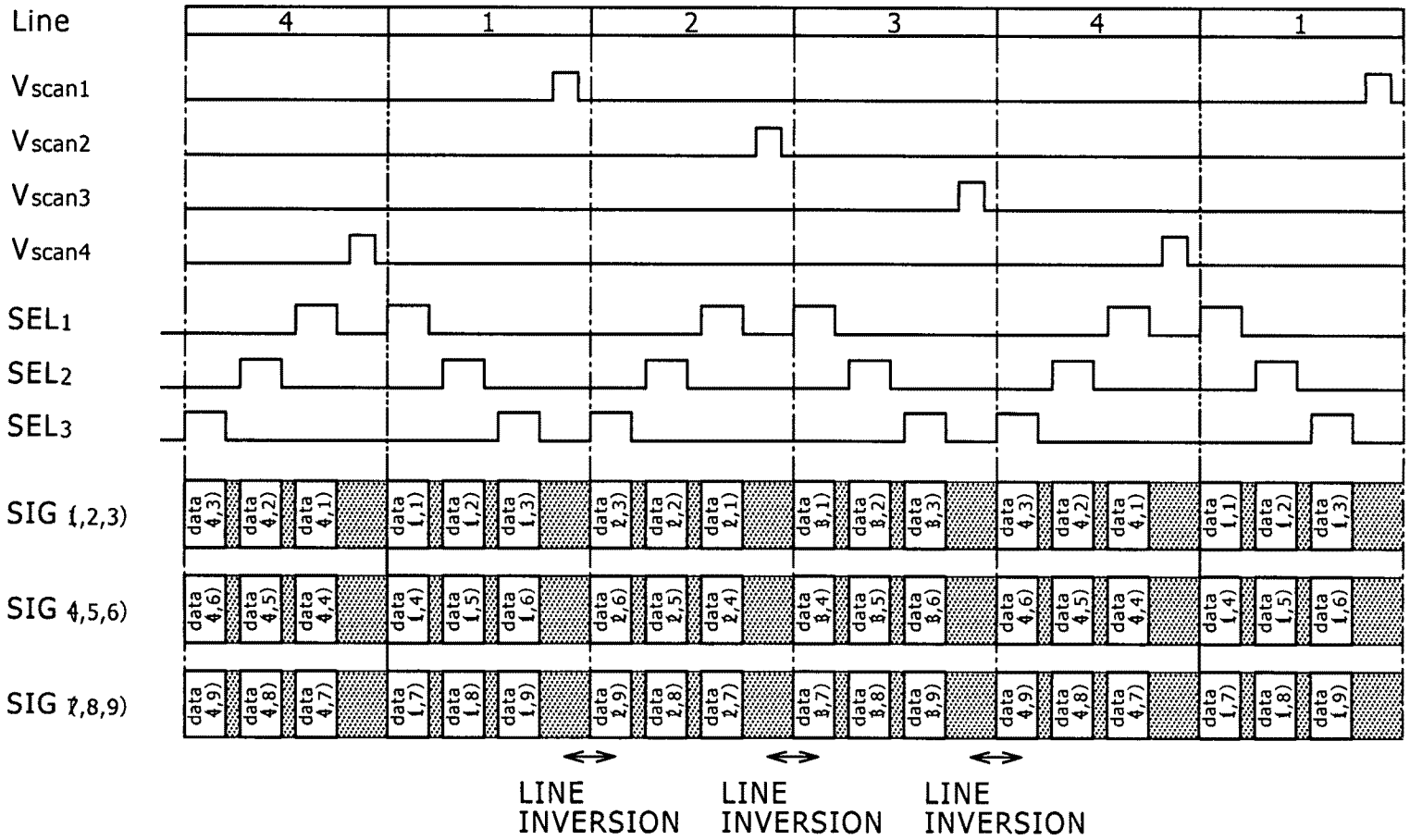

FIG. 39 is a timing chart illustrating driving timings according to a working example 7 in the case in which the first select method is adopted and a pixel is composed of subpixels of RGB. The display panel has a configuration basically same as that of FIG. 29 although it is different whether a pixel is for a single color or is composed of subpixels for RGB.

In the working examples 1 to 5, the selection order of the selector circuit is reversed for each frame, and in the working example 6, the selection order of the selector circuits is shifted for each frame to rotate. In contrast, in the working example 7, a configuration is adopted wherein the selection order of the selector circuits 61, 62, . . . is reversed for each line, that is, for each one horizontal period.

According to the driving method of the working example 7, since the selection order of the selector circuits is reversed for each line, the order of a bright pixel and a dark pixel is changed over for each one horizontal line as seen in FIG. 33C. Therefore, the spatial periodicity of the luminance difference can be diffused. Then, by diffusing the spatial periodicity of the luminance difference, the luminance difference can be made less likely to be visually observed. Consequently, since the luminance difference arising from the selection order of the selector circuits can be reduced, the display apparatus can achieve a display image of high picture quality. Further, since the selector deriving method is adopted, similar working effects to those achieved by the working example 1 can be achieved.

Also in the case of the working example 7, even if the time division number x is 2 or 4 or more, similar effects can be achieved similarly as in the case where the select order of the selector circuits is reversed for each frame. Further, although reversal of the select order of the selector circuit is carried out preferably for each cycle of one line, the effect of reduction of the luminance difference arising from the selection order of the selector circuits can be obtained even if such reversal as described above is carried out for each cycle of a plurality of lines.

In an organic EL display apparatus, different from a liquid crystal display apparatus of ac reversal driving, the display luminance is always directed in a single direction with respect to an input signal or display data, and therefore, it is particularly easy to achieve the effect of reducing the luminance difference arising from the select order of the selector circuit. Further, as regards the phase of the vertical scanning signals $V_{scan1}$ to $V_{scan4}$ or the selection signals $SEL_1$ to $SEL_3$, a plurality of selection methods are available as in the working example 1, 4, 5 and so forth. Further, in the case of RGB display, a plurality of selection methods are available as in the working examples 2 and 3.

[4-8. Working Example 8]

Figure 40:
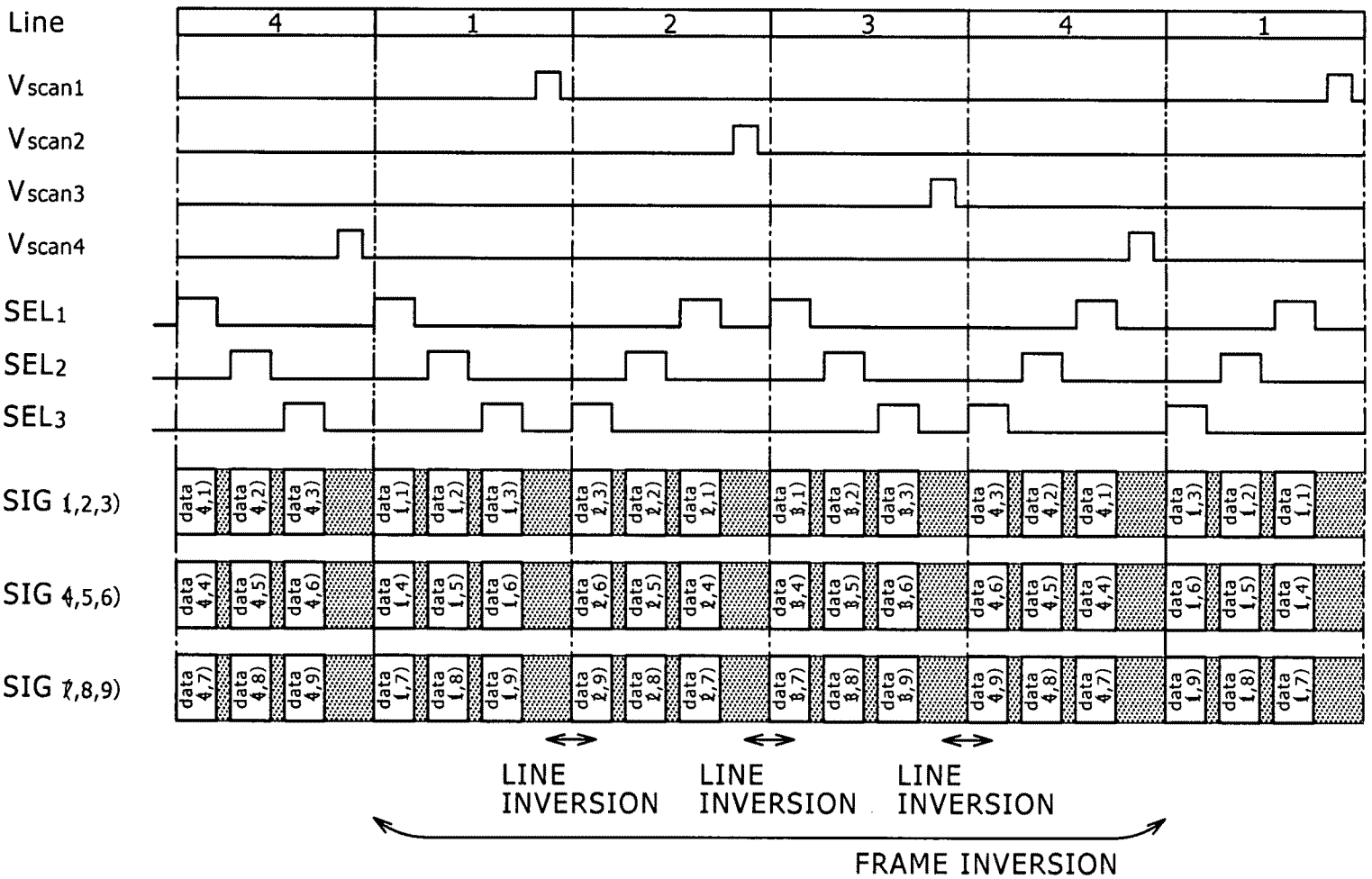

FIG. 40 is a timing chart illustrating driving timings according to a working example 8 in the case in which the first select method is adopted and a pixel is composed of subpixels of RGB. The display panel has a configuration basically same as that of FIG. 29 although it is different whether a pixel is for a single color or is composed of subpixels for RGB.

In the working example 8, a configuration is adopted wherein the driving method according to the working example 4 and the driving method according to the working example 7 are combined such that the select order of the selector circuits is reversed for each frame and besides for each line. With the driving method according to the working example 8, a reduction effect of a time-average luminance difference by reversal for each frame and a spatial reduction effect of the luminance difference by reversal for each line can be achieved simultaneously as seen in FIG. 33A. Consequently, the display apparatus can display an image of high picture quality. Further, since the selector driving method is adopted, working effects similar to those achieved by the working example 1 can be achieved.

[4-9 Working Example 9]

Figure 42:
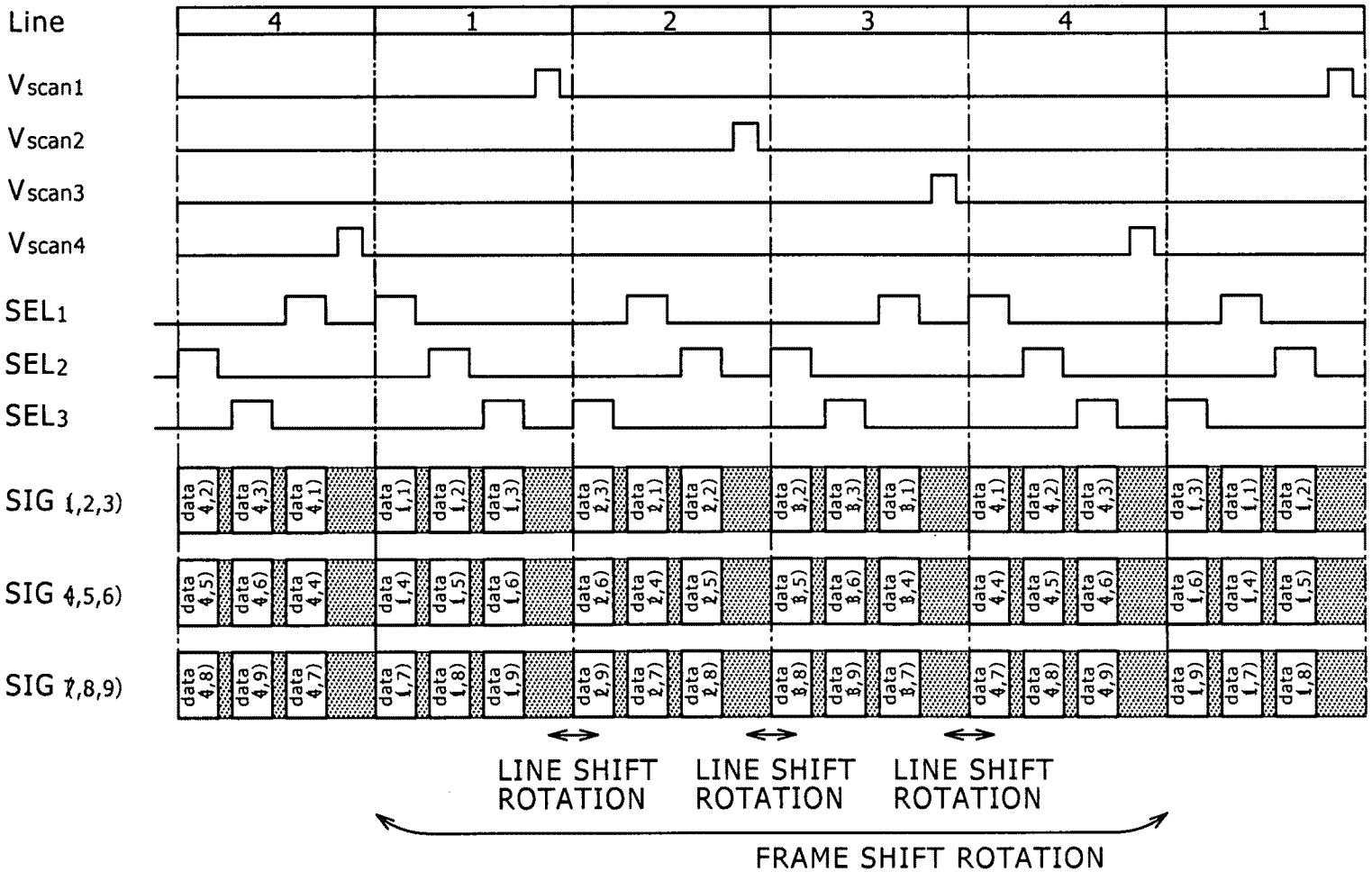
FIG. 42 is a timing chart illustrating driving timings of a display panel according to a working example 9 of the second embodiment which adopts the second select method and includes pixels for single color display.

FIG. 42 is a timing chart illustrating driving timings according to a working example 8 in the case in which the first select method is adopted and a pixel is for a single color. The display panel has a configuration basically same as that of FIG. 29 although it is different regarding whether a pixel is for a single color or is composed of subpixels for RGB.

The working example 9 adopts a configuration wherein, while it is premised on an assumption that the driving method according to the working example 7, that is, the driving method of reversing the selection order of the selector circuits for each line, is used, for example, the driving method according to the working example 6 is adopted, that is, the select order of the selector circuits is shifted to rotate. In the example illustrated in FIG. 3, the selection order of the selector circuits is shifted for each frame and for each line to rotate.

[4-10. Working Example 10]

Figure 43:
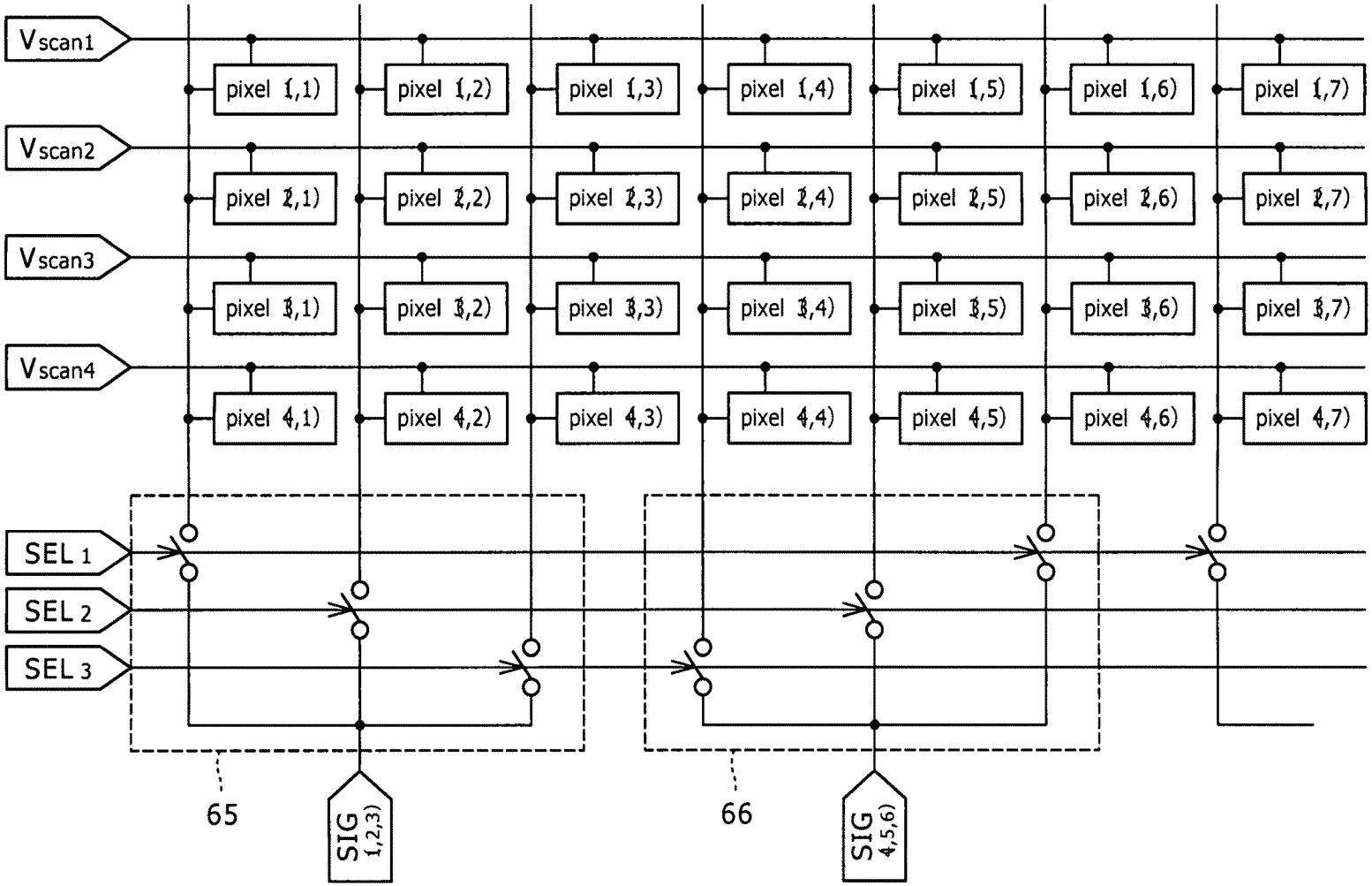
FIG. 43 is a block diagram showing another configuration of a display panel which adopts the second select method and includes pixels for single color display.
Figure 44:
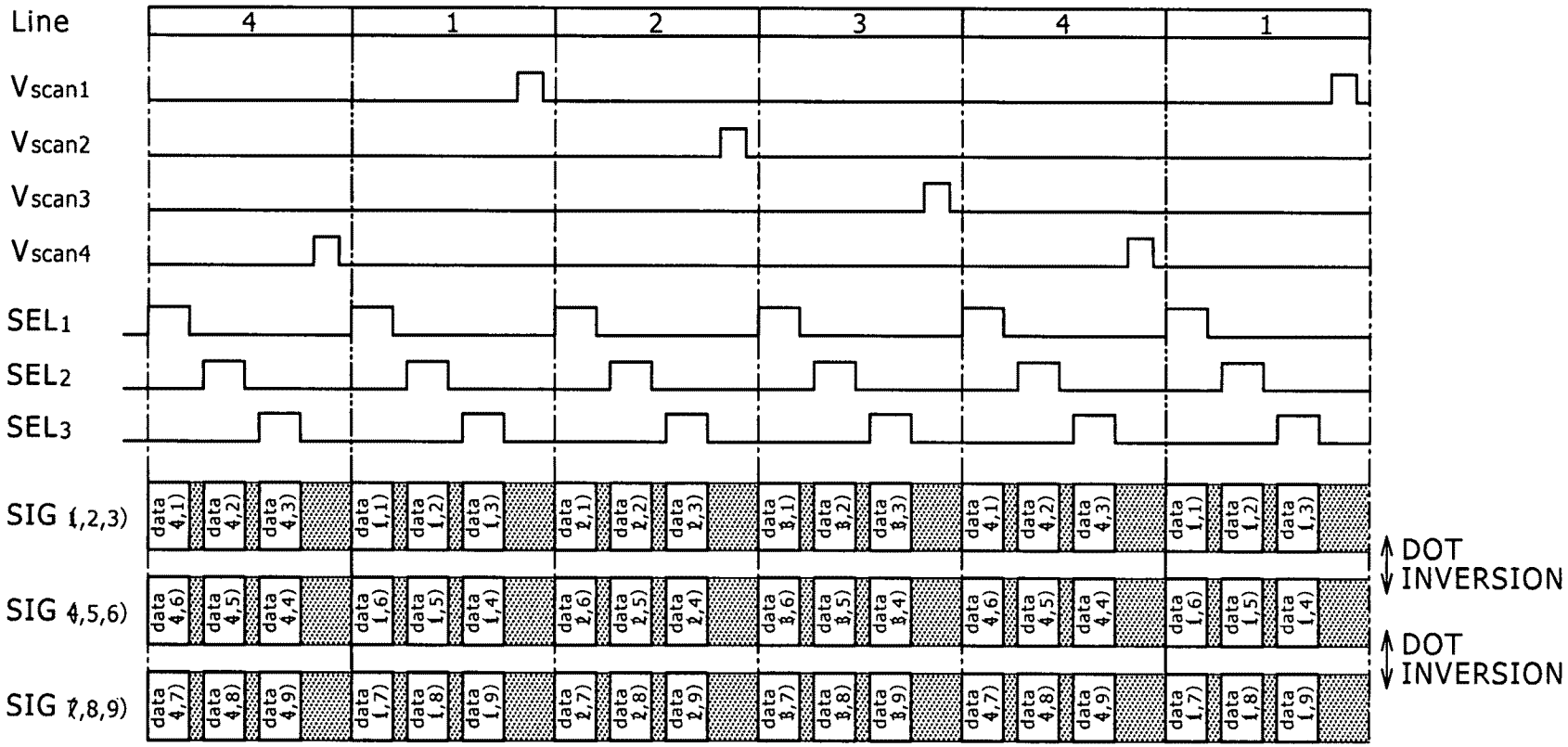
FIGS. 44 and 45 are timing charts illustrating driving timings of display panels according to working examples 10 and 11 of the second embodiment which adopt the second select method and includes pixels for single color display.

FIG. 43 is a block diagram showing another configuration of the display panel in the case in which the second select method is adopted and a pixel is for a single color. FIG. 44 illustrates driving timings according to the working example 10 in the case in which the second select method is adopted and a pixel is for a single color.

The working examples 1 to 9 adopt the configuration wherein the select order of the selector circuits is changed in a fixed frame cycle or a fixed line cycle. In contrast, the working example 10 adopts another configuration wherein the operation period cycle of the selector circuits is determined as a unit and the select order of the selector circuit is changed in a cycle of an operation period corresponding to the number of selector circuits. As an example, the select order of the selector circuits 65 and 66 which neighbor with each other is changed between the selector circuits 65 and 66. In particular, for example, the selector circuit 65 selects pixels in the order of the first pixel (x, 1)→second pixel (x, 2)→third pixel (x, 3). The selector circuit 66 selects pixels in the reverse order of the third pixel (x, 6)→second pixel (x, 5)→first pixel (x, 4).

As a circuit, the order of connection of the selection signals $SEL_1$, $SEL_2$ and $SEL_3$ to the selector circuits 65 and 66 neighboring with each other is changed between the selector circuits 65 and 66 as seen in FIG. 43 to change the selection order of the selector circuits 65 and 66. The driving method according to the working example 10 is not a driving method wherein the select order of the selector circuits 65 and 66 is changed for each frame and for each line but a driving method wherein the select order is changed for each pixel or subpixel, that is, for each dot.

Figure 41A:
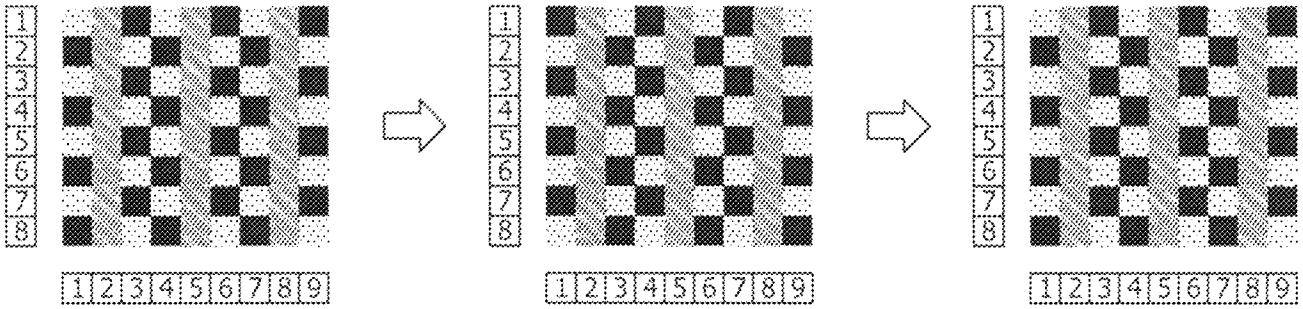
FIGS. 41A to 41C are schematic views illustrating working effects of different working examples of the second embodiment.
Figure 41B:
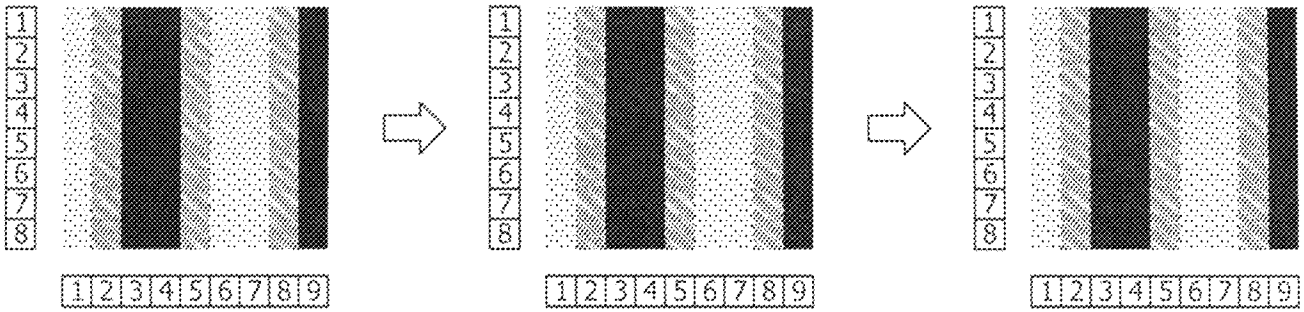
Figure 41C:
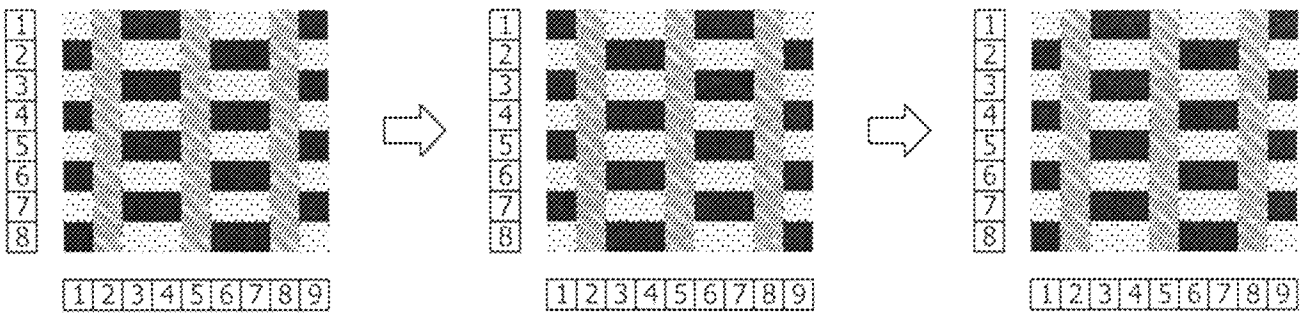

With the driving method according to the working example 10, since the luminance difference arising from the select order of the selector circuits 65 and 66 neighboring with each other in the direction of the selector circuits 65 and 66 as seen in FIG. 41B, the display apparatus can display an image of high picture quality. Further, since the selector driving method is adopted, working effects similar to those achieved by the working example 1 can be achieved.

Also in the case of the working example 10, even if the time division number x is 2 or 4 or more, similar effects can be achieved similarly as in the case where the select order of the selector circuits is reversed for each frame and/or each line. Further, although reversal of the select order of the selector circuits is carried out preferably for one selector cycle, the effect of reduction of the luminance difference arising from the selection order of the selector circuits can be obtained even if a plurality of selector cycles are used.

In an organic EL display apparatus, different from a liquid crystal display apparatus of ac reversal driving, the display luminance is always directed in a single direction with respect to an input signal or display data, and therefore, it is particularly liable to achieve the effect of reducing the luminance difference arising from the select order of the selector circuit. Further, as regards the phase of the vertical scanning signals $V_{scan1}$ to $V_{scan4}$ or the selection signals $SEL_1$ to $SEL_3$, a plurality of selection methods are available as in the working example 1, 4, 5 and so forth. Further, in the case of RGB display, a plurality of selection methods are available as in the working examples 2 and 3. Furthermore, the method of changing the selection order may be, in addition to reversal, any method by which a luminance difference arising from the selection order such as shifting and rotation is dispersed.

[4-11. Working Example 11]

Figure 45:
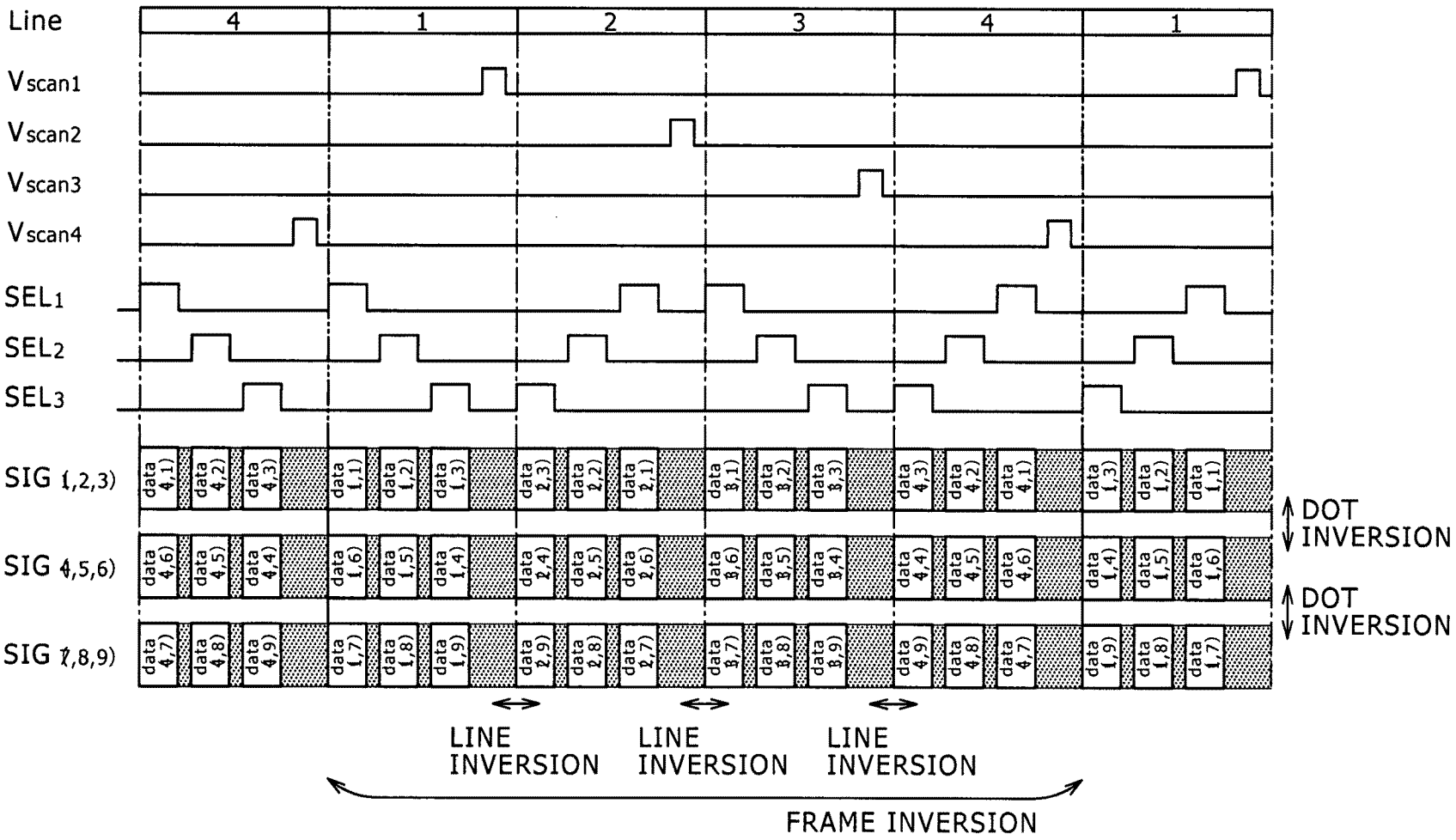

FIG. 45 is a timing chart illustrating driving timings according to a working example 10 in the case in which the second select method is adopted and a pixel is for a single color. The display panel has a configuration basically same as that of FIG. 43.

The working example 11 adopts a configuration wherein frame reversal and line reversal are added to the driving method of the working example 10, that is, to the driving method of changing the select order of the selector circuits 65 and 66 neighboring with each other between the selector circuits 65 and 66.

With the driving method according to the working example 11, a time-mean reduction effect of the luminance difference by reversal for each frame, a space-mean reduction effect of the luminance difference in the vertical direction by reversal for each line and the reduction effect of the luminance by the working example 10 can be achieved simultaneously. In other words, a time-mean reduction effect of the luminance difference, a space-mean reduction effect of the luminance difference in the vertical direction and a space-means reduction effect of the luminance difference in the horizontal direction by a change of the select order between neighboring selector circuits can be achieved.

[4-12. Working Example 12]

Figure 46:
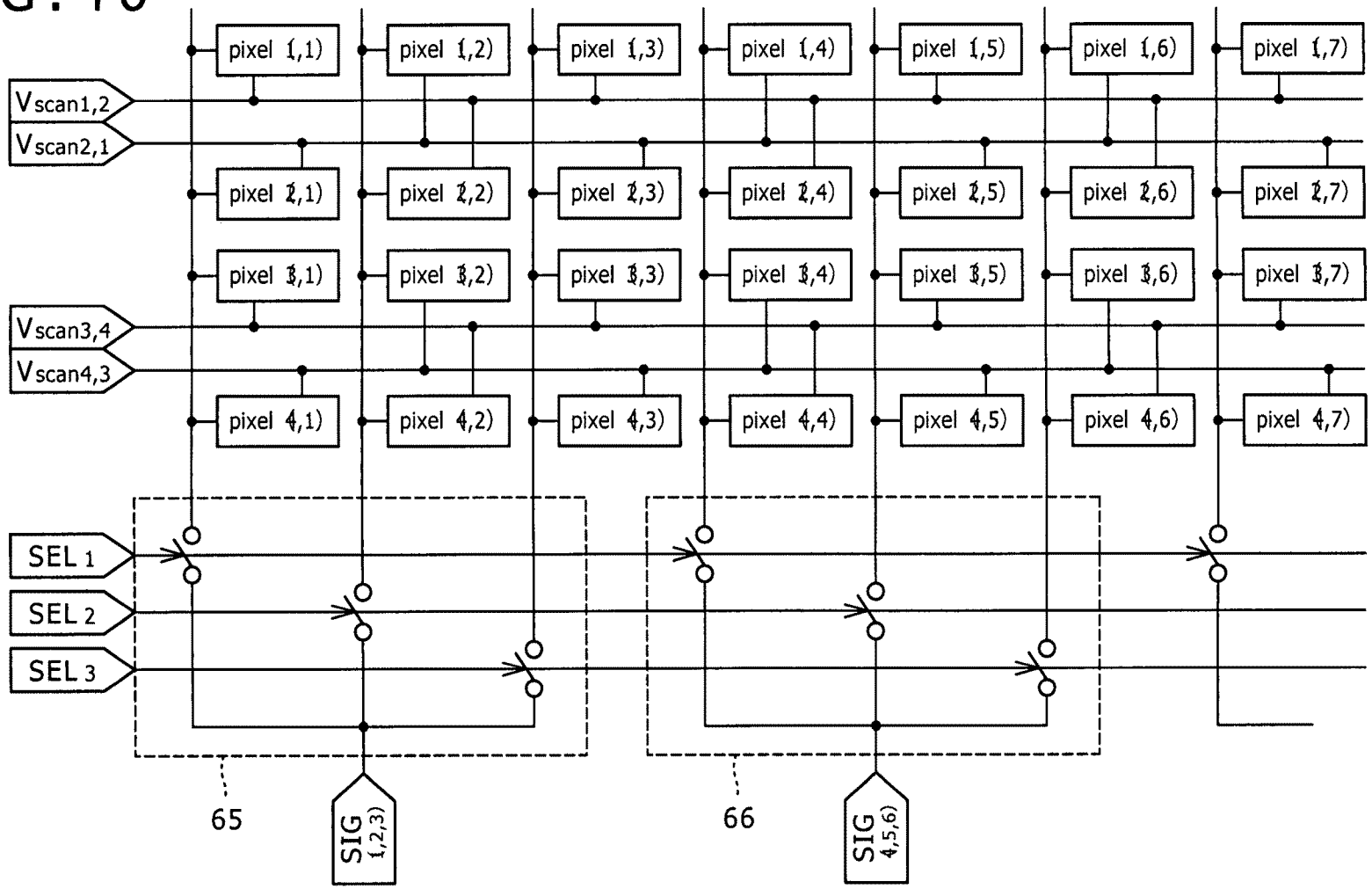
FIG. 46 is a block diagram showing a further configuration of a display panel which adopts the second select method and includes pixels for single color display.
Figure 47:
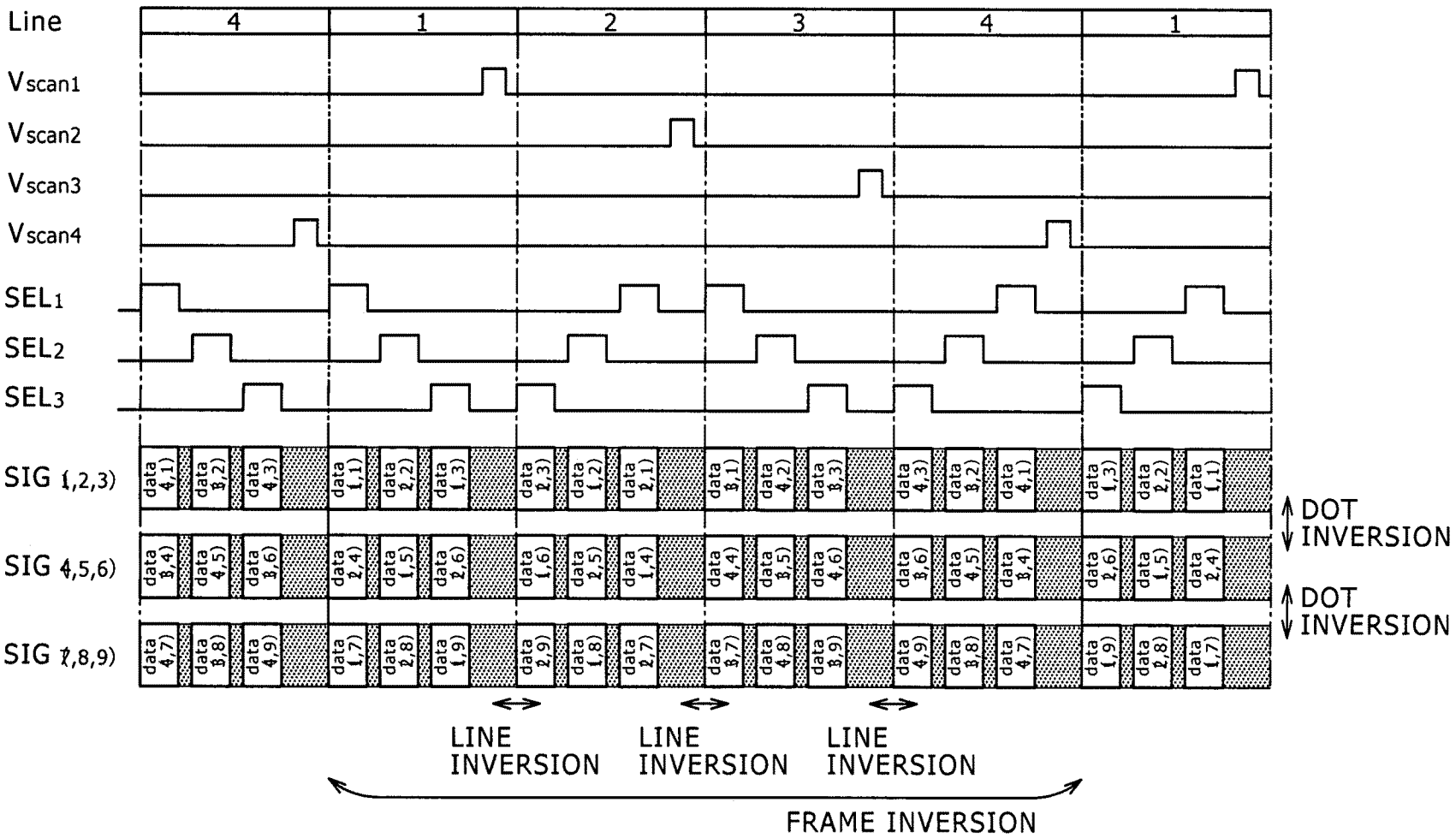
FIG. 47 is a timing chart illustrating driving timings of a display panel according to a working example 12 of the second embodiment which adopt the second select method and includes pixels for single color display.

FIG. 46 is a block diagram showing a further configuration of the display panel in the case in which the second select method is adopted and a pixel is for a single color. FIG. 47 illustrates driving timings according to the working example 12 in the case in which the second select method is adopted and a pixel is for a single color.

As apparent from FIGS. 46 and 47, the working example 12 adopts a configuration wherein a plurality of scanning lines are periodically changed with respect to pixels of a plurality of rows. Here, as an example, the number of scanning lines is two and the number of rows is two.

In this manner, also by periodically changing a plurality of scanning lines with respect to pixels of a plurality of rows, if attention is paid to pixels in a certain row, it is possible to effectively change the selection order between the selector circuits 65 and 66 neighboring with each other similarly as in the case of the working example 11. As a result, working effects similar to those in the case of the working example 11 can be achieved.

[4-13. Working Effects in the Case of Application to an Organic EL Display Apparatus]

In the foregoing description, it is premised on the assumption that, in the working examples 1 to 12, the present invention is applied to an organic EL display apparatus. However, the application of the present invention is not limited to an organic EL display apparatus, but the present invention can be applied also to various display apparatus which adopts the selector driving method such as a liquid crystal display apparatus. However, from the reason described below, it can be considered that the effect of the invention in the case where it is applied to an organic EL display apparatus is high.

First, in the case where, within one horizontal period, display signals are inputted collectively to a plurality of signal lines before they are divided or distributed time-divisionally to the signal lines, since a time difference till writing of the display signals by the selector circuits occurs, particularly a luminance difference is liable to appear.

The organic EL display apparatus to which the present invention is applied as described first adopts a configuration wherein, before the signal voltages $V_{sig}$ of the image signal are written into the signal lines, a reference voltage $V_{ofs}$ for threshold value correction is collectively written into the signal lines. Then, after the reference voltage $V_{ofs}$ is written collectively, selection is carried out successively by the selector circuits; and therefore, particularly a luminance difference is liable to appear. Accordingly, where the present invention is applied to an organic EL display apparatus, the effects of the working examples 1 to 12 are particularly liable to be achieved.

Further, in the case wherein, within one horizontal period, pixels are selected after display signals are time-divisionally divided into a plurality of signal lines in a state in which the pixels are not selected, a time difference occurs after writing of the display signals into the signal lines by the selector circuits until a scanning line is selected. Therefore, particularly a luminance difference is liable to appear.

In the organic EL display apparatus described above, as apparent from the description of the basic operation, the correction time period is determined from the selection period of a scanning line, that is, from the period of conduction of the writing transistor 23 of FIG. 2. Then, after signal voltages $V_{sig}$ of the image signal are written into the signal lines by the selector circuits, a scanning line is selected, and therefore, particularly a luminance difference is liable to appear. Accordingly, in the case where the present invention is applied to an organic EL display apparatus, the effects of the working examples 1 to 12 are particularly liable to be achieved.

Besides, in an organic EL display apparatus, different from a liquid crystal display apparatus of the ac reversal driving type, the display luminance has a relationship of one direction with respect to the input signal or display data. Therefore, the result of reduction of the luminance difference arising from the select order of the selector circuits is particularly liable to be achieved.

<5. Modifications>

While, in the embodiments described hereinabove, the driving circuit for the organic EL element 21 basically has a pixel configuration configured from two transistors including the driving transistor 22 and the writing transistor 23, the present invention is not limited to the organic EL element of the pixel configuration.

Further, while, in the embodiments described hereinabove, the electro-optical element of the pixel 20 is applied to an organic EL display apparatus which uses an organic EL element, the present invention is not limited to the specific application. In particular, the present invention can be applied to various display apparatus which use an electro-optical device or light emitting element of the current driven type whose emitted light luminance varies in response to the value of current flowing to the device such as an inorganic EL element, an LED element or a semiconductor laser element.

<6. Applications>

The display apparatus according the present invention described above can be applied to a display apparatus for electronic apparatus in various fields wherein an image signal inputted to the electronic apparatus or an image signal generated in the electronic apparatus is displayed as an image or a screen image. As an example, the display apparatus according to the embodiment of the present invention can be applied to a display apparatus for various electronic apparatus shown in FIGS. 48 to 52G such as, for example, a digital camera, a notebook type personal computer, a portable terminal apparatus such as a portable telephone set and a video camera.

By using the display apparatus according to the embodiment of the present invention as a display apparatus for electronic apparatus in various fields in this manner, the picture quality of the display image on the various electronic apparatus can be improved. In particular, as apparent from the foregoing description of the embodiments, the display apparatus according to the present invention can implement, in the case where both of the mirror type layout structure and the selector driving method are used, higher picture quality because accurate display signals can be written into signal lines. Accordingly, in the various electronic apparatus, the picture quality of a display image can be further improved.

The display apparatus according to the embodiment of the present invention includes a display apparatus of the module type of a sealed configuration. This may be, for example, a display module wherein an opposing section of transparent glass or the like is adhered to the pixel array section 30. This transparent opposing section may have a color filter, a protective film or the like or else such a light blocking film as described hereinabove provided thereon. It is to be noted that the display module may include a circuit section, a flexible printed circuit (FPC) or the like for inputting and outputting signals or the like from the outside to the signal array section or vice versa.

In the following, particular examples of an electronic apparatus to which the embodiment of the present invention is applied are described.

Figure 48:
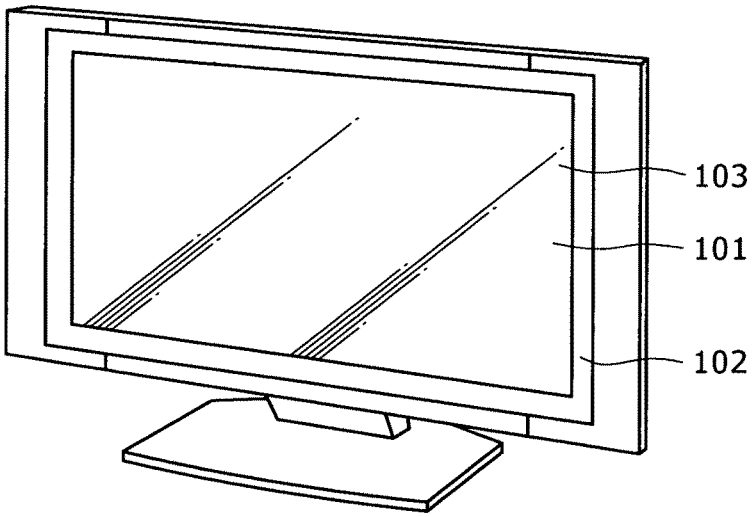
FIG. 48 is a perspective view showing an appearance of a television set to which the present invention is applied.

FIG. 48 is a perspective view showing an appearance of a television set to which the embodiment of the present invention is applied. Referring to FIG. 48, the television set according to the present application includes an image display screen section 101 configured from a front panel 102, a glass filter 103 and so forth. The display apparatus according to the present invention is used as the image display screen section 101.

Figure 49A:
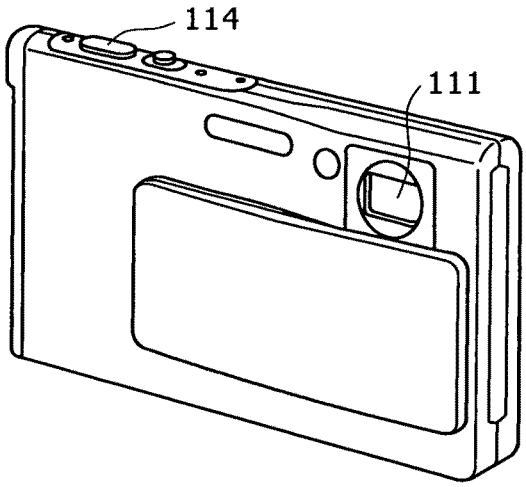
FIGS. 49A and 49B are perspective views showing appearances of a digital camera to which the present invention is applied as viewed from the front side and the rear side, respectively.
Figure 49B:
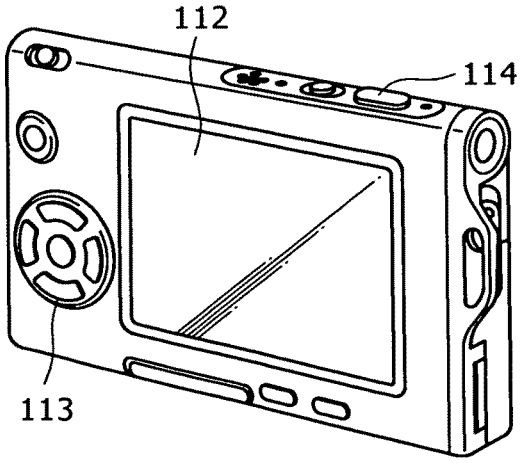

FIGS. 49A and 49B are perspective views showing an appearance of a digital camera to which the embodiment of the present invention is applied as viewed from the front side and the rear side, respectively. Referring to FIGS. 49A and 49B, the digital camera according to the present application includes a light emitting section 111 for emitting flash light, a display section 112, a menu switch 113, a shutter button 114 and so forth. The display apparatus according to the embodiment of the present invention is used as the display section 112.

Figure 50:
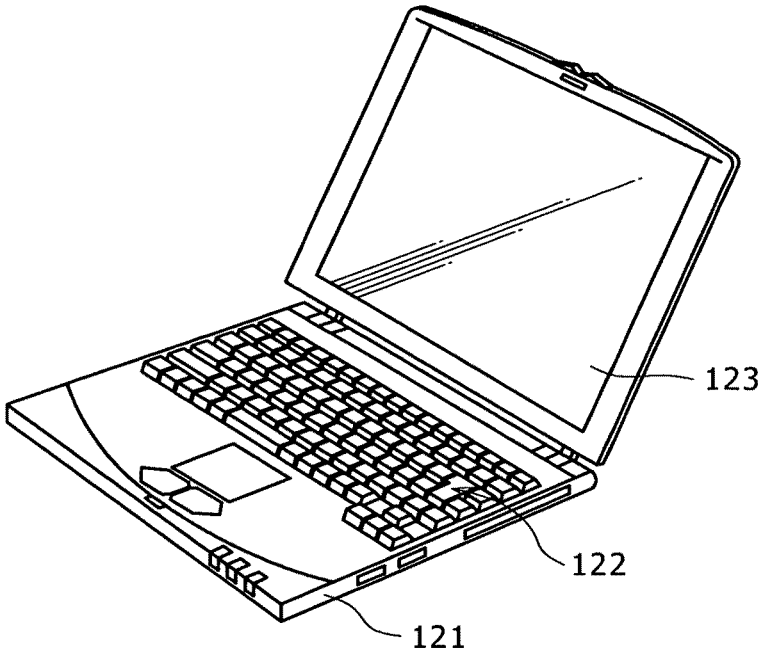
FIG. 50 is a perspective view showing an appearance of a notebook type personal computer to which the present invention is applied.

FIG. 50 is a perspective view showing an appearance of a notebook type personal computer to which the embodiment of the present invention is applied. Referring to FIG. 50, the notebook type personal computer according to the embodiment of the present application includes a keyboard 122 for being operated to input a character and so forth, a display section 123 for displaying an image, and so forth, all mounted on a main body 121. The display apparatus according to the present invention is used as the display section 123.

Figure 51:
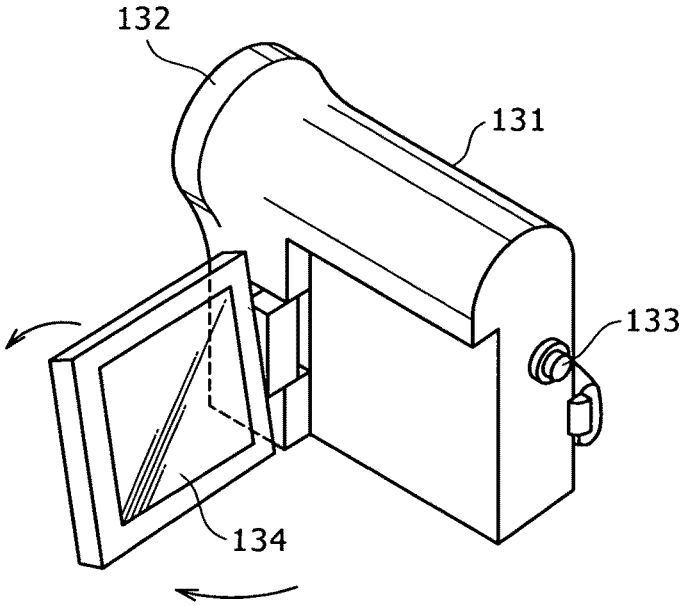
FIG. 51 is a perspective view showing an appearance of a video camera to which the present invention is applied.

FIG. 51 is a perspective view showing an appearance of a video camera to which the embodiment of the present invention is applied. Referring to FIG. 51, the video camera according to the embodiment of the present application includes a main body section 131, a lens 132 provided on a side face directed forwardly of the main body section 131 for picking up an image of an image pickup object, a start/stop switch 133 for image pickup, a display section 134 and so forth. The display apparatus according to the embodiment of the present invention is used as the display section 134.

Figure 52A:
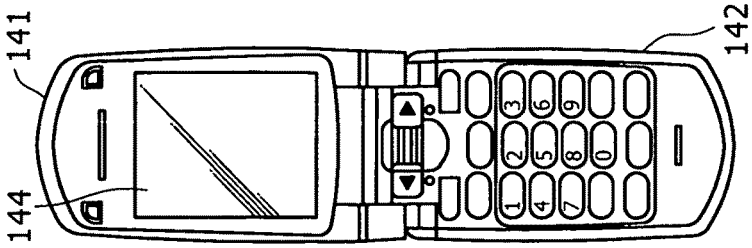
FIGS. 52A and 52B are a front elevational view and a side elevational view, respectively, showing appearances of a portable telephone set to which the present invention is applied and which is in an unfolded state
Figure 52B:
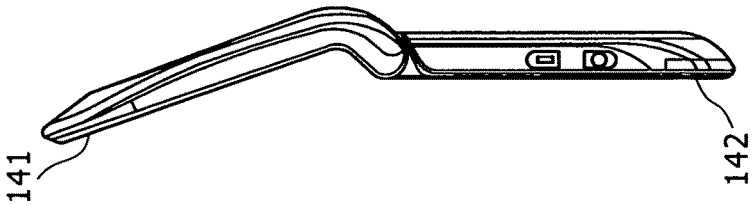
Figure 52D:
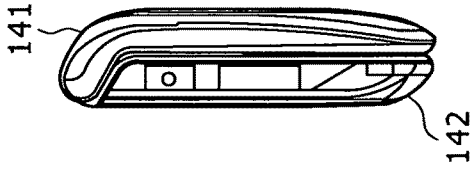
FIGS. 52C, 52D, 52E, 52F and 52G are a front elevational view, a left side elevational view, a right side elevational view, a top plan view and a bottom plan view, respectively, of the portable telephone set in a folded state.
Figure 52C:
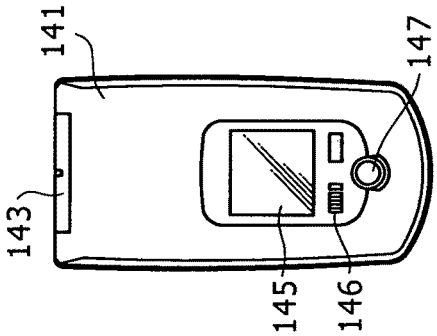
Figure 52E:
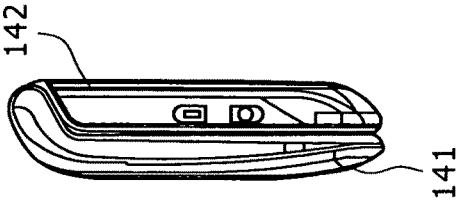
Figure 52F:
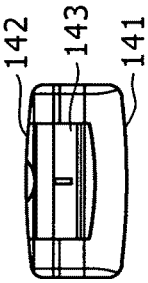
Figure 52G:
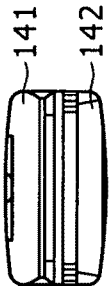

FIGS. 52A to 52G show an appearance of a portable terminal apparatus, for example, a portable telephone set, to which the present invention is applied. In particular, FIGS. 52A and 52B are a front elevational view and a side elevational view of the portable telephone set in an unfolded state, respectively. Meanwhile, FIGS. 52C, 52D, 52E, 52F and 52G are a front elevational view, a left side elevational view, a right side elevational view, a top plan view and a bottom plan view of the portable telephone set in a folded state. Referring to FIGS. 52A to 52G, the portable telephone set includes an upper side housing 141, a lower side housing 142, a connection section 143 in the form of a hinge section, a display unit 144, a sub display unit 145, a picture light 146, a camera 147 and so forth. The display apparatus according to the embodiment the present invention is used as the display unit 144 and/or the sub display unit 145.

While preferred embodiments of the present invention have been described using specific terms, such description is for illustrative purpose only, and it is to be understood that changes and variations may be made without departing from the spirit or scope of the following claims.

The present application contains subject matter related to that disclosed in Japanese Priority Patent Application JP 2010-089803 filed in the Japan Patent Office on Apr. 8, 2010, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus, comprising:

a pixel array section including a plurality of pixel circuits arrayed in rows and columns of a matrix and each including a light emitting portion;

a plurality of signal lines disposed individually for the pixel columns of the matrix array of said pixel circuits and connected to the pixel circuits belonging to the pixel columns; and a selector circuit for distributing display signals given thereto in a time series from an input signal line time-divisionally to the signal lines; wherein said pixel array section has, in regard to any of combinations of those two signal lines which are individually connected to the pixel circuits which belong to those two pixel columns which neighbor with each other, a first wiring region in which, in the case where the display signals are to be distributed at different timings to the two signal lines of the combination by said selector circuit, the two signal lines are wired so as not to neighbor with each other, and a second wiring region in which, in the case where the display signals are to be distributed at the same timing to the two signal lines of the combination by said selector circuit, the two signal lines are wired so as to neighbor with each other.

2. The display apparatus according to claim 1, wherein said pixel circuits are laid out on one direction side in the row direction of the matrix pixel array of said pixel array section as viewed from the signal lines connected to said pixel circuits.

3. The display apparatus according to claim 2, wherein the pixel circuits belonging to the two pixel columns neighboring with each other are laid out symmetrically with each other with respect to an axis of a column direction of the matrix pixel array of said pixel array section.

4. The display apparatus according to claim 2, wherein each of the pixel circuits belonging to the two pixel columns neighboring with each other has a signal line on the opposite side to the neighboring side and has a power supply line wired in the column direction of the matrix pixel array of said pixel array section on the neighboring side.

5. The display apparatus according to claim 4, wherein each of said pixel circuits supply direct current corresponding to a display signal supplied to the signal line to said light emitting portion to drive said light emitting portion to emit light.

6. The display apparatus according to claim 5, wherein said selector circuit changes a distribution order, in which said selector circuit time-divisionally distributes the display signals to the plural signal lines within one horizontal period, in a fixed cycle.

7. The display apparatus according to claim 6, wherein the fixed cycle is given with reference to one frame cycle.

8. The display apparatus according to claim 7, wherein the distribution order of said selector circuit is reversed in the fixed frame cycle.

9. The display apparatus according to claim 7, wherein the distribution order of said selector circuit is shifted and rotated in the fixed frame cycle.

10. The display apparatus according to claim 6, wherein the fixed cycle is given with reference to a cycle of one horizontal period.

11. The display apparatus according to claim 10, wherein the distribution order of said selector circuit is reversed in a fixed horizontal period cycle.

12. The display apparatus according to claim 10, wherein the distribution order of said selector circuit is shifted and rotated in a fixed horizontal period cycle.

13. The display apparatus according to claim 6, wherein the fixed cycle is given with reference to an operation period cycle of said selector circuit.

14. The display apparatus according to claim 13, wherein the distribution order of said selector circuit is reversed in an operation period cycle corresponding to a fixed selector circuit number.

15. The display apparatus according to claim 13, wherein the distribution order of said selector circuit is shifted and rotated in an operation period cycle corresponding to a fixed selector circuit number.

16. The display apparatus according to claim 6, wherein said selector circuit inputs the same signal collectively to said signal lines before the display signals are distributed time-divisionally to said signal lines.

17. The display apparatus according to claim 6, wherein said selector circuit distributes the display signals time-divisionally to said signal lines in a state in which said pixel circuits are not selected, and said pixel circuits are selected after the display signals are distributed by said selector circuit.

18. The display apparatus according to claim 17, wherein said light emitting portion is formed from an organic electroluminescence element.

19. A layout method for a display apparatus which includes a pixel array section including a plurality of pixel circuits arrayed in rows and columns of a matrix and each including a light emitting portion, a plurality of signal lines disposed individually for the pixel columns of the matrix array of the pixel circuits and connected to the pixel circuits belonging to the pixel columns, and a selector circuit for distributing display signals given thereto in a time series from an input signal line time-divisionally to the signal lines, the layout method comprising the step of:

laying out the signal lines such that, in regard to any of combinations of those two signal lines which are individually connected to the pixel circuits which belong to those two pixel columns which neighbor with each other, the two signal lines are wired so as not to neighbor with each other in the case where the display signals are to be distributed at different timings to the two signal lines of the combination by the selector circuit, but the two signal lines are wired so as to neighbor with each other in the case where the display signals are to be distributed at the same timing to the two signal lines of the combination by the selector circuit.

20. An electronic apparatus, comprising:

a display apparatus including a pixel array section including a plurality of pixel circuits arrayed in rows and columns of a matrix and each including a light emitting portion, a plurality of signal lines disposed individually for the pixel columns of the matrix array of said pixel circuits and connected to the pixel circuits belonging to the pixel columns, and a selector circuit for distributing display signals given thereto in a time series from an input signal line time-divisionally to the signal lines; wherein said pixel array section has, in regard to any of combinations of those two signal lines which are individually connected to the pixel circuits which belong to those two pixel columns which neighbor with each other, a first wiring region in which, in the case where the display signals are distributed at different timings to the two signal lines of the combination by said selector circuit, the two signal lines are wired so as not to neighbor with each other, and a second wiring region in which, in the case where the display signals are distributed at the same timing to the two signal lines of the combination by said selector circuit, the two signal lines are wired so as to neighbor with each other.

* * * * *